US009593444B2

(12) United States Patent
Nakayama et al.

(10) Patent No.: US 9,593,444 B2
(45) Date of Patent: Mar. 14, 2017

(54) METHOD FOR PRODUCING SIZING AGENT-COATED CARBON FIBERS, AND SIZING AGENT-COATED CARBON FIBERS

(75) Inventors: Yoshifumi Nakayama, Ehime (JP); Toshiya Kamae, Ehime (JP); Daigo Kobayashi, Ehime (JP); Makoto Endo, Ehime (JP)

(73) Assignee: TORAY INDUSTRIES, INC., Tokyo (JP)

( * ) Notice: Subject to any disclaimer, the term of this patent is extended or adjusted under 35 U.S.C. 154(b) by 49 days.

(21) Appl. No.: 13/695,989

(22) PCT Filed: Jun. 24, 2011

(86) PCT No.: PCT/JP2011/064511

§ 371 (c)(1),
(2), (4) Date: Nov. 21, 2012

(87) PCT Pub. No.: WO2012/002266

PCT Pub. Date: Jan. 5, 2012

(65) Prior Publication Data

US 2013/0089736 A1 Apr. 11, 2013

(30) Foreign Application Priority Data

Jun. 30, 2010 (JP) ..... 2010-149130
Aug. 2, 2010 (JP) ..... 2010-173398
Dec. 24, 2010 (JP) ..... 2010-287142

(51) Int. Cl.

| | |
|---|---|
| ***B05D 3/02*** | (2006.01) |
| ***D06M 15/55*** | (2006.01) |
| ***D06M 13/285*** | (2006.01) |
| ***D06M 13/325*** | (2006.01) |
| ***D06M 13/46*** | (2006.01) |
| ***D01F 9/12*** | (2006.01) |
| ***D06M 15/555*** | (2006.01) |
| ***D06M 13/328*** | (2006.01) |
| ***D06M 13/35*** | (2006.01) |
| ***D06M 13/352*** | (2006.01) |
| ***D06M 13/355*** | (2006.01) |
| *D06M 101/40* | (2006.01) |

(52) U.S. Cl.

CPC ..... *D06M 15/55* (2013.01); *D01F 9/12* (2013.01); *D06M 13/285* (2013.01); *D06M 13/325* (2013.01); *D06M 13/328* (2013.01); *D06M 13/35* (2013.01); *D06M 13/352* (2013.01); *D06M 13/355* (2013.01); *D06M 13/46* (2013.01); *D06M 15/555* (2013.01); *D06M 2101/40* (2013.01); *D06M 2200/40* (2013.01); *D06M 2200/50* (2013.01); *Y10T 428/2933* (2015.01)

(58) Field of Classification Search

CPC ..... D06M 15/555; D06M 13/285; D06M 13/325; D06M 13/46; D06M 2101/40; D06M 2200/40; D06M 2200/50; D06M 13/328; D06M 13/35; D06M 13/352; D06M 13/355; D01F 9/12; Y10T 428/2933

USPC ..... 427/384

See application file for complete search history.

(56) References Cited

U.S. PATENT DOCUMENTS

| | | | | |
|---|---|---|---|---|
| 2,928,807 | A * | 3/1960 | Belanger | C08G 59/42 525/530 |
| 3,865,705 | A * | 2/1975 | Rieux et al. | 428/367 |
| 6,315,824 | B1 * | 11/2001 | Lauzon | 106/287.2 |
| 6,503,967 | B1 * | 1/2003 | Kitajima et al. | 523/421 |
| 2002/0150755 | A1 * | 10/2002 | Kobayashi et al. | 428/364 |
| 2005/0196619 | A1 * | 9/2005 | Nakanishi | B32B 15/08 428/416 |
| 2009/0162653 | A1 * | 6/2009 | Sakata et al. | 428/367 |

FOREIGN PATENT DOCUMENTS

| | | | |
|---|---|---|---|
| JP | 60-139875 | A | 7/1985 |
| JP | 2000-355630 | A | 12/2000 |
| JP | 2003-64577 | A | 3/2003 |
| JP | 2005-146431 | A | 6/2005 |
| JP | 2010-57462 | A | 3/2010 |

OTHER PUBLICATIONS

International Search Report issued in PCT/JP2011/064511 mailed Oct. 18, 2011.

* cited by examiner

*Primary Examiner* — Robert S Walters, Jr.
(74) *Attorney, Agent, or Firm* — Birch, Stewart, Kolasch & Birch, LLP

(57) ABSTRACT

Disclosed is a method for producing a sizing agent-coated carbon fibers, wherein at least one kind of sizing agent that is selected from the group consisting of sizing agents (a), (b) and (c) is used for coating, in each of the sizing agents a bi- or higher functional epoxy compound (A1) and/or an epoxy compound (A2) being used as a component (A), and the epoxy compound (A2) having a mono- or higher functional epoxy group and at least one functional group that is selected from among a hydroxyl group, an amide group, an imide group, a urethane group, a urea group, a sulfonyl group and a sulfo group. The sizing agent is applied to carbon fibers and the resulting is subjected to a heat treatment within the temperature range of 160-260° C. for 30-600 seconds.

7 Claims, No Drawings

METHOD FOR PRODUCING SIZING AGENT-COATED CARBON FIBERS, AND SIZING AGENT-COATED CARBON FIBERS

TECHNICAL FIELD

The present invention relates to a method for producing sizing agent-coated carbon fibers suitably used for aircraft members, spacecraft members, motor vehicle members and seacraft members, and the sizing agent-coated carbon fibers. In more detail, this invention relates to a method for producing sizing agent-coated carbon fibers excellent in adhesion to the matrix resin and excellent also in processability, and the sizing agent-coated carbon fibers.

BACKGROUND ART

Since carbon fibers are excellent in strength and elastic modulus though light in weight, composite materials obtained by combining carbon fibers with various matrix resins are used in many fields including aircraft members, spacecraft members, motor vehicle members, seacraft members, civil engineering and architectural materials and sports articles. In the composite materials obtained by using carbon fibers, the adhesion between the carbon fibers and the matrix resin is important in order that the excellent properties of the carbon fibers can be used.

In order to enhance the adhesion between the carbon fibers and the matrix resin, normally oxidation treatment such as gas-phase oxidation or liquid-phase oxidation is applied to the carbon fibers as a method for introducing oxygen-containing functional groups into the surface of the carbon fibers. For example, a method of enhancing the interlaminar shear strength used as an indicator of adhesion by electrolytically treating carbon fibers is proposed (see patent document 1). However, in recent years, as the level of properties required for the composite materials rises, the adhesion that can be achieved by such oxidation treatment alone becomes less sufficient.

On the other hand, carbon fibers are fragile and poor in bundling properties and abrasion resistance, fuzz and fiber breakage are likely to occur. For this reason, normally, a method of coating carbon fibers with a sizing agent is used.

For example, methods of coating carbon fibers with bisphenol A diglycidyl ether as a sizing agent are proposed (see patent documents 2 and 3). Further, methods of coating carbon fibers with a polyalkylene oxide addition product of bisphenol A as a sizing agent are proposed (see patent documents 4 and 5). Furthermore, methods of coating carbon fibers with a material obtained by adding epoxy groups to a polyalkylene oxide addition product of bisphenol A as a sizing agent are proposed (see patent documents 6 and 7). Moreover, methods of coating carbon fibers with an epoxy addition product of a polyalkylene glycol as a sizing agent are proposed (see patent documents 8, 9 and 10).

In addition, a method of coating carbon fibers with an urethane compound having an epoxy group and a quaternary ammonium salt as a sizing agent is proposed (see patent document 11). Either with the proposed method, the adhesion between the carbon fibers and the matrix resin cannot be enhanced, though bundling properties and abrasion resistance can be enhanced.

These methods are known to enhance the bundling properties and abrasion resistance of carbon fibers. However, these conventional proposals lack the technical idea of positively enhancing the adhesion between the carbon fibers and the matrix resin by using a sizing agent, and actually cannot highly enhance the adhesion between the carbon fibers and the matrix resin.

On the other hand, methods of coating carbon fibers with a specific sizing agent for the purpose of enhancing the impregnability of the matrix resin into the carbon fibers are used.

For example, a method of coating carbon fibers with a cationic surfactant having a surface tension of 40 mN/m or lower and a viscosity of 200 mPa·s or lower at 80° C. as a sizing agent is proposed (see patent document 12). Further, a method of coating carbon fibers with an epoxy resin, water soluble polyurethane resin and a polyether resin as sizing agents is proposed (see patent document 13). These methods are found to enhance the bundling properties of the carbon fibers and the impregnability of the matrix resin into the carbon fibers. However, these conventional proposals also lack the technical idea of positively enhancing the adhesion between the carbon fibers and the matrix resin by using a sizing agent, and actually cannot highly enhance the adhesion between the carbon fibers and the matrix resin.

As described above, sizing agents are hitherto used as so-called sizes for the purpose of enhancing processability or for the purpose of enhancing the impregnability of the matrix resin into the carbon fibers, and few studies have been made to enhance the adhesion between the carbon fibers and the matrix resin by using a sizing agent. Further, even in the studies made, the obtained effect is limited such that the effect of enhancing the adhesion is insufficient or that the effect can be exhibited only in the case where special carbon fibers are used in combination.

For example, a method of coating carbon fibers with N,N,N',N'-tetraglycidyl metaxylylenediamine as a sizing agent is proposed (see patent document 14). However, though it is demonstrated that this proposed method enhances the interlaminar shear strength used as an indicator of the adhesion compared with the case of using bisphenol A glycidyl ether, the effect of enhancing the adhesion is still insufficient. Further, the N,N,N',N'-tetraglycidyl metaxylylenediamine used in this proposal contains an aliphatic tertiary amine in the structure thereof and is nucleophilic, and therefore self-polymerization reaction occurs. As a result, the carbon fiber bundles become harder with the lapse of time and there is a problem that the processability declines.

Further, a method of coating carbon fibers with a mixture comprising a vinyl compound monomer having a glycidyl group and an amine curing agent for an epoxy resin as a sizing agent is proposed (see patent document 15). However, though this proposed method is demonstrated to enhance the interlaminar shear strength used as an indicator of the adhesion, compared with a case where no amine curing agent is used, the effect of enhancing the adhesion is still insufficient. Further, there is a problem that in the step of drying the sizing agent, the glycidyl groups and the amine curing agent react and it become a high molecular weight, that as a result, the carbon fiber bundles become so hard as to lower the processability, and furthermore that the gaps among the carbon fibers become so narrow that the impregnability of the resin declines. Another method of using an epoxy-based compound and an amine curing agent together as a sizing agent is also proposed (see patent document 16). However, according to this proposal, while the handling properties and impregnability of fiber bundles are enhanced, the sizing agent enhanced in molecular weight on the surface of carbon fibers may form a film, to inhibit the adhesion between the carbon fibers and the epoxy matrix resin as the case may be.

Moreover, a method of coating carbon fibers with an amine compound is proposed (see patent document 17). However, though this proposed method demonstrates that the interlaminar shear strength used as an indicator of the adhesion can be enhanced compared with the case of no coating, the effect of enhancing the adhesion is still insufficient. This proposal does not describe the detail of the mechanism of enhancing the adhesion, but the mechanism is estimated approximately as described below. In this proposal, diethylenetriamine and xylenediamine respectively containing a primary amino group, and piperidine and imidazole respectively containing a secondary amino group are used as amine compounds. Since any of the amine compounds contains active hydrogen in the molecule, it is considered that the active hydrogen acts on the epoxy matrix resin, to promote the curing reaction, and that, for example, the hydroxyl groups produced by the reaction between the epoxy matrix and the aforementioned amine compound and the carboxyl groups, hydroxyl groups and the like on the surface of carbon fibers form hydrogen-bondable interactions, to enhance the adhesion. However, as described before, the result of enhancing the adhesion by this proposal is still insufficient, and does not satisfy the requirement for the composite materials of recent years.

As a further other example of using an amine compound as a sizing agent, a method of using a hardened product comprising a thermosetting resin and an amine compound is proposed (see patent document 18). In this proposal, as the amine compound, m-xylenediamine containing a primary amino group, piperazine containing a secondary amino group or the like is used. The main purpose of this proposal is to positively react the active hydrogen contained in the amine compound and a thermosetting resin typified by an epoxy resin, for obtaining a hardened product, thereby enhancing the bundling properties and handling properties of carbon fiber bundles. The carbon fiber bundles are limited for use as chopped fibers, and the mechanical properties concerning the adhesion of molded articles after melt kneading with a thermoplastic resin are still insufficient.

Further, a method of using carbon fibers having a surface oxygen concentration (O/C), surface hydroxyl group concentration and carboxyl group concentration respectively in specific ranges as carbon fibers, and coating the carbon fibers with an aliphatic compound having a plurality of epoxy groups used as a sizing agent is proposed (see patent document 19). However, though the proposed method demonstrates that EDS as an indicator of the adhesion can be enhanced, the effect of enhancing the adhesion between the carbon fibers and the matrix resin is still insufficient. Further, the effect of enhancing the adhesion can be exhibited only in the limited case of using specific carbon fibers in combination.

PRIOR ART DOCUMENTS

Patent Documents

Patent document 1: JP 04-361619 A
Patent document 2: U.S. Pat. No. 3,957,716
Patent document 3: JP 57-171767 A
Patent document 4: JP 07-009444 A
Patent document 5: JP 2000-336577 A
Patent document 6: JP 61-028074 A
Patent document 7: JP 01-272867 A
Patent document 8: JP 57-128266 A
Patent document 9: U.S. Pat. No. 4,555,446
Patent document 10: JP 62-033872 A
Patent document 11: U.S. Pat. No. 4,496,671
Patent document 12: JP 2010-31424 A
Patent document 13: JP 2005-320641 A
Patent document 14: JP 52-059794 A
Patent document 15: JP 52-045673 A
Patent document 16: JP 2005-146429 A
Patent document 17: JP 52-045672 A
Patent document 18: JP 09-217281 A
Patent document 19: U.S. Pat. No. 5,691,055

SUMMARY OF THE INVENTION

Problems to be Solved by the Invention

In view of the abovementioned problems of the prior art, the object of this invention is to provide a method for producing sizing agent-coated carbon fibers excellent in the adhesion between the carbon fiber and the matrix resin and also excellent in processability, and the sizing agent-coated carbon fibers.

Means for Solving the Problems

The present inventors coated carbon fibers with a sizing agent containing (A) a specific epoxy compound and (B) a specific tertiary amine compound and/or tertiary amine salt, quaternary ammonium salt, quaternary phosphonium salt and/or phosphine compound at a specific ratio, and heat-treated at a specific temperature for a specific time, to find that the adhesion between the carbon fibers and the matrix resin could be enhanced, thus arriving at the present invention.

That is, the present invention is a method for producing sizing agent-coated carbon fibers coated with at least one sizing agent selected from the group including the following [a], [b] and [c] wherein a di- or higher functional epoxy compound (A1) and/or an epoxy compound (A2) having mono- or higher functional epoxy groups and at least one or more types of functional groups selected from hydroxyl groups, amide groups, imide groups, urethane groups, urea groups, sulfonyl groups and sulfo groups are/is used as component (A), comprising the steps of coating carbon fibers with said sizing agent and heat-treating in a temperature range from160 to 260° C. for 30 to 600 seconds.

[a] A sizing agent obtained by mixing at least 0.1 to 25 parts by mass of a tertiary amine compound and/or tertiary amine salt (B1) with a molecular weight of 100 g/mol or higher used as component (B), with 100 parts by mass of the component (A) [b] A sizing agent obtained by mixing at least 0.1 to 25 parts by mass of a quaternary ammonium salt (B2) having a cationic moiety represented by either the following general formula (I) or (II) used as component (B), with 100 parts by mass of the component (A)

[Chemical formula 1]

Formula (I)

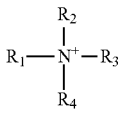

-continued

[Chemical formula 2]

Formula (II)

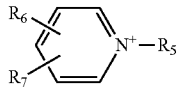

(where $R_1$ to $R_5$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; $R_6$ and $R_7$ denote, respectively independently, any one of a hydrogen, a hydrocarbon group with 1 to 8 carbon atoms, a group containing a hydrocarbon with 1 to 8 carbon atoms and an ether structure, and a group containing a hydrocarbon with 1 to 8 carbon atoms and an ester structure)

[c] A sizing agent obtained by mixing at least 0.1 to 25 parts by mass of a quaternary phosphonium salt and/or phosphine compound (B3) used as component (B), with 100 parts by mass of the component (A)

In a preferred mode of the method for producing sizing agent-coated carbon fibers of this invention, the tertiary amine compound and/or tertiary amine salt (B1) with a molecular weight of 100 g/mol or higher of the abovementioned [a] is a tertiary amine compound and/or tertiary amine salt represented by the following general formula (III):

[Chemical formula 3]

Formula (III)

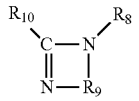

(where $R_8$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and where, $R_9$ denotes an alkylene group with 3 to 22 carbon atoms and may also contain an unsaturated group; and $R_{10}$ denotes any one of a hydrogen, a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; or $R_8$ and $R_{10}$ may be combined with each other to form an alkylene group with 2 to 11 carbon atoms),or the following general formula (IV):

[Chemical formula 4]

Formula (IV)

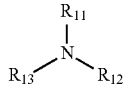

(where $R_{11}$ to $R_{13}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to, 22 carbon atoms and a hydroxyl group), or the following general formula (V):

[Chemical formula 5]

Formula (V)

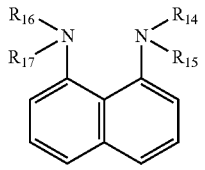

(where $R_{14}$ to $R_{17}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group), or the following general formula (VI):

[Chemical formula 6]

Formula (VI)

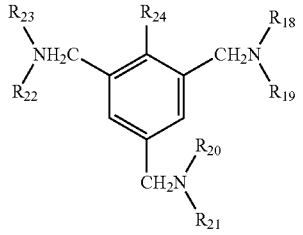

(where $R_{18}$ to $R_{23}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; $R_{24}$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, a group containing a hydrocarbon with 1 to 22 carbon atoms and a hydroxyl group, and a hydroxyl group).

In a preferred mode of the method for producing a sizing agent-coated carbon fibers of this invention, the compound represented by the general formula (III) is 1,5-diazabicyclo[4,3,0]-5-nonene or a salt thereof, or 1,8-diazabicyclo[5,4,0]-7-undecene or a salt thereof.

In a preferred mode of the method for producing sizing agent-coated carbon fibers of this invention, in the general formula (1) of the aforementioned [b], $R_1$ and $R_2$ denote any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; $R_3$ and $R_4$ denote any one of a hydrocarbon group with 2 to 22 carbon atoms, a group containing a hydrocarbon with 2 to 22 carbon atoms and an ether structure, a group containing a hydrocarbon with 2 to 22 carbon atoms and an ester structure, and a group containing a hydrocarbon with 2 to 22 carbon atoms and a hydroxyl group; in the general formula (II), $R_5$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and $R_6$ and $R_7$ denote, respectively independently, any one of a hydrogen, a hydrocarbon group with 1 to 8 carbon atoms, a group containing a hydrocarbon with 1 to 8 carbon atoms and an ether structure, and a group containing a hydrocarbon with 1 to 8 carbon atoms and an ester structure.

In a preferred mode of the method for producing a sizing agent-coated carbon fibers of this invention, the anionic moiety of the quaternary ammonium salt (B2) having a cationic moiety of the aforementioned [b] is a halogen ion.

In a preferred mode of the method for producing a sizing agent-coated carbon fibers of this invention, the quaternary phosphonium salt and/or phosphine compound (B3) in the aforementioned [c] is a quaternary phosphonium salt or phosphine compound represented by the following general formula (VII) or (VIII).

[Chemical formula 7]

Formula (VII)

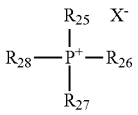

[Chemical formula 8]

Formula (VIII)

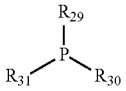

(where $R_{25}$ to $R_{31}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group).

In a preferred mode of the method for producing sizing agent-coated carbon fibers of this invention, 0.1 to 10 parts by mass of a quaternary phosphonium salt and/or phosphine compound (B3) are mixed with 100 parts by mass of the component (A).

In a preferred mode of the method for producing sizing agent-coated carbon fibers of this invention, the carbon fibers are electrolytically oxidized in a liquid phase in an alkaline electrolyte or electrolytically oxidized in a liquid phase in an acidic electrolyte and in succession washed in an alkaline aqueous solution, being subsequently coated with the sizing agent.

In a preferred mode of the method for producing sizing agent-coated carbon fibers of this invention, the epoxy equivalent of the component (A) is less than 360 g/mol.

In a preferred mode of the method for producing sizing agent-coated carbon fibers of this invention, the component (A) is a tri- or higher functional epoxy compound.

In a preferred mode of the method for producing sizing agent-coated carbon fibers of this invention, the component (A) contains an aromatic ring in the molecule.

In a preferred mode of the method for producing sizing agent-coated carbon fibers of this invention, the component (A1) is any one of a phenol novolac type epoxy resin, a cresol novolac type epoxy resin and tetraglycidyldiaminodiphenylmethane.

In a preferred mode of the method for producing sizing agent-coated carbon fibers of this invention, the surface oxygen concentration (O/C) of the carbon fibers measured by X-ray photoelectron spectroscopy is 0.05 to 0.5.

Further, when the present inventors coated carbon fibers with a sizing agent containing a specific tertiary amine compound and/or tertiary amine salt, they found that the adhesion between the carbon fibers and the matrix resin was enhanced, thus being able to conceive of the present invention.

That is, this invention is sizing agent-coated carbon fibers in which 0.001 to 3 parts by mass of at least one or more tertiary amine compounds and/or tertiary amine salts (B1) with a molecular weight of 100 g/mol or higher selected from the following formulae (III), (V) and (IX) are deposited on 100 parts by mass of carbon fibers, wherein a compound represented by the general formula (IX) has at least one or more branched structures and contains at least one or more hydroxyl groups.

[Chemical formula 9]

Formula (III)

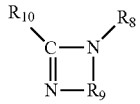

(where $R_8$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and where $R_9$ denotes an alkylene group with 3 to 22 carbon atoms, and may also contain an unsaturated group; and $R_{10}$ denotes any one of a hydrogen, a hydrocarbon group with 1 to 22 carbon atoms, a group containing a hydrocarbon with 1 to 22 carbon atoms and an ether group, a group containing a hydrocarbon with 1 to 22 carbon atoms and an ester structure, and a group containing a hydrocarbon with 1 to 22 carbon atoms and a hydroxyl group; or $R_8$ and $R_{10}$ may be combined with each other to form an alkylene group with 2 to 11 carbon atoms).

[Chemical formula 10]

Formula (V)

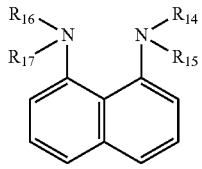

(where $R_{14}$ to $R_{17}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group).

[Chemical formula 11]

Formula (IX)

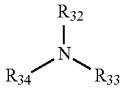

(where $R_{32}$ to $R_{34}$ denote any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and any one of $R_{32}$ to $R_{34}$ contains a branched structure represented by general formula (X) or (XI).)

[Chemical formula 12]

Formula (X)

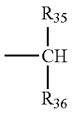

(where $R_{35}$ and $R_{36}$ denote any one of a hydrocarbon group with 1 to 10 carbon atoms, a group containing a hydrocarbon with 1 to 10 carbon atoms and an ether structure, a group containing a hydrocarbon with 1 to 10 carbon atoms and an ester group, a group containing a hydrocarbon with 1 to 10 carbon atoms and a hydroxyl group, and a hydroxyl group.)

[Chemical formula 13]

Formula (XI)

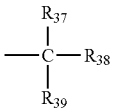

(where $R_{37}$ to $R_{39}$ denote any one of a hydrocarbon group with 1 to 10 carbon atoms, a group containing a hydrocarbon with 1 to 10 carbon atoms and an ether structure, a group containing a hydrocarbon with 1 to 10 carbon atoms and an ester structure, a group containing a hydrocarbon with 1 to 10 carbon atoms and a hydroxyl group, and a hydroxyl group).

In a preferred mode of the sizing agent-coated carbon fibers of this invention, a di- or higher functional epoxy compound (A1) and/or an epoxy compound (A2) having mono- or higher functional epoxy groups and at least one or more types of functional groups selected from hydroxyl groups, amide groups, imide groups, urethane groups, urea groups, sulfonyl groups and sulfo groups are deposited as the component (A).

In a preferred mode of the sizing agent-coated carbon fibers of this invention, the compound represented by the general formula (III) is 1,5-diazabicyclo[4,3,0]-5-nonene or a salt thereof, or 1,8-diazabicyclo[5,4,0]-7-undecene or a salt thereof.

In a preferred mode of the sizing agent-coated carbon fibers of this invention, the compound represented by the general formula (IX) has at least two or more branched structures.

In a preferred mode of the sizing agent-coated carbon fibers of this invention, the compound represented by the general formula (IX) is triisopropanolamine or a salt thereof.

In a preferred mode of the sizing agent-coated carbon fibers of this invention, the epoxy equivalent of the component (A) is less than 360 g/mol.

In a preferred mode of the sizing agent-coated carbon fibers of this invention, the component (A) is a tri- or higher functional epoxy compound.

In a preferred mode of the sizing agent-coated carbon fibers of this invention, the component (A) contains an aromatic ring in the molecule.

In a preferred mode of the sizing agent-coated carbon fibers of this invention, the component (A1) is any one of a phenol novolac type epoxy resin, a cresol novolac type epoxy resin and tetraglycidyldiaminodiphenylmethane.

In a preferred mode of the sizing agent-coated carbon fibers of this invention, the surface oxygen concentration (O/C) of the carbon fibers measured by X-ray photoelectron spectroscopy is 0.05 to 0.5.

Effects of the Invention

According to this invention, in the case where a specific amount of a specific tertiary amine compound and/or tertiary amine salt, quaternary ammonium salt, quaternary phosphonium salt and/or phosphine compound (B) is mixed in a sizing agent containing a specific epoxy compound (A) as a main ingredient and where the mixture is heat-treated under specific conditions, then the formation of covalent bonding between the aforementioned epoxy compound and the oxygen-containing functional groups originally contained in the surface of carbon fibers, or the oxygen-containing functional groups such as carboxyl groups and hydroxyl groups introduced by oxidation treatment is promoted, and carbon fibers highly excellent in adhesion to the matrix resin can be obtained.

Further, according to this invention, in the case where carbon fibers are coated with a sizing agent containing a specific tertiary amine compound and/or tertiary amine salt, the adhesion between the carbon fibers and the matrix resin can be enhanced.

Furthermore, the carbon fibers obtained by the method of producing sizing agent-coated carbon fibers of this invention and the sizing agent-coated carbon fibers of this invention have excellent bundling properties and abrasion resistance, and therefore excellent in processability into woven fabrics and prepregs. The carbon fiber-reinforced composite material obtained from such carbon fibers and a matrix resin is excellent in strength and elastic modulus though light in weight, and consequently can be suitably used in many fields including aircraft members, spacecraft members, motor vehicle members, seacraft members, civil engineering and architectural materials, sports articles, etc.

MODES FOR CARRYING OUT THE INVENTION

Modes for carrying out the method for producing sizing agent-coated carbon fibers of this invention are explained below in more detail. This invention is a method for producing sizing agent-coated carbon fibers coated with at least one sizing agent selected from the group including the following [a], [b] and [c] wherein a di- or higher functional epoxy compound (A1) and/or an epoxy compound (A2) having mono- or higher functional epoxy groups and at least one or more types of functional groups selected from hydroxyl groups, amide groups, imide groups, urethane groups, urea groups, sulfonyl groups and sulfo groups are/is used as component (A), comprising the steps of coating carbon fibers with said sizing agent and heat-treating in a temperature range from160 to 260° C. for 30 to 600 seconds.

[a] A sizing agent obtained by mixing at least 0.1 to 25 parts by mass of a tertiary amine compound and/or tertiary amine salt (B1) with a molecular weight of 100 g/mol or higher used as component (B), with 100 parts by mass of the component (A) [b] A sizing agent obtained by mixing at least 0.1 to 25 parts by mass of a quaternary ammonium salt (B2) having a cationic moiety represented by either the following general formula (I) or (II) used as component (B), with 100 parts by mass of the component (A)

[Chemical formula 14]

Formula (I)

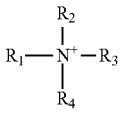

[Chemical formula 15]

Formula (II)

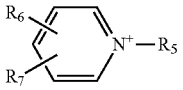

(where $R_1$ to $R_5$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; $R_6$ and $R_7$ denote, respectively independently, any one of a hydrogen, a hydrocarbon group with 1 to 8 carbon atoms, a group containing a hydrocarbon with 1 to 8 carbon atoms and an ether structure, and a group containing a hydrocarbon with 1 to 8 carbon atoms and an ester structure) [c] A sizing agent obtained by mixing at least 0.1 to 25 parts by mass of a quaternary phosphonium salt and/or phosphine compound (B3) used as component (B), with 100 parts by mass of the component (A)

The component (A) used in this invention refers to a compound (A 1) having two or more epoxy groups in the molecule and/or an epoxy resin (A2) having mono- or higher functional epoxy groups and at least one or more types of functional groups selected from hydroxyl groups, amide groups, imide groups, urethane groups, urea groups and sulfonyl groups and sulfo groups.

The component (B) used in this invention refers to at least one compound selected from a tertiary amine compound and/or tertiary amine salt (B1) with a molecular weight of 100 g/mol or higher, a quaternary ammonium salt (B2) having a cationic moiety represented by either the general formula (I) or (II), and a quaternary phosphonium salt and/or phosphine compound (B3).

The mechanism, in which when carbon fibers coated with a sizing agent obtained by mixing specific amounts of the components (A) and (B) are heat-treated under specific conditions the adhesion is enhanced, is not clear. However, it is considered that at first the component (B) acts on the oxygen-containing functional groups such as carboxyl groups and hydroxyl groups of the carbon fibers used in this invention, to extract the hydrogen ions contained in these functional groups, for anionization, and that subsequently the anionized functional groups and the epoxy groups contained in the component (A) perform nucleophilic reaction. Thus, the strong bonding between the carbon fibers used in this invention and the epoxy is formed. On the other hand, the relation with the matrix resin can be explained as described below for each case of (A1) and (A2).

In case of (A1), it is considered that the remaining epoxy groups not participating in the covalent bonding with the carbon fibers used in this invention react with the functional groups contained in the matrix resin, to form covalent bonding or to form hydrogen bonding. Above all, in the case where the matrix resin is an epoxy resin, it is considered that the reaction between the epoxy groups of (A1) and the epoxy groups of the matrix resin and the reaction via the amine curing agent contained in the epoxy resin can form a strong interface. Further, it is preferred that the structure of (A1) contains one or more unsaturated groups, and in the case where the matrix resin is a radical polymerization resin such as an unsaturated polyester resin or a vinyl ester resin, the unsaturated groups of (A1) and the unsaturated groups of the matrix resin can radical-react with each other to form a strong interface.

In case of (A2), the epoxy groups of (A2) form covalent bonding with the oxygen-containing functional groups such as carboxyl groups and hydroxyl groups of the carbon fibers used in this invention, and it is considered that the other hydroxyl groups, amide groups, imide groups, urethane groups, urea groups, sulfonyl groups or sulfo groups interact with the matrix resin, to form covalent bonding, hydrogen bonding or the like in response to the matrix resin used. If the matrix resin is an epoxy resin, it is considered that the hydroxyl groups, amide groups, imide groups, urethane groups, urea groups, sulfonyl groups or sulfo groups of (A2) interact with the epoxy groups of the matrix resin or the hydroxyl groups produced by the reaction between the amine curing agent and the epoxy resins, to form a strong interface. Further, if the matrix resin is a thermoplastic resin typified by a polyamide, polyester or acid-modified polyolefin, it is considered that the hydroxyl groups, amide groups, imide groups, urethane groups, urea groups, sulfonyl groups or sulfo groups of (A2) interact with the amide groups, ester groups or acid anhydride groups contained in any of these matrix resins, and the carboxyl groups, hydroxyl groups or amino groups present at the ends or the like, to form a strong interface.

That is, the remaining epoxy groups not participating in the covalent bonding with the carbon fibers in case of (A1) are considered to have a function corresponding to that of the hydroxyl groups, amide groups, imide groups, urethane groups, urea groups, sulfonyl groups or sulfo groups in case of (A2).

In this invention, it is preferred that the epoxy equivalent of the epoxy compound (A) is less than 360 g/mol. More preferred is less than 270 g/mol, and further more preferred is less than 180 g/mol. If the epoxy equivalent is less than 360 g/mol, covalent bonding is formed at a high density, and the adhesion between the carbon fibers and the matrix resin is further enhanced. The lower limit of the epoxy equivalent is not especially limited, but the adhesion may be saturated at less than 90 g/mol as the case may be.

In this invention, it is preferred that the epoxy compound (A) is a tri- or higher functional epoxy resin. More preferred is a tetra- or higher functional epoxy resin. If the epoxy compound (A) is a tri- or higher functional resin having three or more epoxy groups in the molecule, even in the case where one epoxy group forms covalent bonding with an oxygen-containing functional group on the surface of carbon fibers, the remaining two or more epoxy groups can form covalent bonding or hydrogen bonding with the matrix resin, to further enhance the adhesion. There upper limit in the number of epoxy groups is not especially limited, but the adhesion may be saturated if the number of epoxy groups is 10 or more, as the case may be.

In this invention, it is preferred that the epoxy compound (A) has one or more aromatic ring in the molecule. More preferred is an epoxy compound having two or more aromatic rings. In the fiber reinforced composite material comprising carbon fibers and a matrix resin, the so-called interphase near the carbon fibers is affected by the carbon fibers or the sizing agent and may have properties different from those of the matrix resin as the case may be. If the epoxy compound (A) has one or more aromatic rings, a rigid interphase is formed, to enhance the stress transmission capability between the carbon fibers and the matrix resin and to enhance mechanical properties such as the 0° tensile strength of the fiber reinforced composite material. The upper limit in the number of aromatic rings is not especially limited, but the mechanical properties may be saturated if the number of aromatic rings is 10 or more, as the case may be.

In this invention, it is preferred that the epoxy compound (A1) is any one of a phenol novolac type epoxy resin, a cresol novolac type epoxy resin or tetraglycidyldiaminodiphenylmethane. These epoxy resins are large in the number of epoxy groups, low in epoxy equivalent, have two or more aromatic rings, and can enhance the adhesion between the carbon fibers and the matrix resin and in addition can enhance mechanical properties such as 0° tensile strength of the fiber reinforced composite material. It is more preferred that the di- or higher functional epoxy resin is a phenol novolac type epoxy resin or a cresol novolac type epoxy resin.

In this invention, examples of the di- or higher functional epoxy compound (A1) include a glycidyl ether type epoxy resin derived from a polyol, a glycidyl amine type epoxy resin derived from an amine having a plurality of active hydrogens, a glycidyl ester type epoxy resin derived from a polycarboxylic acid, and an epoxy resin obtained by oxidizing a compound having a plurality of double bonds in the molecule.

Examples of the glycidyl ether type epoxy resin include a glycidyl ether type epoxy resin obtained by reaction between bisphenol A, bisphenol F, bisphenol AD, bisphenol S, tetrabromobisphenol A, phenol novolac, cresol novolac, hydroquinone, resorcinol, 4,4'-dihydroxy-3,3',5,5'-tetramethylbiphenyl, 1,6-dihydroxynaphthalene, 9,9-bis(4-hydroxyphenyefluorene, tris(p-hydroxyphenyl)methane and a glycidyl ether type epoxy resin obtained by the reaction between tetrakis(p-hydroxyphenyl)ethane and epichlorohydrin. Furtherother examples include a glycidyl ether type epoxy resin obtained by the reaction between ethylene glycol, diethylene glycol, triethylene glycol, tetraethylene glycol, polyethylene glycol, propylene glycol, dipropylene glycol, tripropylene glycol, tetrapropylene glycol, polypropylene glycol, trimethylene glycol, 1,2-butanediol, 1,3-butanediol, 1,4-butanediol, 2,3-butanediol, polybutylene glycol, 1,5-pentanediol, neopentyl glycol, 1,6-hexanediol, 1,4-cyclohexanedimethanol, hydrogenated bisphenol A, hydrogenated bisphenol F, glycerol, diglycerol, polyglycerol, trimethylolpropane, pentaerythritol, sorbitol or arabitol and epichlorohydrin. Still further other examples include a glycidyl ether type epoxy resin having a dicyclopentadiene structure and a glycidyl ether type epoxy resin having a biphenylaralkyl structure.

Examples of the glycidyl amine type epoxy resin include N,N-diglycidylaniline, N,N-diglycidyl-o-toluidine, 1,3-bis(aminomethyl)cyclohexane, m-xylylenediamine, m-phenylenediamine, 4,4'-diaminodiphenylmethane and 9,9-bis(4-aminophenyl)fluorene.

Further other examples include an epoxy resin obtained by reacting both the hydroxyl group and the amino group of an aminophenol such as m-aminophenol, p-aminophenol or 4-amino-3-methylphenol with epichlorohydrin.

Examples of the glycidyl ester type epoxy resin include a glycidyl ester type epoxy resin obtained by reacting phthalic acid, terephthalic acid, hexahydrophthalic acid or dimer acid with epichlorohydrin.

Examples of the epoxy resin obtained by oxidizing a compound having a plurality of double bonds in the molecule include an epoxy resin having an epoxycyclohexane ring in the molecule. Further, the epoxy resin can also be an epoxylated soybean oil.

In addition to these epoxy resins, such epoxy resins as triglycidyl isocyanurate can also be used. Further, epoxy resins synthesized by using the abovementioned epoxy resins as raw materials, for example, an epoxy resin synthesized by oxazolidone ring-forming reaction from bisphenol A diglycidyl ether and tolylene diisocyanate can also be used.

In this invention, examples of the epoxy compound (A2) having mono- or higher functional groups and having at least one or more types of functional groups selected from hydroxyl groups, amide groups, imide groups, urethane groups, urea groups, sulfonyl groups and sulfo groups include a compound having epoxy groups and hydroxyl groups, a compound having epoxy groups and amide groups, a compound having epoxy groups and imide groups, a compound having epoxy groups and urethane groups, a compound having epoxy groups and urea groups, a compound having epoxy groups and sulfonyl groups, and a compound having epoxy groups and sulfo groups.

Examples of the compound having epoxy groups and hydroxyl groups include a sorbitol type polyglycidyl ether and glycerol type polyglycidyl ether, etc. Particular examples include Denacol (registered trademark) EX-611, EX-612, EX-614, EX-614B, EX-622, EX-512, EX-521, EX-421, EX-313, EX-314 and EX-321 (produced by Nagase ChemteX. Corporation), etc.

Examples of the compound having epoxy groups and amide groups include glycidylamide, amide-modified epoxy resin, etc. An amide-modified epoxy can be obtained by reacting the epoxy groups of a di- or higher functional epoxy resin with the carboxyl groups of a dicarboxylic acid amide.

Examples of the compound having epoxy groups and imide groups include glycidyl phthalimide, etc. Particular examples include Denacol (registered trademark) EX-731 (produced by Nagase ChemteX Corporation), etc.

Examples of the compound having epoxy groups and urethane groups include a urethane-modified epoxy resin. Particular examples include Adeka Resin (registered trademark) EPU-78-13S, EPU-6, EPU-11, EPU-15, EPU-16A, EPU-16N, EPU-17T-6, EPU-1348 and EPU-1395 (produced by Adeka Corporation), etc. Otherwise, it can also be obtained by reacting a reaction equivalent (based on the amount of the end hydroxyl groups of the polyethylene oxide monoalkyl ether used here) of a polyvalent isocyanate with the end hydroxyl groups of a polyethylene oxide monoalkyl ether and subsequently reacting the hydroxyl groups in a polyvalent epoxy resin with the isocyanate residue of the obtained reaction product. Examples of the polyvalent isocyanate used include 2,4-tolylene diisocyanate, metaphenylene diisocyanate, paraphenylene diisocyanate, diphenylmethane diisocyanate, hexamethylene diisocyanate, isophorone diisocyanate, norbornane diisocyanate, triphenylmethane triisocyanate and biphenyl-2,4,4'-triisocyanate, etc.

Examples of the compound having epoxy groups and urea groups include a urea-modified epoxy resin, etc. The amide-modified epoxy can be obtained by reacting the epoxy groups of a di- or higher functional epoxy resin with the carboxyl groups of dicarboxylic acid urea.

Examples of the compound having epoxy groups and sulfonyl groups include bisphenol S type epoxy, etc.

Examples of the compound having epoxy groups and sulfo groups include p-toluenesulfonic acid glycidyl or 3-nitrobenzenesulfonic acid glycidyl, etc.

(B1) to (B3) used as the component (B) are explained below in succession.

It is necessary that the tertiary amine compound and/or tertiary amine salt (B1) with a molecular weight of 100 g/mol or higher used in this invention is mixed by 0.1 to 25 parts by mass per 100 parts by mass of the epoxy compound (A). A preferred range is 0.5 to 20 parts by mass, and a more preferred range is 2 to 15 parts by mass. A further more preferred range is 2 to 8 parts by mass. If the mixed amount of (B1) is less than 0.1 part by mass, the formation of covalent bonding between the epoxy compound (A) and the oxygen-containing functional groups on the surface of the carbon fibers cannot be promoted, and the adhesion between the carbon fibers and the matrix resin becomes insufficient. On the other hand, if the mixed amount is more than 25 parts by mass, (B1) covers the surface of the carbon fibers, to inhibit the formation of covalent bonding, and the adhesion between the carbon fibers and the matrix resin becomes insufficient.

The molecular weight of the tertiary amine compound and/or tertiary amine salt (B1) with a molecular weight of 100 g/mol or higher used in this invention is required to be 100 g/mol or higher. A preferred range of the molecular weight is 100 to 400 g/mol, and a more preferred range is 100 to 300 g/mol. A further more preferred range is 100 to 200 g/mol. If the molecular weight is 100 g/mol or higher, the volatilization even during heat treatment can be inhibited, and even with a small amount, a large effect of enhancing adhesion can be obtained. On the other hand, if the molecular weight is 400 g/mol or lower, the rate of active sites in the molecule is high, and also with a small amount, a large effect of enhancing adhesion can be obtained.

The tertiary amine compound used in this invention refers to a compound having a tertiary amino group in the molecule. Further, the tertiary amine salt used in this invention refers to a salt obtained by neutralizing a compound having a tertiary amino group by using a proton donor. In this connection, a proton donor refers to a compound having an active hydrogen capable of being given as a proton to a compound having a tertiary amino group. Meanwhile, an active hydrogen refers to a hydrogen atom given as a proton to a basic compound.

Examples of the proton donor include inorganic acids, organic acids such as carboxylic acids, sulfonic acids and phenols, alcohols, mercaptans and 1,3-dicarbonyl compounds, etc.

Examples of the inorganic acids include sulfuric acid, sulfurous acid, persulfuric acid, hydrochloric acid, perchloric acid, nitric acid, phosphoric acid, phosphorous acid, hypophosphorous acid, phosphonic acid, phosphinic acid, pyrophosphoric acid, tripolyphosphoric acid and amidosulfuric acid, etc. Among them, sulfuric acid, hydrochloric acid, nitric acid andphosphoric acid can be preferably used.

The carboxylic acids can be classified into aliphatic polycarboxylic acids, aromatic polycarboxylic acids, S-containing polycarboxylic acids, aliphatic hydroxycarboxylic acids, aromatic hydroxycarboxylic acids, aliphatic monocarboxylic acids and aromatic monocarboxylic acids, and include the following compounds.

Examples of the aliphatic polycarboxylic acids include oxalic acid, malonic acid, succinic acid, glutaric acid, adipic acid, pimelic acid, suberic acid, azelaic acid, sebacic acid, undecanoic diacid, dodecanoic diacid, tridecanoic diacid, tetradecanoic diacid, pentadecanoic diacid, methylmalonic acid, ethylmalonic acid, propylmalonic acid, butylmalonic acid, pentylmalonic acid, hexylmalonic acid, dimethylmalonic acid, diethylmalonic acid, methylpropylmalonic acid, methylbutylmalonic acid, ethyipropylmalonic acid, dipropylmalonic acid, methylsuccinic acid, ethylsuccinic acid, 2,2-dimethylsuccinic acid, 2,3-dimethylsuccinic acid, 2-methylglutaric acid, 3-methylglutaric acid, 3-methyl-3-ethylglutaric acid, 3,3-diethylglutaric acid, 3,3-dimethylglutaric acid, 3-methyladipic acid, maleic acid, fumaric acid, itaconic acid and citraconic acid, etc.

Examples of the aromatic polycarboxylic acids include phthalic acid, isophthalic acid, terephthalic acid, trimellitic acid and pyromellitic acid, etc.

Examples of the S-containing polycarboxylic acids include thiodipropionic acid, etc.

Examples of the aliphatic hydroxycarboxylic acids include glycollic acid, lactic acid, tartaric acid and castor oil fatty acid, etc.

Examples of the aromatic hydroxycarboxylic acids include salicylic acid, mandelic acid, 4-hydroxybenzoic acid, 1-hydroxy-2-naphthoic acid, 3-hydroxy-2-naphthoic acid and 6-hydroxy-2-naphthoic acid, etc.

Examples of aliphatic monocarboxylic acids include formic acid, acetic acid, propionic acid, butyric acid, isobutyric acid, valeric acid, caproic acid, enanthic acid, caprylic acid, octylic acid, pelargonic acid, laurylic acid, myristic acid, stearic acid, behenic acid, undecanoic acid, acrylic acid, methacrylic acid, crotonic acid and oleic acid, etc.

Examples of the aromatic monocarboxylic acids include benzoic acid, cinnamic acid, naphthoic acid, toluic acid, ethylbenzoic acid, propylbenzoic acid, isopropylbenzoic acid, butylbenzoic acid, isobutylbenzoic acid, secondary-butylbenzoic acid, tertiary-butylbenzoic acid, hydroxybenzoic acid, ethoxybenzoic acid, propoxybenzoic acid, isopropoxybenzoic acid, buthoxybenzoic acid, isobutoxybenzoic acid, secondary-butoxybenzoic acid, tertiary-butoxybenzoic acid, aminobenzoic acid, N-methylaminobenzoic acid, N-ethylaminobenzoic acid, N-propylaminobenzoic acid, N-isopropylaminobenzoic acid, N-butylaminobenzoic acid, N-isobutylaminobenzoic acid, N-secondary-butylaminobenzoic acid, N-tertiary-butylaminobenzoic acid, N,N-dimethylaminobenzoic acid, N,N-diethylaminobenzoic acid, nitrobenzoic acid and fluorobenzoic acid, etc.

Among the abovementioned carboxylic acids, aromatic polycarboxylic acids, aliphatic monocarboxylic acids and aromatic carboxylic acids can be preferably used, and particularly, phthalic acid, formic acid and octylic acid can be preferably used.

Sulfonic acids can be classified into aliphatic sulfonic acids and aromatic sulfonic acids, and include the following compounds.

Among the aliphatic sulfonic acids, examples of monovalent saturated aliphatic sulfonic acids include methanesulfonic acid, ethanesulfonic acid, propanesulfonic acid, isopropylsulfonic acid, butanesulfonic acid, isobutylsulfonic acid, tert-butylsulfonic acid, pentanesulfonic acid, isopentylsulfonic acid, hexanesulfonic acid, nonanesulfonic acid, decanesulfonic acid, undecanesulfonic acid, dodecanesulfonic acid, tridecanesulfonic acid, tetradecanesulfonic acid, n-octylsulfonic acid, dodecylsulfonic acid and cetylsulfonic acid, etc.

Among the aliphatic sulfonic acids, examples of monovalent unsaturated aliphatic sulfonic acids include ethylenesulfonic acid and 1-propene-1-sulfonic acid, etc.

Among the aliphatic sulfonic acids, examples of di- or higher valent aliphatic sulfonic acids include methionic acid, 1,1-ethanedisulfonic acid, 1,2-ethanedisulfonic acid, 1,1-propanedisulfonic acid, 1,3-propanedisulfonic acid and polyvinylsulfonic acid, etc.

Among the aliphatic sulfonic acids, examples of hydroxy aliphatic sulfonic acid include isethionic acids and 3-hydroxy-propanesulfonic acid, etc.

Among the aliphatic sulfonic acids, examples of sulfo aliphatic carboxylic acids include sulfoacetic acid and sulfosuccinic acid, etc.

Among the aliphatic sulfonic acids, examples of sulfo aliphatic carboxylic acid esters include di(2-ethylhexyl) sulfosuccinic acid, etc.

Among the aliphatic sulfonic acids, examples of fluorosulfonic acids include trifluoromethanesulfonic acid, perfluoroethanesulfonic acid, perfluoropropanesulfonic acid, perfluoroisopropylsulfonic acid, perfluorobutanesulfonic acid, perfluoroisobutylsulfonic acid, perfluoro-tert-butylsulfonic acid, perfluoropentanesulfonic acid, perfluoroisopentylsulfonic acid, perfluorohexanesulfonic acid, perfluorononanesulfonic acid, perfluorodecanesulfonic acid, perfluoroundecanesulfonic acid, perfluorododecanesulfonic acid, perfluorotridecanesulfonic acid, perfluorotetradecanesulfonic acid, perfluoro-n-octylsulfonic acid, perfluorododecylsulfonic acid and perfluorocetylsulfonic acid, etc.

Among the aromatic sulfonic acids, examples of monovalent aromatic sulfonic acid include benzenesulfonic acid, p-toluenesulfonic acid, o-toluenesulfonic acid, m-toluenesulfonic acid, o-xylene-4-sulfonic acid m-xylene-4-sulfonic acid, 4-ethylbenzenesulfonic acid, 4-propylbenzenesulfonic acid, 4-butylbenzenesulfonic acid, 4-dodecylbenzenesulfonic acid, 4-octylbenzenesulfonic acid, 2-methyl-5-isopropylbenzenesulfonic acid, 2-napthalenesulfonic acid, butylnaphthalenesulfonic acid, t-butylnaphthalenesulfonic acid, 2,4,5-trichlorobenzenesulfonic acid, benzylsulfonic acid and phenylethanesulfonic acid, etc.

Among the aromatic sulfonic acids, examples of di- or higher valent aromatic sulfonic acids include m-benzenedisulfonic acid, 1,4-naphthalenedisulfonic acid, 1,5-naphthalenedisulfonic acid, 1,6-naphthalenedisulfonic acid, 2,6-naphthalenedisulfonic acid, 2,7-naphthalenedisulfonic acid, 1,3,6-naphthalenetrisulfonic acid and sulfonated polystyrene, etc.

Among the aromatic sulfonic acids, examples of hydroxy aromatic sulfonic acids include phenol-2-sulfonic acid, phenol-3-sulfonic acid, phenol-4-sulfonic acid, anisole-o-sulfonic acid, anisole-m-sulfonic acid, phenetole-o-sulfonic acid, phenetole-m-sulfonic acid, phenol-2,4-disulfonic acid, phenol-2,4,6-trisulfonic acid, anisole-2,4-disulfonic acid, phenetole-2,5-disulfonic acid, 2-hydroxytoluene-4-sulfonic acid, pyrocatechin-4-sulfonic acid, veratrol-4-sulfonic acid, resorcin-4-sulfonic acid, 2-hydroxy-1-methoxybenzene-4-sulfonic acid, 1,2-dihydroxybenzene-3,5-disulfonic acid, resorcin-4,6-disulfonic acid, hydroquinonesulfonic acid, hydroquinone-2,5-disulfonic acid and 1,2,3-trihydroxybenzene-4-sulfonic acid, etc.

Among the aromatic sulfonic acids, examples of. sulfo aromatic carboxylic acids include o-sulfobenzoic acid, m-sulfobenzoic acid, p-sulfobenzoic acid, 2,4-disulfobenzoic acid, 3-sulfophthalic acid, 3,5-disulfophthalic acid, 4-sulfoisophthalic acid, 2-sulfoterephthalic acid, 2-methyl-4-sulfobenzoic acid, 2-methyl-3,5-disulfobenzoic acid, 4-propyl-3-sulfobenzoic acid, 2,4,6-trimethyl-3-sulfobenzoic acid, 2-methyl-5-sulfoterephthalic acid, 5-sulfosalicylic acid and 3-hydroxy-4-sulfobenzoic acid, etc.

Among the aromatic sulfonic acids, examples of thio aromatic sulfonic acids include thiophenolsulfonic acid, thioanisole-4-sulfonic acid and thiophenetole-4-sulfonic acid, etc.

Among the aromatic sulfonic acids, examples of other sulfonic acids having functional groups include benzaldehyde-o-sulfonic acid, benzaldehyde-2,4-disulfonic acid, acetophenone-o-sulfonic acid, acetophenone-2,4-disulfonic acid, benzophenone-o-sulfonic acid, benzophenone-3,3'-disulfonic acid, 4-aminophenol-3-sulfonic acid, anthraquinone-1-sulfonic acid, anthraquinone-2-sulfonic acid, anthraquinone-1,5-disulfonic acid, anthraquinone-1,8-disulfonic acid, anthraquinone-2,6-disulfonic acid and 2-methylanthraquinone-l-sulfonic acid, etc.

Among the abovementioned sulfonic acids, a monovalent aromatic sulfonic acid can be preferably used. In particular, benzenesulfonic acid, p-toluenesulfonic acid, o-toluenesulfonic acid and m-toluenesulfonic acid can be preferably used.

Further, with regard to the phenols, examples of a phenol containing one active hydrogen in the molecule include phenol, cresol, ethylphenol, n-propylphenol, isopropylphenol, n-butylphenol, sec-butylphenol, tert-butylphenol, cyclohexylphenol, dimethylphenol, methyl-tert-butylphenol, di-tert-butylphenol, chlorophenol, bromophenol, nitrophenol, methoxyphenol and methyl salicylate, etc. Examples of a phenol containing two active hydrogens in the molecule include biphenols such as hydroquinone, resorcinol, catechol, methylhydroquinone, tert-butylhydroquinone, benzylhydroquinone, phenylhydroquinone, dimethylhydroquinone, methyl-tert-butylhydroquinone, di-tert-butylhydroquinone trimethylhydroquinone, methoxyhydroquinone, methylresorcinol, tert-butylresorcinol, benzylresorcinol, phenylresorcinol, dimethylresorcinol, methyl-tert-butylresorcinol, di-tert-butylresorcinol, trimethylresorcinol, methoxyresorcinol, methylcatechol, tert-butylcatechol, benzylcatechol, phenylcatechol, dimethylcatechol, methyl-tert-butylcatechol, di-tert-butylcatechol, trimethylcatechol, methoxycatechol, biphenol, 4,4'-dihydroxy-3,3',5,5'-tetramethylbiphenyl and 4,4'-dihydroxy-3,3'-5,5'-tetra-tert-butylbiphenyl, bisphenol A, 4,4'-dihydroxy-3,3'5,5'-tetramethylbisphenol A, 4,4'-dihydroxy-3,3',5,5'-tetra-tert-butylbisphenol A, bisphenol F, 4,4'-dihydroxy-3,3',5,5'-tetramethylbisphenol F, 4,4'-dihydroxy-3,3',5,5'-tetra-tert-butylbisphenol F, bisphenol AD, 4,4'-dihydroxy-3,3',5,5'-tetramethylbisphenol AD, 4,4'-dihydroxy-3,3',5,5'-tetra-tert-butylbisphenol AD, bisphenols and the like represented by structural formulae (XII) to (XVIII), terpene phenols, compounds represented by structural formula (XIX) and (XX), etc. Examples of a phenol having three active hydrogens in the molecule include trihydroxybenzene and tris(p-hydroxyphenyl)methane, etc. Examples of a phenol having four active hydrogens in the molecule include tetrakis(p-hydroxyphenyl)ethane, etc. Further, other examples include novolacs of phenols such as phenol, alkylphenols and halogenated phenols.

Among the abovementioned phenols, phenol and phenol novolac can be preferably used.

Further, alcohols include 1,2-ethanediol, 1,2-propanediol, 1,3-propanediol, 1,3-butanediol, 1,4-butanediol, 1,5-pentanediol, 1,1-dimethyl-1,3-propanediol, 2,2-dimethyl-1,3-propanediol, 2-methyl-2,4-pentanediol, 1 ,4-cyclohexanediol, 1,4-cyclohexanedimethanol, diethylene glycol, triethylene glycol, dodecahydrobisphenol A, ethylene oxide addition product of bisphenol A represented by structural formula (XXI), propylene oxide addition product of bisphenol A represented by structural formula (XXII), ethylene oxide addition product of dodecahydrobisphenol A represented by structural formula (XXIII), propylene oxide addition product of dodecahydrobisphenol A represented by structural formula (XXIV), glycerol, trimethylolethane and trimethylolpropane, etc. Further, examples of an alcohol containing four hydroxyl groups in the molecule include pentaerythritol, etc.

[Chemical formula 16]

Formula (XII)

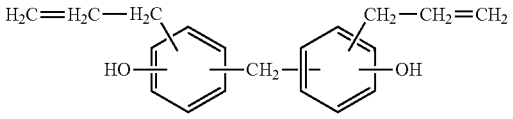

[Chemical formula 17]

Formula (XIII)

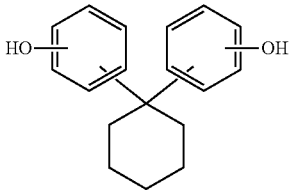

[Chemical formula 18]

Formula (XIV)

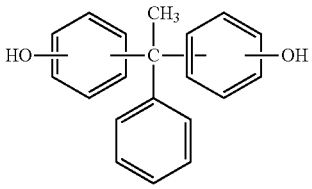

[Chemical formula 19]

Formula (XV)

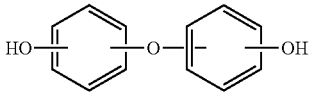

[Chemical formula 20]

Formula (XVI)

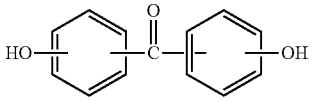

-continued

[Chemical formula 21]

Formula (XVII)

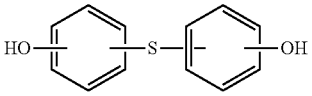

[Chemical formula 22]

Formula (XVIII)

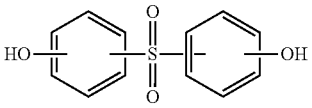

[Chemical formula 23]

Formula (XIX)

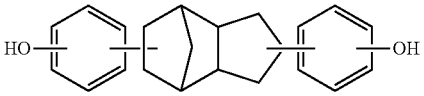

[Chemical formula 24]

Formula (XX)

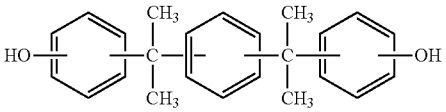

[Chemical formula 25]

Formula (XXI)

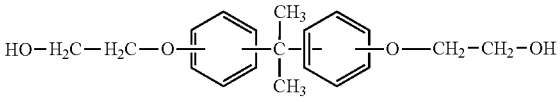

[Chemical formula 26]

Formula (XXII)

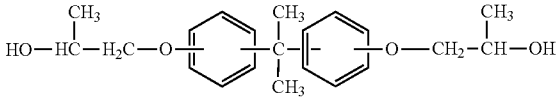

[Chemical formula 27]

Formula (XXIII)

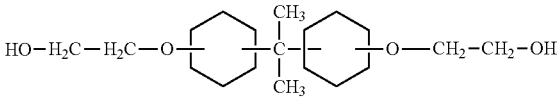

[Chemical formula 28]

Formula (XXIV)

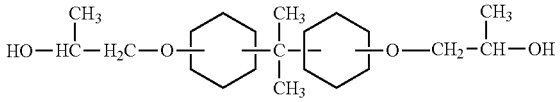

Further, with regard to the mercaptans, examples of a mercaptan containing one active hydrogen in the molecule include methanethiol, ethanethiol, 1-propanethiol, 2-propanethiol, 1-butanethiol, 2-methyl-1-propanethiol, 2-butanethiol, 2-methyl-2-propanethiol, 1-pentanethiol, 1-hexanethiol, 1-heptanethiol, 1-octanethiol, cyclopentanethiol, cyclohexanethiol, benzylmercaptan, benzenethiol, toluenethiol, chlorobenzenethiol, bromobenzenethiol, nitrobenzenethiol and methoxybenzenethiol, etc. Examples of a mercaptan containing two active hydrogens in the molecule include 1,2-ethanedithiol, 1,3-propanedithiol, 1,4-butanedithiol, 1,5-pentanedithiol, 2,2'-hydroxydiethanethiol, 1,6-hexanedithiol, 1,2-cyclohexanedithiol, 1,3-cyclohexanedithiol, 1,4-cyclohexanedithiol, 1,2-benzenedithiol, 1,3-benzenedithiol and 1,4-benzenethiol, etc.

Further, the 1,3-dicarbonyl compounds' include 2,4-pentanedione, 3-methyl-2,4-pentanedione, 3-ethyl-2,4-pentanedione, 3,5-heptanedione, 4,6-nonanedione, 2,6-dimethyl-3,5-heptanedione, 2,2,6,6-tetramethyl-3,5-heptanedione, 1-phenyl-1,3-butanedione, 1,3-diphenyl-1,3-propanedione, 1,3-cyclopentanedione, 2-methyl-1,3-cyclopentanedione, 2-ethyl-1,3-cyclopentanedione, 1,3-cyclohexanedione, 2-methyl-1,3-cyclohexanedione, 2-ethyl-cyclohexanedione, 1,3-indanedione, ethyl acetoacetate and diethyl malonate, etc.

It is preferred that the tertiary amine compound and/or tertiary amine salt (B1) with a molecular weight of 100 g/mol or higher is a tertiary amine compound and/or tertiary amine salt represented by the following general formula (III):

[Chemical formula 29]

Formula (III)

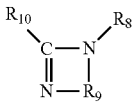

(where $R_8$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and where $R_9$ denotes an alkylene group with 3 to 22 carbon atoms, and may contain an unsaturated group; and $R_{10}$ denotes any one of a hydrogen, a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; or $R_8$ and $R_{10}$ may also be combined with each other to form an alkylene group with 2 to 11 carbon atoms), or the following formula (IV):

[Chemical formula 30]

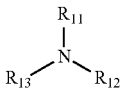

(where $R_{11}$ to $R_{13}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group), or the following general formula (V):

[Chemical formula 31]

Formula (V)

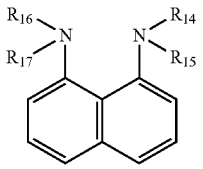

(where $R_{14}$ to $R_{17}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group), or the following general formula (VI):

[Chemical formula 32]

Formula (VI)

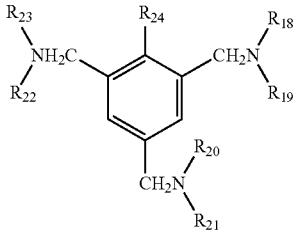

(where $R_{18}$ to $R_{23}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and $R_{24}$ denotes any one of a hydrocarbon group with 1 to 22 carbon atoms, a group containing a hydrocarbon with I to 22 carbon atoms and an ether structure, a group containing a hydrocarbon with 1 to 22 carbon atoms and an ester structure, a group containing a hydrocarbon with 1 to 22 carbon atoms and a hydroxyl group, and a hydroxyl group).

In the abovementioned general formulae (III) to (VI) of this invention, $R_8$ and $R_{11}$ to $R_{23}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group. If the number of carbon atoms is kept in a range from 1 to 22, the steric hindrance of the molecular structure is moderately small and the reaction promotion effect becomes so high as to enhance the adhesion. A more preferred range is 1 to 14, and a further more preferred range is 1 to 8. On the other hand, if the number of carbon atoms is more than 22, the steric hindrance of the molecular structure may become rather large and the reaction promotion effect may decline as the case may be.

In the abovementioned general formula (VI) of this invention, $R_{24}$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, a group containing a hydrocarbon with 1 to 22 carbon atoms and a hydroxyl group, and a hydroxyl group. If the number of carbon atoms is kept in a range from 1 to 22, the steric hindrance of the molecular structure is moderately small and the reaction promotion effect becomes so high as to enhance the adhesion. A more preferred range is 1 to 14, and a further more preferred range is 1 to 8. On the other hand, if the number of carbon atoms is more than 22, the steric hindrance of the molecular structure may become rather large and the reaction promotion effect may decline as the case may be.

In the abovementioned general formula (III) of this invention, $R_9$ denote an alkylene group with 3 to 22 carbon atoms and may also contain an unsaturated group. If the number of carbon atoms is kept in a range from 3 to 22, the steric hindrance of the molecular structure is moderately small and the reaction promotion effect becomes so high as to enhance the adhesion. A more preferred range is 3 to 14, and a further more preferred range is 3 to 8. On the other hand, if the number of carbon atoms is more than 22, the steric hindrance of the molecular structure may become rather large and the reaction promotion effect may decline as the case may be.

In the abovementioned general formula (III) of this invention, $R_{10}$ denotes any one of a hydrogen, a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group. If the number of carbon atoms is kept in a range from 1 to 22, the steric hindrance of the molecular structure is moderately small and the reaction promotion effect becomes so high as to enhance the adhesion. A more preferred range is 1 to 14, and a further more preferred range is 1 to 8. On the other hand, if the number of carbon atoms is more than 22, the steric hindrance of the molecular structure may become rather large and the reaction promotion effect may decline as the case may be.

In this case, a hydrocarbon group with 1 to 22 carbon atoms is a group comprising carbon and hydrogen atoms only, and can be either a saturated hydrocarbon group or an unsaturated hydrocarbon group, containing or not containing a ring structure. Examples of the hydrocarbon group include a methyl group, ethyl group, propyl group, butyl group, pentyl group, hexyl group, cyclohexyl group, octyl group, decyl group, dodecyl group, tetradecyl group, hexadecyl group, octadecyl group, oleyl group, docosyl group, benzyl group and phenyl group, etc.

Further, examples of the group containing a hydrocarbon with 1 to 22 carbon atoms and an ether structure, if straight-chain, include polyether groups such as methoxymethyl group, ethoxymethyl group, propoxymethyl group, butoxymethyl group, phenoxymethyl group, methoxyethyl group, ethoxyethyl group, propoxyethyl group, butoxyethyl group, phenoxyethyl group, methoxyethoxymethyl group, methoxyethoxyethyl group, polyethylene glycol group and polypropylene glycol group. Examples of the group containing a hydrocarbon with 1 to 22 carbon atoms and an ether structure, if cyclic, include ethylene oxide, tetrahydrofuran, oxepane, 1,3-dioxolan, etc.

Furthermore, examples of the group containing a hydrocarbon with 1 to 22 carbon atoms and an ester structure include an acetoxymethyl group, acetoxyethyl group, acetoxypropyl group, acetoxybutyl group, methacroyloxyethyl group and benzoyloxyethyl group, etc.

Moreover, examples of the group containing a hydrocarbon with 1 to 22 carbon atoms and a hydroxyl group include a hydroxymethyl group, hydroxyethyl group, hydroxypropyl group, hydroxybutyl group, hydroxypentyl group, hydroxyhexyl group, hydroxycyclohexyl group, hydroxyoctyl group, hydroxydecyl group, hydroxydodecyl group, hydroxytetradecyl group, hydroxyhexadecyl group, hydroxyoctadecyl group, hydroxyoleyl group and hydroxydocosyl group, etc.

In the abovementioned general formula (IV) of this invention, it is preferred that the number of carbon atoms of $R_{12}$ and $R_{13}$ is 2 or more. More preferred is 3 or more, and further more preferred is 4 or more. If the number of carbon atoms of $R_{12}$ and $R_{13}$ is 2 or more, the side reactions in which the tertiary amine compound and/or tertiary amine salt acts as an initiator, such as the homopolymerization of the epoxy resin, can be inhibited to further enhance the adhesion.

In this invention, it is preferred that the compound represented by the aforementioned general formula (III) is 1,8-diazabicyclo[5,4,0]-7-undecene (DBU) or a salt thereof, or 1,5-diazabicyclo[4,3,0]-5-nonene (DBN) or a salt thereof.

In this invention, it is preferred that the compound represented by the aforementioned general formula (IV) is tributylamine, N,N-dimethylbenzylamine, diisopropylethylamine, triisopropylamine, dibuylethanolamine, diethylethanolamine or triisopropanolamine.

In this invention, it is preferred that the compound represented by the aforementioned general formula (V) is 1,8-bis(dimethylamino)naphthalene.

In this invention, it is preferred that the compound represented by the aforementioned general formula (VI) is 2,4,6-tris(dimethylaminomethyl)phenol.

In this invention, it is preferred that the acid dissociation constant (pKa) of the conjugate acid of the tertiary amine compound (B1) is 9 or more. More preferred is 11 or more. If the acid dissociation constant (pKa) is 9 or more, the reaction between the functional groups on the surface of the carbon fibers and the epoxy is promoted to enhance the adhesion enhancing effect. Examples of such a tertiary amine compound include DBU (pKa 12.5), DBN (pKa 12.7) and 1,8-bis(dimethylamino)naphthalene (pKa 12.3), etc.

In this invention, it is preferred that the boiling point of the tertiary amine compound and/or tertiary amine salt (B1) is 160° C. or higher. A more preferred range is 160 to 350° C., and a further more preferred range is 160 to 260° C. If the boiling point is lower than 160° C., the volatilization in the step of heat-treating in a temperature range from 160 to 260° C. for 30 to 600 seconds becomes vigorous, and the reaction promotion effect may decline as the case may be.

The tertiary amine compound and/or tertiary amine salt (B1) used in this invention can be an aliphatic tertiary amine, aromatic-aliphatic tertiary amine, aromatic tertiary amine, heterocyclic tertiary amine or a salt thereof. Examples are enumerated below.

Examples of the aliphatic tertiary amine include triethylamine, tripropylamine, triisopropylamine, tributylamine, tripentylamine, trihexylamine, tricyclohexylamine, trioctylamine, dimethylpropylamine, dimethylbutylamine, dimethylpentylamine, dimethylhexylamine, dimethylcyclohexylamine, dimethyloctylamine, dimethyldecylamine, dimethyldodecylamine, dimethyltetradecylamine, dimethylhexadecylamine, dimethyloctadecylamine, dimethyloleylamine, dimethyldocosylamine,diethylpropylamine, diethylbutylamine, diethylpentylamine, diethylhexylamine, diethylcyclohexylamine, diethyloctylamine, diethyldecylamine, diethyldodecylamine, diethyltetradecylamine, diethylhexadecylamine, diethyloctadecylamine, diethylloleylamine, diethyldocosylamine, dipropylmethylamine, diisopropylethylamine, dipropylethylamine, dipropylbutylamine, dibutylmethylamine, dibutylethylamine, dibutylpropylamine, dihexylmethylamine, dihexylethylamine, dihexylpropylamine, dihexylbutylamine, dicyclohexylmethylamine, dicyclohexylethylamine, dicyclohexylpropylamine, dicyclohexylbutylamine, dioctylmethylamine, dioctylethylamine, dioctylpropylamine, didecylmethyl amine, didecylethylamine, didecylpropylamine, didecylbutylamine, di dodecylmethyl amine, didodecylethylamine, didodecylpropylamine, didodecylbutylamine, ditetradecylmethylamine, ditetradecylethylamine, ditetradecylpropylamine, ditetradecylbutylamine, dihexadecylmethylamine, dihexadecylethylamine, dihexadecylpropylamine, dihexadecylbutylamine, trimethanolamine, triethanolamine, triisopropanolamine, tributanolamine, trihexanolamine, diethylmethanolamine, dipropylmethanolamine, diisopropylmethanolamine, dibutylmethanolamine, diisobutylmethanolamine, ditertiarybutylmethanol amine, di(2-ethylhexyl)methanolamine, dimethylethanolamine, diethylethanolamine, dipropylethanolamine, diisopropylethanolamine, dibutylethanolamine, diisobutylethanolamine, ditertiarybutylethanolamine, di(2-ethylhexyl) ethanolamine, dimethylpropanolamine, diethylpropanolamine, dipropylpropanolamine, diisopropylpropanolamine, dibutylpropanolamine, diisobutylpropanolamine, ditertiarybutylpropanolamine, di(2-ethylhexyl)propanolamine, methyldimethanolamine, ethyldimethanolamine, propyldimethanolamine, isopropyldimethanolamine, butyldimethanolamine, isobutyldimethanolamine, tertiarybutyldimethanolamine, (2-ethylhexyl)dimethanolamine, methyldiethanolamine, ethyldiethanolamine, propyldiethanolamine, isopropyldiethanolamine, butyldiethanolamine, isobutyldiethanolamine, tertiarybutyldiethanolamine, (2-ethylhexyl) diethanolamine, dimethylaminoethoxyethanol, compounds having two or more tertiary amines in the molecule such as N,N,N',N'-tetramethyl-1,3-propanediamine, N,N,N',N'-tetraethyl-1,3-propanediamine, N,N-diethyl-N',N'-dimethyl-1,3-propanediamine, tetramethyl-1,6-hexadiamine, pentamethyldiethylenetriamine, bis(2-dimethylaminoethyl)ether, and trimethylaminoethylethanolamine, etc.

Examples of the aromatic-aliphatic tertiary amines include N,N'-dimethylbenzylamine, N,N'-diethylbenzylamine, N,N'-dipropylbenzylamine, N,N'-dibutylbenzylamine, N,N'-dihexylbenzylamine, N,N'-dicyclohexylbenzylamine, N,N'-dioctylbenzylamine, N,N'-didodecylbenzylamine, N,N'-dioleylbenzylamine, N,N'-dibenzylmethylamine, N,N'-dibenzylethylamine, N,N'-dibenzylpropylamine, N,N'-dibenzylbutylamine, N,N'-dibenzylhexylamine, N,N'-dibenzylcyclohexylamine, N,N'-dibenzyloetylamine, N,N'-dibenzyldodecylamine, N,N'-dibenzyloleylamine, tribenzylamine, N,N'-methylethylbenzylamine, N,N'-methylpropylbenzylamine, N,N'-methylbutylbenzyl amine, N,N'-methylhexylbenzylamine, N,N'-methylcyclohexylbenzylamine, N,N'-methyloctylbenzylamine, N,N'-methyldodecylbenzylamine, N,N'-methyloleylbenzylamine, N,N'-methylhexadecylbenzylamine, N,N'-methyloctadecylbenzylamine, 2-(dimethylaminomethyl)phenol, 2,4,6-tris(dimethylaminomethyl)phenol, 2,4,6-tris(diethylaminomethyl)phenol, 2,4,6-tris(dipropylaminomethyl)phenol, 2,4,6-tris(dibutylaminomethyl)phenol, 2,4,6-tris(dipentylaminomethyl)phenol, and 2,4,6-tris(dihexylaminomethyl)phenol, etc.

Examples of the aromatic tertiary amines include triphenylamine, tri(methylphenyl)amine, tri(ethylphenyl)amine, tri(propylphenyl)amine, tri(butylphenyl)amine, tri(phenoxyphenyl)amine, tri(benzylphenyl)amine, diphenylmethylamine, diphenylethylamine, diphenylpropylamine, diphenylbutylamine, diphenylhexylamine, diphenylcyclohexylamine, N,N-dimethylaniline, N,N-diethylaniline, N,N-dipropylaniline, N,N-dibutylaniline, N,N-dihexylaniline, N,N-dicyclohexylaniline, (methylphenyl)dimethylamine, (ethylphenyedimethylamine, (propylphenyl)dimethylamine, (butylphenyl)dimethylamine, bis(methylphenyl)methylamine, bis(ethylphenyl)methylamine, bis (propylphenyl)methylamine, bis(butylphenyl)methylamine, N,N-di(hydroxyethyl)aniline, N,N-di(hydroxypropyl)aniline, N,N-di(hydroxybutyl)aniline, and diisopropanol-p-toluidine, etc.

Examples of the heterocyclic tertiary amines include pyridine-based compounds such as picoline, isoquinoline and quinoline, imidazole-based compounds, pyrazole-based compounds, morpholine-based compounds, piperazine-based compounds, piperidine-based compounds, pyrrolidine-based compounds, cycloamidine-based compounds, and proton sponge derivatives.

The pyridine-based compounds include N,N-dimethyl-4-aminopyridine, bipyridine and 2,6-lutidine, etc. The imidazole-based compounds include 1-benzyl-2-methylimidazole, 1-cyanoethyl-2-methylimidazole, 1-cyanoethyl-2-phenylimidazole, 1-cyanoethyl-2-ethyl-4-imidazole, 1-cyanoethyl-2-undecylimidazole, 1-cyanoethyl-2-methylimidazolium trimellitate, 1-cyanoethyl-2-undecylimidazolium trimellitate, 1-benzyl-2-phenylimidazole, 1-(2-hydroxyethyl)imidazole, 1-benzyl-2-formylimidazole, 1-benzyl-imidazole, and 1-allylimidazole, etc. The pyrazole-based compounds include pyrazole and 1,4-dimethylpyrazole, etc. The morpholine-based compounds include 4-(2-hydroxyethyl)morpholine, N-ethylmorpholine, N-methylmorpholine, and 2,2'-dimorpholinediethyl ether, etc. The piperazine-based compounds include 1-(2-hydroxyethyl)piperazine and N,N-dimethylpiperazine, etc. The piperidine-based compounds include N-(2-hydroxyethyl)piperidine, N-ethylpiperidine, N-propylpiperidine, N-butylpiperidine N-hexylpiperidine, N-cyclohexylpiperidine, and N-octylpiperidine, etc. The pyrrolidine-based compounds include N-butylpyrrolidine and N-octylpyrrolidine, etc. The cycloamidine-based compounds include 1,8-diazabicyclo[5.4.0]-7-undecene (DBU), 1,5-azabicyclo [4,3,0]-5-nonene (DBN), 1,4-diazabicyclo[2,2,2]octane, and 5,6-dibutylamino-1,8-diaza-bicyclo[5,4,0]undecene-7 (DBA). Other heterocyclic amines include hexamethylenetetramine, hexaethylenetetramine and hexapropyltetramine.

Examples of the abovementioned DBU salt include phenol salt of DBU (U-CAT SA1 produced by San-Apro Ltd.), octylate of DBU (U-CAT SA102 produced by San-Apro Ltd.), p-toluenesulfonate of DBU (U-CAT SA506 produced by San-Apro Ltd.), formate of DBU (U-CAT SA603 produced by San-Apro Ltd.), orthophthalate of DBU (U-CAT SA810), and phenol novolac resin salts of DBU (U-CAT SA810, SA831 SA841, SA851 and SA881 produced by San-Apro Ltd.), etc.

Examples of the aforementioned proton sponge derivatives include 1,8-bis(dimethylamino)naphthalene, 1,8-bis(diethylamino)naphthalene, 1,8-bis(dipropylamino)naphthalene, 1,8-bis(dibutylamino)naphthalene, 1,8-bis(dipentylamino)naphthalene, 1,8-bis(dihexylamino)naphthalene, 1-dimethylamino-8-methylamino-quinolizine, 1-dimethylamino-7-methyl-8-methylamino-quinolizine, 1-dimethylamino-7-methyl-8-methylamino-isoquinoline, 7-methyl-1,8-methylamino-2,7-naphthyridine, and 2,7-dimethyl-1,8-methylamino-2,7-naphthylidine, etc.

Among these tertiary amine compounds and tertiary amine salts, in view of a high reaction promotion effect between the functional groups on the surface of carbon fibers and the epoxy resin and the possible inhibition of the reaction between epoxy rings, preferably used are triisopropylamine, dibutylethanolamine, diethylethanolamine, triisopropanolamine, diisopropylethylamine, 2,4,6-tris(dimethylaminomethyl)phenol, 2,6-lutidine, DBU, DBU salt, DBN, DBN salt and 1,8-bis(dimethylamino)naphthalene.

Further, the hindered amine-based compounds include tetrakis(1,2,2,6,6-pentamethyl-4-piperidinyl)butane-1,2,3,4-tetracarboxylate(for example, LA-52 (produced by Adeka Corporation)), bis(1,2,2,6,6-pentamethyl-4-piperidyl)sebacate (for example, LA-72 (produced by Adeka Corporation), TINUVIN765 (produced by BASF)), bis(2,2,6,6-tetramethyl-1-undecyloxypiperidine-4-yl)carboxylate (for example, LA-81 (produced by Adeka Corporation)), 1,2,2,6,6-pentamethyl-4-piperidyl methacrylate (for example, LA-82 (produced by Adeka Corporation)), 2-((4-methoxyphenyl)methylene) malonate, 1,3-bis(1,2,2,6,6-pentamethyl-4-piperidinyl)ester, Chimassorb119, 2-dodecyl-N-(1,2,2,6,6-pentamethyl-4-piperidinyl)succinimide, 1-hexadecyl-2,3,4-tris(1,2,2,6,6-pentamethyl-4-piperidinyl) 1,2,3 ,4-butanetetracarboxylate, 1,2,3-tris(1,2,2,6,6-pentamethyl-4-piperidinyl)-4-tridecyl 1,2,3,4-butanetetracarboxylate, 1-methyl-10-(1,2,2,6,6-pentamethyl-4-piperidinyl)decanedioate, 4-(ethenyloxy)-1,2,2,6,6-pentamethylpiperidine, 2-((3,5-bis(1,1-dimethylethyl)-4-hydroxyphenyl)methyl)-2-butyl, bis(1,2,2,6,6-pentamethyl-4-piperidinyl)propanedioate, 4-hydroxy-1,2,2,6,6-pentamethylpiperidine, 1 ,2,2,6,6-pentamethylpiperidine, LA-63P (produced by Adeka Corporation), LA-68 (produced by Adeka Corporation), TINUVIN622LD (produced by BASF), TINUVIN144 (produced by BASF), etc.

Any one of these tertiary amine compounds and tertiary amine salts can be used alone, or two or more of them can also be used together.

(B2) is explained below.

It is necessary that the quaternary ammonium salt (B2) having a cationic moiety represented by the abovementioned general formula (I) or (II) used in this invention is mixed by 0.1 to 25 parts by mass per 100 parts by mass of the epoxy compound (A). A preferred range is 0.1 to 10 parts by mass, and a more preferred range is 0.1 to 8 parts by mass. If the mixed amount is less than 0.1 part by mass, the covalent bond formation between the epoxy compound (A) and the oxygen-containing functional groups on the surface of carbon fibers is not promoted, and the adhesion between the carbon fibers and the matrix resin becomes insufficient. On the other hand, if the mixed amount is more than 25 parts by mass, (B2) covers the surface of carbon fibers, to inhibit the covalent bond formation and the adhesion between the carbon fibers and the matrix resin becomes insufficient.

The mechanism in which the quaternary ammonium salt (B2) having a cationic moiety represented by the abovementioned general formula (I) or (II) mixed in this invention promotes the covalent bond formation is not clear, but this effect can be obtained only by the quaternary ammonium salt with a specific structure. Therefore, it is necessary that $R_1$ to $R_5$ of the abovementioned general formula (I) or (II) denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group. If the number of carbon atoms is 23 or more, the adhesion becomes insufficient though the reason is not clear.

In this case, a hydrocarbon group with 1 to 22 carbon atoms refers to a group comprising carbon and hydrogen atoms only, and can be either a saturated hydrocarbon group or an unsaturated hydrocarbon group, containing or not containing a ring structure. Examples of the hydrocarbon group include a methyl group, ethyl group, propyl group, butyl group, pentyl group, hexyl group, cyclohexyl group, octyl group, decyl group, dodecyl group, tetradecyl group, hexadecyl group, octadecyl group, oleyl group, docosyl group, benzyl group and phenyl group, etc.

Further, examples of the group containing a hydrocarbon with 1 to 22 carbon atoms and an ether structure include polyether groups such as a methoxymethyl group, ethoxymethyl group, propoxymethyl group, butoxymethyl group, phenoxymethyl group, methoxyethyl group, ethoxyethyl group, propoxyethyl group, butoxyethyl group, phenoxyethyl group, methoxyethoxymethyl group, methoxyethoxyethyl group, polyethylene glycol group and polypropylene glycol group.

Furthermore, examples of the group containing a hydrocarbon with 1 to 22 carbon atoms and an ester structure include an acetoxymethyl group, acetoxyethyl group, acetoxypropyl group, acetoxybutyl group, methacroyloxyethyl group and benzoyloxyethyl group, etc.

Moreover, examples of the group containing a hydrocarbon with I to 22 carbon atoms and a hydroxyl group include a hydroxymethyl group, hydroxyethyl group, hydroxypropyl group, hydroxybutyl group, hydroxypentyl group, hydroxyhexyl group, hydroxycyclohexyl group, hydroxyoctyl group, hydroxydecyl group, hydroxydodecyl group, hydroxytetradecyl group, hydroxyhexadecyl group, hydroxyoctadecyl group, hydroxyoleyl group, hydroxydocosyl group, etc.

Above all, it is preferred that the number of carbon atoms of $R_1$ to $R_5$ of the quaternary ammonium salt (B2) having a cationic moiety is in a range from 1 to 14. A more preferred range is 1 to 8. In the case where the number of carbon atoms is less than 14, when the quaternary ammonium salt acts as a reaction promoter, steric hindrance is moderately small and the reaction promotion effect becomes so high as to further enhance the adhesion.

Further, in this invention, it is preferred that the number of carbon atoms of $R_3$ and $R_4$ of the quaternary ammonium salt (B2) having a cationic moiety represented by the general formula (I) is 2 or more. More preferred is 3 or more, and further more preferred is 4 or more. If the number of carbon atoms is 2 or more, the homopolymerization of the epoxy resin owing to the quaternary ammonium salt acting as an initiator can be inhibited, and the adhesion is further enhanced.

Furthermore, in this invention, it is preferred that $R_6$ and $R_7$ of the quaternary ammonium salt (B2) having a cationic moiety represented by the abovementioned general formula (II) denote, respectively independently, any one of a hydrogen, a hydrocarbon group with 1 to 8 carbon atoms, a group containing a hydrocarbon with 1 to 8 carbon atoms and an ether structure, and a group containing a hydrocarbon with 1 to 8 carbon atoms and an ester structure. If a hydrogen is selected or if the number of carbon atoms is less than 8, then the rate of active sites in the molecule is high, and even with a small amount, a large adhesion enhancing effect can be obtained.

In this invention, it is preferred that the molecular weight of the cationic moiety of the quaternary ammonium salt (B2) having a cationic moiety is in a range from 100 to 400 g/mol. A more preferred range is 100 to 300 g/mol, and a further more preferred range is 100 to 200 g/mol. If the molecular weight of the cationic moiety is 100 g/mol or higher, volatilization can be inhibited even during heat treatment, and a large adhesion enhancing effect can be obtained even with a small amount. On the other hand, if the molecular weight of the cationic moiety is 400 g/mol or lower, the rate of active sites in the molecule is high, and a large adhesion enhancing effect can be obtained also even with a small amount.

In this invention, examples of the cationic moiety of the quaternary ammonium salt, which is represented by the abovementioned general formula (I), include tetramethylammonium, ethyltrimethylammonium, trimethylpropylammonium, butyltrimethylammonium, trimethylpentylammonium, hexyltrimethylammonium, cyclohexyltrimethylammonium, trimethyloctylammonium, decyltrimethylammonium, dodecyltrimethylammonium, tetradecyltrimethylammonium, hexadecyltrimethylammonium, trimethyloctadecylammonium, trimethyloleylammonium, docosyltrimethylammonium, benzyltrimethylammonium, trimethylphenylammonium, diethyldimethylammonium, dimethyldipropylammonium, dibutyldimethylammonium, dimethyldipentylammonium, dihexyldimethylammonium, dicyclohexyldimethylammonium, dimethyldioctylammonium, didecyldimethylammonium, ethyldecyldimethylammonium, didodecyldimethylammonium, ethyldodecyldimethylammonium, ditetradecyldimethylammonium, ethyltetradecyldimethylammonium, dihexadecyldimethylammonium, ethylhexadecyldimethylammonium, dimethyldioctadecylammonium, ethyloctadecyldimethylammonium, dimethyldioleylammonium, ethyldimethyloleylammonium, didocosyldimethylammonium, docosylethyldimethylammonium, dibenzyldimethylammonium, benzylethyldimethylammonium, benzyldimethylpropylammonium, benzylbutyldimethylammonium, benzyldecyldimethylammonium, benzyldodecyldimethylammonium, benzyltetradecyldimethylammonium, benzylhexadecyldimethylammonium, benzyloctadecyldimethylammonium, benzyldimethyloleylammonium, dimethyldiphenylammonium, ethyldimethylphenylammonium, dimethylpropylphenylammonium, butyldimethylphenylammonium, decyldimethylphenylammonium, dodecyldimethylphenylammonium, tetradecyldimethylphenylammonium, hexadecyldimethylphenylammonium, dimethyloctadecylphenylammonium, dimethyloleylphenylammonium, tetraethylammonium, triethylmethylammonium, triethylpropylammonium, butyltriethylammonium, triethylpentylammonium, triethylhexylammonium, triethylcyclohexylammonium, triethyloctylammonium, decyltriethylammonium, dodecyltriethylammonium, tetradecyltriethylammonium, hexadecyltriethylammonium, triethyloctadecylammonium, triethyloleylammonium, benzyltriethylammonium, triethylphenylammonium, diethyldipropylammonium, dibutyldiethylammonium, diethyldipentylammonium, diethyldihexylammonium, diethyldicyclohexylammonium, diethyldioctylammonium, didecyldiethylammonium, didodecyldiethylammonium, ditetradecyldiethylammonium, diethyldihexadecylammonium, diethyldioctadecylammonium, diethyldioleylammonium, dibenzyldiethylammonium, diethyldiphenylammonium, tetrapropylammonium, methyltripropylammonium, ethyltripropylammonium, butyltripropylammonium, benzyltripropylammonium, phenyltripropylammonium, tetrabutylammonium, tributylmethylammonium, tributylethylammonium, tributylpropylammonium, benzyltributylammonium, tributylphenylammonium, tetrapentylammonium, te trahexylammonium, tetraheptylammonium, tetraoctylammonium, methyltrioctylammonium, ethyltrioctylammonium, trioctylpropylammonium, butyltrioctylammonium, dimethyldioctylammonium, diethyldioctylammonium, dioctyldipropylammonium, dibutyldioctylammonium, tetradecylammonium, tetradodecylammonium, 2-hydroxyethyltrimethylammonium, 2-hydroxyethyltriethylammonium, 2-hydroxyethyltripropylammonium, 2-hydroxyethyltributylammonium, polyoxyethylenetrimethylammonium, polyoxyethylenetriethylammonium, polyoxyethylenetripropylammonium, polyoxyethylenetributylammonium, bis(2-hydroxyethyDdimethylammonium, bis(2-hydroxyethyl)diethylammonium, bis(2-hydroxyethyl)dipropylammonium, bis(2-hydroxyethyl)dibutylammonium, bis(polyoxyeth ylene)dimethylammonium, bis(polyoxyethylene)diethylammonium, bis(polyoxyethylene)dipropylammonium, bis(polyoxyethylene)dibutylammonium, tris(2-hydroxyethyl)methylammonium, tris(2-hydroxyethyl)ethylammonium, tris(2-hydroxyethyl)propylammonium, tris(2-hydroxyethyl)butylammonium, tris(polyoxyethylene)methylammonium, tris(polyoxyethylene)ethylammonium, tris(polyoxyethylene)propylammonium, and tris(polyoxyethylene)butylammonium.

Further, examples of the cationic moiety of the quaternary ammonium salt, which is represented by the abovementioned general formula (II), include 1-methylpyridinium, 1-ethylpyridinium, 1-ethyl-2-methylpyridinium, 1-ethyl-4-methylpyridinium, 1-ethyl-2,4-dimethylpyridinium, 1-ethyl-2,4,6-trimethylpyridinium, 1-propylpyridinium, 1-butylpyridinium, 1-butyl-2-methylpyridinium, 1-butyl-4-methylpyridinium, 1-butyl-2,4-dimethylpyridinium, 1-butyl-2,4,6-trimethylpyridinium, 1-pentylpyridinium, 1-hexylpyridinium, 1-cyclohexylpyridinium, 1-octylpyridinium, 1-decylpyridinium, 1-dodecylpyridinium, 1-tetradecylpyridinium, 1-hexadecylpyridinium, 1-octadecylpyridinium, 1-oleylpyridinium, 1-docosylpyridinium, and 1-benzylpyridinium.

In this invention, examples of the anionic moiety of the quaternary ammonium salt (B2) having a cationic moiety include halogen ions comprising a fluoride anion, chloride anion, bromide anion and iodide anion. Further, other examples include a hydroxide anion, acetate anion, oxalate anion, sulfate anion, benzenesulfonate anion, and toluenesulfonateanion.

Among them, as the counter ion, a halogen ion is preferred in view of small size and no inhibition of the reaction promotion effect of the quaternary ammonium salt.

In this invention, any one of these quaternary ammonium salts used alone or two or more of them can also be used together.

In this invention, examples of the quaternary ammonium salt (B2) having a cationic moiety include trimethyloctadecylammonium chloride, trimethyloctadecylammonium bromide; trimethyloctadecylammonium hydroxide, trimethyloctadecylammonium acetate, trimethyloctadecylammonium benzoate, trimethyloctadecylammonium p-toluenesulfonate, trimethyloctadecylammonium hydrochloride, trimethyloctadecylammonium tetrachloroiodate, trimethyloctadecylammonium hydrogensulfate, trimethyloctadecylammonium methylsulfate, benzyltrimethylammonium chloride, benzyltrimethylammonium bromide, benzyltrimethylammonium hydroxide, benzyltrimethylammonium acetate, benzyltrimethylammonium benzoate, benzyltrimethylammonium p-toluenesulfonate, tetrabutylammonium chloride, tetrabutylammonium bromide, tetrabutylammonium hydroxide, tetrabutylammonium acetate, tetrabutylammonium benzoate, tetrabutylammonium p-toluenesulfonate, (2-methoxyethoxymethyl)triethylammonium chloride, (2-methoxyethoxymethyl)triethylammonium bromide, (2-methoxyethoxymethyl)triethylammonium hydroxide, (2-methoxyethoxymethyl)triethylammonium p-toluenesulfonate, (2-acetoxyethyl)trimethylammonium chloride, (2-acetoxyethyl)trimethylammonium bromide, (2-acetoxyethyl)trimethylammonium hydroxide, (2-acetoxyethyl)trimethylammonium p-toluenesulfonate, (2-hydroxyethyl)trimethylammonium chloride, (2-hydroxyethyl) trimethylammonium bromide, (2-hydroxyethyl) trimethylammonium hydroxide, (2-hydroxyethyl) trimethylammonium p-toluenesulfonate, bis (polyoxyethylene)dimethylammonium chloride, bis (polyoxyethylene)dimethylammonium bromide, bis (polyoxyethylene)dimethylammonium hydroxide, bis (polyoxyethylene)dimethylammonium p-toluenesulfonate, 1-hexadecylpyridinium chloride, 1-hexadecylpyridinium bromide, 1-hexadecylpyridinium hydroxide, and 1-hexadecylpyridinium p-toluenesulfonate, etc.

(B3) is explained below.

It is necessary that the quaternary phosphonium salt and/or phosphine compound (B3) used in this invention is mixed by 0.1 to 25 parts by mass per 100 parts by mass of the epoxy compound (A). A preferred range is 0.1 to 10 parts by mass, and a more preferred range is 0.1 to 8 parts by mass. If the mixed amount is less than 0.1 part by weight, the covalent bond formation between the epoxy compound (A) and the oxygen-containing functional groups on the surface of carbon fibers is not promoted, and the adhesion between the carbon fibers and the matrix resin becomes insufficient. On the other hand, if the mixed amount is more than 25 parts by mass, (B3) covers the surface of carbon fibers, to inhibit covalent bond formation, and the adhesion between the carbon fibers and the matrix resin becomes insufficient.

The quaternary phosphonium salt or phosphine compound (B3) used in this invention is preferably a quaternary phosphonium salt having a cationic moiety or phosphine compound represented by the following general formula (VII) or (VIII)

[Chemical formula 33]

Formula (VII)

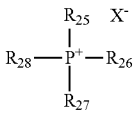

[Chemical formula 34]

Formula (VIII)

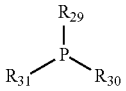

(where $R_{25}$ to $R_{31}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group).

The present inventors found that only in the case where carbon fibers were coated with a sizing agent obtained by mixing 0.1 to 25 parts by mass of a quaternary phosphonium salt and/or phosphine compound (B3), preferably a quaternary phosphonium salt and/or phosphine compound (B3) represented by the abovementioned general formula (VII) or (VIII) with 100 parts by mass of the abovementioned component (A) and where the coated carbon fibers were heat-treated under specific conditions, the covalent bond formation between the di-or higher functional epoxy resin and the oxygen-containing functional groups such as carboxyl groups and hydroxyl groups originally contained in the surface of the carbon fibers or introduced into the surface of the carbon fibers by oxidation treatment was promoted to greatly enhance the adhesion to the matrix resin as a result.

The mechanism in which the covalent bond formation is promoted by mixing a quaternary phosphonium salt or phosphine compound in this invention is not clear, but if a quaternary phosphonium salt or phosphine compound with the aforementioned specific structure is used, the effect of this invention can be suitably obtained. As the quaternary phosphonium salt and/or phosphine compound (B3) used in this invention, it is preferred that $R_{25}$ to $R_{31}$ of the abovementioned general formula (VII) or (VIII) denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group. If the number of atoms is 23 or more, the adhesion may be insufficient as the case may be though the reason is not clear.

In this case, the hydrocarbon group with 1 to 22 carbon atoms is a group comprising carbon and hydrogen atoms only, and can be either a saturated hydrocarbon group or an unsaturated hydrocarbon group, containing or not containing a ring structure. Examples of the hydrocarbon group include a methyl group, ethyl group, propyl group, butyl group, pentyl group, hexyl group, cyclohexyl group, octyl group, decyl group, dodecyl group, tetradecyl group, hexadecyl group, octadecyl group, oleyl group, docosyl group, vinyl group, 2-propynyl group, benzyl group, phenyl group, cinnamyl group, and naphthylmethyl group, etc.

Further, examples of the group containing a hydrocarbon with 1 to 22 carbon atoms and an ether structure, if straight-chain, include polyether groups such as a methoxymethyl group, ethoxymethyl group, propoxymethyl group, butoxymethyl group, phenoxymethyl group, methoxyethyl group, ethoxyethyl group, propoxyethyl group, butoxyethyl group, phenoxyethyl group, methoxyethoxymethyl group, methoxyethoxyethyl group, polyethylene glycol group and polypropylene glycol group. Examples of the group containing a hydrocarbon with 1 to 22 carbon atoms and an ether structure, if cyclic, include ethylene oxide, tetrahydrofuran, oxepane, 1,3-dioxolan, etc.

Furthermore, examples of the group containing a hydrocarbon with 1 to 22 carbon atoms and an ester structure include an acetoxymethyl group, acetoxyethyl group, acetoxypropyl group, acetoxybutyl group, methacroyloxyethyl group and benzoyloxyethyl group, etc.

Moreover, examples of the group containing a hydrocarbon with 1 to 22 carbon atoms and a hydroxyl group include a hydroxymethyl group, hydroxyethyl group, hydroxypropyl group, hydroxybutyl group, hydroxypentyl group, hydroxyhexyl group, hydroxycyclohexyl group, hydroxyoctyl group, hydroxydecyl group, hydroxydodecyl group, hydroxytetradecyl group, hydroxyhexadecyl group, hydroxyoctadecyl group, hydroxyoleyl group and hydroxydocosyl group, etc.

Above all, it is preferred that the number of carbon atoms of $R_{25}$ to $R_{31}$ of the quaternary phosphonium salt or phosphine compound (B3) is in a range from 1 to 14. In the case where the number of carbon atoms is less than 14, when the quaternary phosphonium salt acts as a reaction promoter, steric hindrance becomes moderately small and the reaction promotion effect becomes so high as to further enhance the adhesion.

Further, in this invention, it is preferred that the number of carbon atoms of $R_{26}$ to $R_{28}$ of the quaternary phosphonium salt (B3) represented by the abovementioned general formula (VII) is 2 or more. More preferred is 3 or more, and further more preferred is 4 or more. If the number of atoms is 2 or more, the homopolymerization of the epoxy resin caused by the quaternary phosphonium salt acting as an initiator is inhibited to further enhance the adhesion.

Furthermore, in this invention, it is preferred that $R_{30}$ and $R_{31}$ of the phosphine compound (B3) represented by the abovementioned general formula (VIII) denote, respectively independently, any one of a hydrocarbon group with 1 to 8 carbon atoms, a group containing a hydrocarbon with 1 to 8 carbon atoms and an ether structure, and a group containing a hydrocarbon with 1 to 8 carbon atoms and an ester group. If the number of carbon atoms is less than 8, the rate of active sites in the molecule becomes high, and a large adhesion enhancing effect can be obtained even with a small amount.

In this invention, it is preferred that the molecular weight of the cationic moiety of the quaternary phosphonium salt (B3) is in a range from 100 to 400 g/mol. A more preferred range is 100 to 300 g/mol, and a further more preferred range is 100 to 200 g/mol. If the molecular weight of the cationic moiety is 100 g/mol or higher, the volatilization during the heat treatment can be inhibited, and a large adhesion enhancing effect can be obtained even with a small amount. On the other hand, if the molecular weight of the cationic moiety is 400 g/mol or lower, the rate of active sites in the molecular is high, and a large adhesion enhancing effect can be obtained also even with a small amount.

In this invention, examples of the cationic moiety of the aliphatic quaternary phosphonium salt represented by the abovementioned general formula (VII) include tetramethylphosphonium, tetraethylphosphonium, tetrapropylphosphonium, tetrabutylphosphonium, methyltriethylphosphonium, methyltripropylphosphonium, methyltributylphosphonium, dimethyldiethylphosphonium, dimethyldipropylphosphonium, dimethyldibutylphosphonium, trimethylethylphosphonium, trimethylpropylphosphonium, trimethylbutylphosphonium, (2-methoxyethoxymethyl) triethylphosphonium, (2-actoxyethyl) trimethylphosphonium chloride, (2-acetoxyethyl) trimethylphosphonium, (2-hydroxyethyl) trimethylphosphonium, tributyl-n-octylphosphonium, tributyldodecylphosphonium, tributylhexadecylphosphonium, tributyl(1,3-dioxolan-2-ylmethyl)phosphonium, di-t-butylmethylphosphonium, trihexyltetradecylphosphonium, and bis(polyoxyethylene)dimethylphosphonium, etc.

Further, examples of the cationic moiety of the aromatic quaternary phosphonium salt represented by the abovementioned general formula (VII) include tetraphenylphosphonium, triphenylmethylphosphonium, diphenyldimethylphosphonium, ethyltriphenylphosphonium, tetraphenylphosphonium, n-butyltriphenylphosphonium, benzyltriphenylphosphonium, isopropyltriphenylphosphonium, vinyltriphenylphosphonium, allyltriphenylphosphonium, triphenylpropargylphosphonium, t-butyltriphenylphosphonium, heptyltriphenylphosphonium, triphenyltetradecylphosphonium, hexyltriphenylphosphonium, (methoxymethyl)triphenylphosphonium, 2-hydroxybenzyltriphenylphosphonium, (4-carboxybutyl)triphenylphosphonium, (3-carboxypropyl)triphenylphosphonium, cinnamyltriphenylphosphonium, cyclopropyltriphenylphosphonium, 2-(1,3-dioxane-2-yl)ethyltriphenylphosphonium, 2-(1,3-dioxolan-2-yl)ethyltriphenylphosphonium, 2-(1,3-dioxolan-2-yl)methyltriphenylphosphonium, 4-ethoxybenzyltriphenylphosphonium, and ethoxycarbonylmethyl(triphenyl)phosphonium, etc.

In this invention, examples of the anionic moiety of the quaternary phosphonium salt (B3) include halogen ionscomprising a fluoride anion, chloride anion, bromide anion and iodide anion. Further other examples include a hydroxide anion, acetate anion, oxalate anion, sulfate anion, benzenesulfonate anion, tetraphenylborate ion, tetrafluoroborate ion, hexafluorophosphate ion, bis(trifluoromethylsulfonyl)imide ion, and toluenesulfonate anion.

In this invention, any one of these quaternary phosphonium salts can be used alone, or two or more of them can also be used together.

In this invention, examples of the quaternary phosphonium salt (B3) include trimethyloctadecylphosphonium chloride, trimethyloctadecylphosphonium bromide, trimethyloctadecylphosphonium hydroxide, trimethyloctadecylphosphonium acetate, trimethyloctadecylphosphonium benzoate, trimethyloctadecylphosphonium p-toluenesulfonate, trimethyloctadecylphosphonium hydrochloride, trimethyloctadecylphosphonium tetrachloroiodate, trimethyloctadecylphosphonium hydrogensulfate, trimethyloctadecylphosphonium methylsulfate, benzyltrimethylphosphonium chloride, benzyltrimethylphosphonium bromide, benzyltrimethylphosphonium hydroxide, benzyltrimethylphosphonium acetate, benzyltrimethylphosphonium benzoate, benzyltrimethylphosphonium p-toluenesulfonate, tetrabutylphosphonium chloride, tetrabutylphosphonium bromide, tetrabutylphosphonium hydroxide, tetrabutylphosphonium acetate, tetrabutylphosphonium benzoate, tetrabutylphosphonium p-toluenesulfonate, (2-methoxyethoxymethyl)triethylphosphonium chloride, (2-methoxyethoxymethyl)triethylphosphonium bromide, (2-methoxyethoxymethyl)triethylphosphonium hydroxide, (2-methoxyethyoxymethyl)triethylphosphonium p-toluenesulfonate, (2-acetoxyethyl)trimethylphosphonium chloride, (2-acetoxyethyl)trimethylphosphonium bromide, (2-acetoxyethyl)trimethylphosphonium hydroxide, (2-acetoxyethyl)trimethylphosphonium p-toluenesulfonate, (2-hydroxyethyl)trimethylphosphonium chloride, (2-hydroxyethyl)trimethylphosphonium bromide, (2-hydroxyethyl)trimethylphosphonium hydroxide, (2-hydroxyethyl)trimethylphosphonium p-to luenesulfonate, bis(polyoxyethylene)dimethylphosphonium chloride, bis (polyoxyethylene)dimethylphosphonium bromide, bis (polyoxyethylene)dimethylphosphonium hydroxide, bis (polyoxyethylene)dimethylphosphonium p-toluenesulfonate, tetraphenylphosphonium bromide, and tetraphenylphosphonium tetraphenylborate, etc.

Further, examples of the quaternary phosphonium salts (B3) other than those represented by the abovementioned general formula (VII) include acetonyltriphenylphosphonium chloride, 1H-benzotriazole-1-yloxytripyrroridinophosphonium hexafluorophosphate, 1H-benzotriazole-1-yloxytris(dimethylamino)phosphonium hexafluorophosphate, trans-2-butene-1,4-bis(triphenylphosphonium chloride), (4-carboxybutyl)triphenylphosphonium bromide, (4-carboxypropyl)triphenylphosphonium bromide, (2,4-dichlorobenzyl)triphenylphosphonium chloride, 2-dimethylaminoethyltriphenylphosphonium bromide, ethoxycarbonylmethyl(triphenyl)phosphonium bromide, (formylmethyl)triphenylphosphonium chloride, N-methylanilinotriphenylphosphonium iodide, and phenacyltriphenylphosphonium bromide, etc.

Furthermore, examples of the phosphine compound represented by the abovementioned general formula (VIII) include triethylphosphine, tripropylphosphine, tributylphosphine, tri-t-butylphosphine, tripentylphosphine, trihexylphosphine, tricyclopentylphosphine, tricyclohexylphosphine trioctylphosphine, triphenylphosphine, tri(2-furyl) phosphine, dimethylpropylphosphine, dimethylbutylphosphine, dimethylpentylphosphine, dimethylhexylphosphine, dimethylcyclohexylphosphine, dimethyloctylphosphine, dimethyldecylphosphine, dimethyldodecylphosphine, dimethyltetradecylphosphine, dimethylhexadecylphosphine, dimethyloctadecylphosphine, dimethyloleylphosphine, dimethyldocosylphosphine, diethylpropylphosphine, diethylbutylphosphine, diethylpentylphosphine, diethylhexylphosphine, diethylcyclohexylphosphine, diethyloctylphosphine, diethyldecylphosphine, diethyldodecylphosphine, diethyltetradecylphosphine, diethylhexadecylphosphine, diethyloctadecylphosphine, diethyloleylphosphine, diethyldocosylphosphine, diethylphenylphosphine, ethyldiphenylphosphine, dipropylmethylphosphine, dipropylethylphosphine, dipropylbutylphosphine, dibutylmethylphosphine, dibutylethylphosphine, dibutylpropylphosphine, dihexylmethylphosphine, dihexylethylphosphine, dihexylpropylphosphine, dihexylbutylphosphine, dicyclohexylmethylphosphine, dicyclohexylethylphosphine, dicyclohexylpropylphosphne, dicyclohexylbutylphosphine, dicyclohexylphenylphosphine, dioctylmethylphosphine, dioctylethylphosphine, dioctylpropylphosphine, didecylmethylphosphine, didecylethylphosphine, didecylpropylphosphine, didecylbutylphosphine, didodecylmethylphosphine, didodecylethylphosphine, didodecylpropylphosphine, didodecylbutylphosphine, ditetradecylmethylphosphine, ditetradecylethylphosphine, ditetradecylpropylphosphine, ditetradecylbutylphosphine, dihexadecylmethyiphosphine, dihexadecylethylphosphine, dihexadecylpropylphosphine, dihexadecylbutylphosphine, trimethanolphosphine, triethanolphosphine, tripropanolphosphine, tributanolphosphine, trihexanolphosphine, diethylmethanolphosphine, dipropylmethanolphosphine, diisopropylmethanolphosphine, dibutylmethanolphosphine, diisobutylmethanolphosphine, di-t-butylmethanolphosphine, di(2-ethylhexyl) methanolphosphine, dimethylethanolphosphine, diethylethanolphosphine, dipropylethanolphosphine, diisopropylethanolphosphine, dibutylethanolphosphine, diisobutylethanolphosphine, di-t-butylethanolphosphine, di-t-butylphenylphosphine, di(2-ethylhexyl)ethanolphosphine, dimethylpropanolphosphine, diethylpropanolphosphine, dipropylpropanolphosphine, diisopropylpropanolphosphine, dibutylpropanolphosphine, diisobutylpropanolphosphine, di-t-butylpropanolphosphine, di(2-ethylhexyl)propanolphosphine, methyldimethanolphosphine, ethyldimethanolphosphine, propyldimethanolphosphine, isopropyldimethanolphosphine, butyldimethanolphosphine, isobutyldimethanolphosphine, t-butyldimethanolamine, (2-ethylhexyl)dimethanolphosphine, methyldiethanolphosphine, ethyldiethanolphosphine, propyldiethanolphosphine, isopropyldiethanolphosphine, butyldiethanolphosphine, isobutyldiethano1phosphine, t-butyldiethanolphosphine, (2-ethylhexyl)diethanolphosphine, isopropylphenylphosphine, methoxydiphenylphosphine, ethoxydiphenylphosphine, triphenylphosphine, diphenylmethylphosphine, diphenylethylphosphine, diphenylcyclohexylphosphine, diphenylpropylphosphine, diphenylbutylphosphine, diphenyl-t-butylphosphine, diphenylpentylphosphine, diphenylhexylphosphine, diphenyloctylphosphine, diphenylbenzylphosphine, phenoxydiphenylphosphine, diphenyl-1-pyrenylphosphine, phenyldimethylphosphine, trimethylphosphine, triethylphosphine, tripropylphosphine, tri-t-butylphosphine, tripentylphosphine, trihexylphosphine, tri-n-octylphosphine, tri-o-tolylphosphine, tri-m-tolylphosphine, and tris-2,6-dimethoxyphenylphosphine, etc.

Further, examples of the phosphine (B3) other than those represented by the abovementioned general formula (VIII) include phenyl-2-pyridylphosphine, triphenylphosphine oxide, 1,4-bis(diphenylphosphino)ethane, 1,4-bis(diphenylphosphino)propane, and 1,4-bis(diphenylphosphino)butane, etc.

In this invention, the sizing agent may contain one or more components other than the components (A) and (B). For example, a polyalkylene oxide such as polyethylene oxide or polypropylene oxide, higher alcohol, polyhydric alcohol, alkylphenol, a compound obtained by adding apolyalkylene oxide such as polyethylene oxide or polypropylene oxide to styrenated phenol, or a nonionic surfactant such as a block copolymer between ethylene oxide and propylene oxide can be preferably used. Further, to such an extent that the effect of this invention is not affected, a polyester resin, unsaturated polyester compound or the like can also be added as appropriate.

In this invention, the sizing agent to be used can be diluted with a solvent. Examples of the solvent include water, methanol, ethanol, isopropanol, acetone, methyl ethyl ketone, dimethylformamide, and dimethyl acetamide. Among them, in view of such advantages as easy handling and safety, water can be preferably used.

In this invention, it is preferred that the deposited amount of the sizing agent is in a range from 0.1 to 10 parts by mass per 100 parts by mass of carbon fibers. A more preferred range is 0.2 to 3 parts by mass. In the case where the deposited amount of the sizing agent is 0.1 part by mass or more, when the carbon fibers are formed into a prepreg or woven into a fabric, the carbon fibers can withstand the friction with metallic guides and the like over and under which they pass, to inhibit fuzzing, making the carbon fiber sheet excellent in appearance quality such as smoothness. On the other hand, if the deposited amount of the sizing agent is 10 parts by mass or less, the matrix resin such as an epoxy resin can be impregnated into the carbon fiber bundles without being prevented by the film of the sizing agent formed around the carbon fiber bundles, and the formation of voids in the obtained composite material can be inhibited, making the composite material excellent in appearance quality and also excellent in mechanical properties.

In this invention, it is preferred that the thickness of the sizing agent applied to the carbon fibers and dried is kept in a range from 2 to 20 nm, and that the maximum value of the thickness is not more than double the minimum value. Such a uniformly thick sizing agent layer can provide a stably large adhesion enhancing effect and also assures stable and excellent processability.

In this invention, the carbon fibers to be coated with the sizing agent can be, for example, polyacrylonitrile (PAN)-based or rayon-based or pitch-based carbon fibers. Among them, PAN-based carbon fibers excellent in the balance between strength and elastic modulus can be preferably used.

The method for producing PAN-based carbon fibers is explained below.

As the spinning method for obtaining the precursor fibers of carbon fibers, a wet spinning method, dry spinning method, semi-wet spinning method or the like can be used. Among them, it is preferred to use a wet spinning method or semi-wet spinning method since carbon fibers with high strength are likely to be obtained. As the spinning dope, a solution, suspension or the like of homopolymer or copolymer of polyacrylonitrile can be used.

The abovementioned spinning dope is passed through a spinneret, to be spun, coagulated, washed with water and stretched for obtaining precursor fibers, and the obtained precursor fibers are treated for stabilization, treated for carbonization, and as required, treated for graphitization, to obtain carbon fibers. As the condition of carbonization treatment and graphitization treatment, it is preferred that the highest heat treatment temperature is 1100° C. or higher, and a more preferred range is 1400 to 3000° C.

In this invention, since carbon fibers with high strength and high elastic modulus can be obtained, it is preferred to use thin filaments as carbon fibers. Particularly, it is preferred that the single filament diameter of carbon fibers is 7.5 μm or less. More preferred is 6 μm or less, and further more preferred is 5.5 μm or less. There is no particular limit to the lower limit of single filament diameter, but if the single filament diameter is 4.5 μm or less, single filaments are likely to be broken to lower productivity as the case may be.

The obtained carbon fibers are normally subjected to oxidation treatment, for having oxygen-containing functional groups introduced therein, in order to enhance the adhesion to the matrix resin. The oxidation treatment method can be gas phase oxidation, liquid phase oxidation or liquid phase electrolytic oxidation. In view of high productivity and uniform treatment possibility, liquid phase electrolytic oxidation can be preferably used.

In this invention, as the electrolyte used for liquid phase electrolytic oxidation, an acidic electrolyte and an alkaline electrolyte can be used.

Examples of the acidic electrolyte include inorganic acids such as sulfuric acid, nitric acid, hydrochloric acid, phosphoric acid, boric acid and carbonic acid, organic acids such as acetic acid, butyric acid, oxalic acid, acrylic acid and maleic acid, and salts such as ammonium sulfate and ammonium hydrogen sulfate. Among them, sulfuric acid and nitric acid, which are strongly acidic, can be preferably used.

Examples of the alkaline electrolyte include aqueous solutions of hydroxides such as sodium hydroxide, potassium hydroxide, magnesium hydroxide, calcium hydroxide and barium hydroxide, aqueous solutions of carbonates such as sodium carbonate, potassium carbonate, magnesium carbonate, calcium carbonate, barium carbonate and ammonium carbonate, aqueous solutions of hydrogencarbonates such as sodium hydrogencarbonate, potassium hydrogencarbonate, magnesium hydrogencarbonate, calcium hydrogencarbonate, barium hydrogencarbonate and ammonium hydrogencarbonate, aqueous solutions of ammonia, tetraalkylammonium hydroxides and hydrazine, etc. Among them, an aqueous solution of ammonium carbonate or ammonium hydrogencarbonate, or an aqueous solution of a strongly alkaline tetraalkylammonium hydroxide can be preferably used from the viewpoint that an alkali metal causing the hardening inhibition of the matrix resin is not contained.

In this invention, from the viewpoint that the covalent bond formation between the epoxy compound (A) and the oxygen-containing functional groups on the surface of carbon fibers is promoted to further enhance the adhesion, it is preferred to coat the carbon fibers with the sizing agent after performing the electrolytic treatment with an alkaline electrolyte or after washing with an alkaline aqueous solution in succession to the electrolytic treatment with an acidic aqueous solution. In the case where an electrolytic treatment is performed, the excessively oxidized portions on the surface of carbon fibers exist at the interface as a fragile layer, and they may act as starting points of breakage. Consequently it can be considered that if the excessively oxidized portions are dissolved and removed by the alkaline aqueous solution, the covalent bond formation is promoted. Further, if the residue of the acidic electrolyte exists on the surface of carbon fibers, the protons in the residue are caught by the component (B), and the originally intended effect of the component (B) to extract the hydrogen ions of the oxygen-containing functional groups on the surface of carbon fibers may decline as the case may be. Therefore, it is preferred that the electrolytic treatment in an acidic aqueous solution is followed by the neutralization and washing of the acidic electrolyte by an alkaline aqueous solution. For the abovementioned reason, the specifically treated carbon fibers and the sizing agent in combination can provide further higher adhesion.

It is preferred that the concentration of the electrolyte used in this invention is in a range from 0.01 to 5 moles/liter. A more preferred range is 0.1 to 1 mole/liter. If the concentration of the electrolyte is 0.01 mole/liter or higher, the electrolytic treatment voltage can be lowered advantageously in view of operation cost. On the other hand, if the concentration of the electrolyte is 5 moles/liter or lower, there is an advantage in view of safety.

It is preferred that the temperature of the electrolyte used in this invention is in a range from 10 to 100° C. A more preferred range is 10 to 40° C. If the temperature of the electrolyte is 10° C. or higher, the efficiency of electrolytic treatment can be enhanced advantageously in view of operation cost. On the other hand, if the temperature of the electrolyte is 100° C. or lower, there is an advantage in view of safety.

In this invention, it is preferred to optimize the quantity of electricity in liquid phase electrolytic oxidation in reference to the carbonization degree of carbon fibers, and in the case where carbon fibers with a higher elastic modulus is treated, a larger quantity of electricity is necessary.

In this invention, it is preferred that the current density in liquid phase electrolytic oxidation is kept in a range from 1.5 to 1000 $A/m^2$ of the surface area of the carbon fibers in the electrolytic treatment solution. A more preferred range is 3 to 500 $A/m^2$. If the current density is 1.5 $A/m^2$ or higher, the efficiency of electrolytic treatment can be enhanced advantageously in view of operation cost. On the other hand, if the current density is 1000 $A/m^2$ or lower, there is an advantage in view of safety.

In this invention, it is preferred to wash carbon fibers with an alkaline aqueous solution after oxidation treatment from the viewpoint that the covalent bond foimation between the epoxy compound (A) and the oxygen-containing functional groups on the surface of carbon fibers is promoted to further enhance the adhesion. Above all, it is preferred to wash with an alkaline aqueous solution in succession to the liquid phase electrolytic treatment in an acidic electrolyte.

In this invention, it is preferred that the pH of the alkaline aqueous solution used for washing is kept in a range from 7 to 14. A more preferred range is 10 to 14. Examples of the alkaline aqueous solution include aqueous solutions of hydroxides such as sodium hydroxide, potassium hydroxide, magnesium hydroxide, calcium hydroxide and barium hydroxide, aqueous solutions of carbonates such as sodium carbonate, potassium carbonate, magnesium carbonate, calcium carbonate, barium carbonate and ammonium carbonate, aqueous solutions of hydrogencarbonates such as sodium hydrogencarbonate, potassium hydrogencarbonate, magnesium hydrogencarbonate, calcium hydrogencarbonate, barium hydrogencarbonate and ammonium hydrogencarbonate, aqueous solutions of ammonia, tetraalkylammonium hydroxides and hydrazine, etc. Among them, an aqueous solution of ammonium carbonate or ammonium hydrogencarbonate, or an aqueous solution of a strongly alkaline tetraalkylammonium hydroxide can be preferably used from the viewpoint that an alkali metal causing the hardening inhibition of the matrix resin is not contained.

In this invention, the method for washing the carbon fibers with an alkaline aqueous solution can be, for example, a dip method or a spray method. Above all, a dip method can be preferably used in view of easy washing. Further, a method of dipping while ultrasonically vibrating the carbon fibers is a preferred mode.

In this invention, after the carbon fibers are electrolytically treated or washed with an alkaline aqueous solution, it is preferred to wash the carbon fibers with water and to dry. In this case, if the drying temperature is too high, the functional groups existing on the outermost surface of the carbon fibers are likely to disappear due to thermal decomposition, and accordingly it is desirable to dry at a temperature as low as possible. A particularly preferred drying temperature is 250° C. or lower, and it is more preferred to dry at 210° C. or lower.

The means for applying the sizing agent to the carbon fibers (for coating) can be, for example, a method of immersing the carbon fibers into the sizing agent using rollers, a method of bringing the carbon fibers into contact with the rollers having the sizing agent deposited thereon, or a method of spraying the sizing agent as a mist to the carbon fibers. Further, the sizing agent applying means can be either a batch method or a continuous method. A continuous method is preferred because of high productivity and little variation. In this case, it is preferred to control the sizing agent concentration, temperature, fiber tension and the like in order to ensure that the effective component of the sizing agent may be uniformly deposited on the carbon fibers while the deposited amount of the effective component is kept in an adequate range. Further, ultrasonically vibrating the carbon fibers while the sizing agent is applied is also a preferred mode.

In this invention, after the carbon fibers are coated with the sizing agent, it is necessary to perform heat treatment in a temperature range from 160 to 260° C. for 30 to 600 seconds. Preferred heat treatment conditions are a heat treatment temperature range from 170 to 250° C. and a heat treatment time range from 30 to 500 seconds. More preferred heat treatment conditions are a heat treatment temperature range from 180 to 240° C. and a heat treatment time range from 30 to 300 seconds. If the heat treatment temperature is lower than 160° C. and/or the heat treatment time is shorter than 30 seconds, then the covalent bond formation between the epoxy resin as the sizing agent and the oxygen-containing functional groups on the surface of carbon fibers is not promoted while the adhesion between the carbon fibers and the matrix resin remains insufficient. On the other hand, if the heat treatment temperature is higher than 260° C. and/or the heat treatment time is longer than 600 seconds, then the tertiary amine compound and/or tertiary amine salt is volatilized without promoting the covalent bond formation, while the adhesion between the carbon fibers and the matrix resin remains insufficient.

In this invention, it is preferred that the strand strength of an obtained carbon fiber bundle is 3.5 GPa or higher. More preferred is 4 GPa or higher, and further more preferred is 5 GPa or higher. Further, it is preferred that the strand elastic modulus of an obtained carbon fiber bundles is 220 GP or more. More preferred is 240 GPa or more, and further more preferred is 280 GPa or more.

In this invention, the abovementioned strand tensile strength and elastic modulus of a carbon fiber bundle can be obtained according to the following procedure in conformity with the Determination of Tensile Properties of Resin-Impregnated Yarns of JIS-R-7608 (2004). As the resin, "Celloxide" (registered trademark) 2021 P (produced by Daicel Chemical Industries, Ltd.)/boron trifluoride monoethylamine (produced by Tokyo Chemical Industry Co., Ltd.)/acetone=100/3/4 (parts by mass) was used, and curing conditions were normal pressure, 130° C. and 30 minutes. Ten strands of carbon fiber bundles were measured, and the strand tensile strength and the strand elastic modulus were obtained as mean values.

In this invention, as the carbon fibers, it is preferred that the surface oxygen concentration (O/C) as the ratio of the number of oxygen atoms (O) to the number of carbon atoms (O) on the surface of the fibers measured by X-ray photoelectron spectroscopy is in a range from 0.05 to 0.50. A more preferred range is 0.06 to 0.30, and a further more preferred range is 0.07 to 0.20. If the surface oxygen concentration (O/C) is 0.05 or more, the oxygen-containing functional groups on the surface of carbon fibers can be secured, and strong adhesion to the matrix resin can be obtained. Further, if the surface oxygen concentration (O/C) is 0.5 or less, the decline of the strength of the carbon fibers per se by oxidation can be inhibited.

The surface oxygen concentration of carbon fibers is obtained according to the following procedure by X-ray photoelectron spectroscopy. At first, the sizing agent and the like deposited on the surface of carbon fibers are removed by a solvent, and the carbon fibers are cut at 20 mm and spread and arranged on a sample support base made of copper. Then, $AlK_{\alpha 1,2}$ is used as the X-ray source, and the sample chamber is internally kept at $1\times10^{-8}$ Torr. The kinetic energy value (K.E.) of the main peak of $C_{1s}$ is adjusted to 1202 eV as the correction value of the peak involved in the electrification at the time of measurement. The $C_{1s}$ peak area is obtained by drawing a straight baseline in a range from 1191 to 1205 eV as K.E. The $O_{1s}$ peak area is obtained by drawing a straight baseline in a range from 947 to 959 eV as K.E.

In this case, the surface oxygen concentration is calculated as the ratio of the numbers of atoms by using the sensitivity correction value peculiar to the instrument from the abovementioned ratio of the $O_{1s}$ peak area to $C_{1s}$ peak area. As the X-ray photoelectron spectroscope, ESCA-1600 produced by ULVAC-PHI is used, and the sensitivity correction value peculiar to the instrument is 2.33.

Modes for obtaining the sizing agent-coated carbon fibers of this invention are explained below.

This invention is sizing agent-coated carbon fibers in which 0.001 to 3 parts by mass of one or more tertiary amine compounds and/or tertiary amine salts (B1) with a molecular weight of 100 g/mol or higher selected from the following general formulae (III), (V) and (IX) are deposited on 100 parts by mass of carbon fibers, wherein the compound represented by general foiuiula (IX) has at least one or more branched structures and contains at least one or more hydroxyl groups.

[Chemical formula 35]

Formula (III)

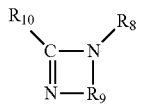

(where $R_3$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and where $R_9$ denotes an alkylene group with 3 to 22 carbon atoms and may contain an unsaturated group; and $R_{10}$ denotes any one of a hydrogen, a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; or $R_8$ and $R_{10}$ are combined to form an alkylene group with 2 to 11 carbon atoms.)

[Chemical formula 36]

Formula (V)

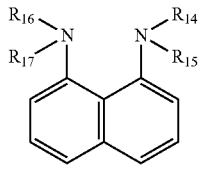

(where $R_{14}$ to $R_{17}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group.)

[Chemical formula 37]

Formula (IX)

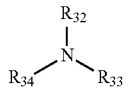

(where $R_{32}$ to $R_{34}$ denote a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and any one of $R_{32}$ to $R_{34}$ contains a branched structure represented by general formula (X) or (XI).)

[Chemical formula 38]

Formula (X)

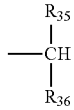

(where $R_{35}$ and $R_{36}$ denote any one of a hydrocarbon group with 1 to 10 carbon atoms, a group containing a hydrocarbon with 1 to 10 carbon atoms and an ether structure, a group containing a hydrocarbon with 1 to 10 carbon atoms and an ester structure, a group containing a hydrocarbon with 1 to 10 carbon atoms and a hydroxyl group, and a hydroxyl group.)

[Chemical formula 39]

Formula (XI)

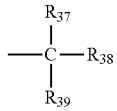

(where $R_{37}$ to $R_{39}$ denote any one of a hydrocarbon group with 1 to 10 carbon atoms, a group containing a hydrocarbon with 1 to 10 carbon atoms and an ether structure, a group containing a hydrocarbon with 1 to 10 carbon atoms and an ester structure, a group containing a hydrocarbon with 1 to 10 carbon atoms and a hydroxyl group, and a hydroxyl group.)

The tertiary amine compound used in this invention refers to a compound having a tertiary amino group in the molecule. Further, the tertiary amine salt used in this invention refers to a salt obtained by neutralizing a compound having a tertiary amino group by a proton donor. In this case, a proton donor refers to a compound having an active hydrogen capable of being given as a proton to a compound having a tertiary amino group. Meanwhile, an active hydrogen refers to a hydrogen atom given as a proton to a basic compound.

In this invention, the branched structure of the aforementioned general formula (IX) refers to a structure represented by the general formula (X) or (XI).

The $R_{35}$ to $R_{39}$ of the abovementioned general formula (X) and (XI) of the present invention denote, respectively independently, any one of a hydrocarbon group with 1 to 10 carbon atoms, a group containing a hydrocarbon with 1 to 10 carbon atoms and an ether structure, a hydrocarbon with 1 to 10 carbon atoms and an ester structure, a group with 1 to 10 carbon atoms and a hydroxyl group, and a hydroxyl group. If the number of carbon atoms is kept in a range from 1 to 10, the steric hindrance of the molecular structure is moderately small and the reaction promotion effect becomes so high as to enhance the adhesion. A more preferred range is 1 to 5, and a further more preferred range is 1 to 5. On the other hand, if the number of carbon fibers is more than 10, the steric hindrance of the molecular structure may be rather larger and the reaction promotion effect may decline as the case may be.

The $R_8$ and $R_{14}$ to $R_{17}$ of the abovementioned general formulae (III) and (V) of this invention denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group. If the number of carbon atoms is kept in a range from 1 to 22, the steric hindrance of the molecular structure is moderately small and the reaction promotion effect becomes so high as to enhance the adhesion. A more preferred range is 1 to 14, and a further more preferred range is 1 to 8. On the other hand, if the number of carbon atoms is more than 22, the steric hindrance of the molecular structure may be rather larger and the reaction promotion effect may decline as the case may be.

The $R_{32}$ to $R_{34}$ of the abovementioned general formula (IX) of this invention denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group. Any one of $R_{32}$ to $R_{34}$ contains a branched structure represented by the general formula (X) or (XI). If the number of carbon atoms is kept in a range from 1 to. 22, the steric hindrance of the molecular structure is moderately small and the reaction promotion effect becomes so high as to enhance the adhesion. A more preferred range is 1 to 14, and a further more preferred range is 1 to 8. On the other hand, if the number of carbon atoms is more than 22, the steric hindrance of the molecular structure may be rather large and the reaction promotion effect may decline as the case may be.

The $R_9$ of the abovementioned general formula (III) of this invention denotes an alkylene group with 3 to 22 carbon atoms, and may contain an unsaturated group. If the number of atoms is kept in a range from 3 to 22, the steric hindrance of the molecular structure is moderately small and the reaction promotion effect becomes so high as to enhance the adhesion. A more preferred range is 3 to 14, and a further more preferred range is 3 to 8. On the other hand, if the number of atoms is more than 22, the steric hindrance of the molecular structure may be rather large and the reaction promotion effect may decline as the case may be.

The $R_{10}$ of the abovementioned general formula (III) of this invention denotes any one of a hydrogen, a hydrocarbon group with 1 to 22 carbon atoms, a group containing a hydrocarbon with 1 to 22 carbon atoms an ether structure, a group containing a hydrocarbon with 1 to 22 carbon atoms and an ester structure, and a group containing a hydrocarbon with 1 to 22 carbon atoms and a hydroxyl group. If the number of carbon atoms is kept in a range from 1 to 22, the steric hindrance of the molecular structure is moderately small and the reaction promotion effect becomes so high as to enhance the adhesion. A more preferred range is 1 to 14, and a further more preferred range is 1 to 8. On the other hand, if the number of carbon atoms is more than 22, the steric hindrance of the molecular structure may be rather large and the reaction promotion effect may decline as the case may be.

In this case, the hydrocarbon group with 1 to 22 carbon atoms is a group comprising carbon and hydrogen atoms only, and can be either a saturated hydrocarbon group or an unsaturated hydrocarbon group, containing and not containing a ring structure. Examples of the hydrocarbon group include a methyl group, ethyl group, propyl group, butyl group, pentyl group, hexyl group, cyclohexyl group, octyl group, decyl group, dodecyl group, tetradecyl group, hexadecyl group, octadecyl group, oleyl group, docosyl group, benzyl group and phenyl group, etc.

Further, examples of the group containing a hydrocarbon with 1 to 22 carbon atoms and an ether structure, if straight chain, include polyether groups such as a methoxymethyl group, ethoxymethyl group, propoxymethyl group, butoxymethyl group, phenoxymethyl group, methoxyethyl group, ethoxyethyl group, propoxyethyl group, butoxyethyl group, phenoxyethyl group, methoxyethoxymethyl group, methoxyethoxyethyl group, polyethylene glycol group and polypropylene glycol group. Examples of the group containing a hydrocarbon with 1 to 22 carbon atoms and an ether structure, if cyclic, include ethylene oxide, tetrahydrofuran, oxepane, 1,3-dioxolan, etc.

Further, examples of the group containing a hydrocarbon with 1 to 22 carbon atoms and an ester structure include an acetoxymethyl group, acetoxyethyl group, acetoxypropyl group, acetoxybutyl group, methacroyloxyethyl group and benzoyloxyethyl group, etc.

Furthermore, examples of the group containing a hydrocarbon with 1 to 22 hydrocarbon and a hydroxyl group include a hydroxymethyl group, hydroxyethyl group, hydroxypropyl group, hydroxybutyl group, hydroxypentyl group, hydroxyhexyl group, hydroxycyclohexyl group, hydroxyoctyl group, hydroxydecyl group, hydroxydodecyl group, hydroxytetradecyl group, hydroxyhexadecyl group, hydroxyoctadecyl group, hydroxyoleyl group and hydroxy docosyl group, etc.

In this invention, at least one or more tertiary amine compounds and/or tertiary amine salts (B1) with a molecular weight of 100 g/mol or higher selected from the general formulae (III), (V) and (IX) are deposited by 0.001 to 3 parts by mass per 100 parts by mass of carbon fibers. A preferred range is 0.003 to 0.8 part by mass, and a more preferred range is 0.005 to 0.3 part by mass. If the deposited amount is 0.001 to 3 parts by mass, the reaction between the functional groups on the surface of carbon fibers and the functional group contained in the matrix resin is promoted to enhance the adhesion enhancing effect.

In this invention, examples of the compound represented by the aforementioned general formula (III) include 1,8-diazabicyclo[5,4,0]-7-undecene (DBU), 1,5-diazabicyclo[4,3,0]-5-nonene (DBN), 1,4-diazabicyclo[2,2,2]octane, 5,6-dibutylamino-1,8-diazabicyclo[5,4,0]-undecene-7 (DBA), and salts thereof. Examples of DBU salts include phenol salt of DBU (U-CAT SA1, produced by San-Apro Ltd.), octylate of DBU (U-CAT SA102 produced by San-Apro Ltd.), p-toluenesulfonate of DBU (U-CAT SA506 produced by San-Apro Ltd.), formate of DBU (U-CAT SA603 produced by San-Apro Ltd.), orthophthalate of DBU (U-CAT SA810), and phenol novolac resin salts of DBU (U-CAT SA810, SA831, SA841, SA851 and 881 produced by San-Apro Ltd.), etc.

In this invention, from the viewpoint that the compound represented by the aforementioned general formula (III) extracts hydrogen ions from the oxygen-containing functional groups such as carboxyl groups and hydroxyl groups of carbon fibers and promotes the nucleophilic reaction with the matrix resin, 1,5-diazabicyclo[4,3,0]-5-nonene or a salt thereof, or 1,8-diazabicyclo[5,4,0]-7-undecene or a salt thereof is preferred. The compound represented by the aforementioned general formula (III) has a cyclic structure and therefore is considered to have high affinity with the carbon fibers having also cyclic carbon mesh surfaces, and this is considered to allow the hydrogen ions of the functional groups on the surface of carbon fibers to be efficiently and effectively extracted.

In this invention, it is necessary that the compound represented by the aforementioned general formula (IX) has at least one or more branched structures and contains at least one or more hydroxyl groups. Having two or more branched structures is preferred, and having three or more branched structures is more preferred. If the compound has a branched structure, steric hindrance properties can be enhanced to inhibit the reaction between epoxy rings, and the reaction promotion effect between the functional groups on the surface of carbon fibers and the epoxy can be enhanced. Further, if the compound has at least one or more hydroxyl groups, the interaction with the functional groups on the surface of carbon fibers can be enhanced for allowing the protons of the functional groups on the surface of carbon fibers to be efficiently extracted, and the reactivity with the epoxy can be enhanced.

In this invention, examples of the compound represented by the aforementioned general formula (IX) include diisobutylmethanolamine, ditertiarybutylmethanolamine, di(2-ethylhexyl)methanolamine, diisopropylethanolamine, diisobutylethanolamine, ditertiarybutylethanolamine, di(2-ethylhexyl)ethanolamine, diisopropylpropanolamine, diisobutylpropanol amine, ditertiarybutylpropanolamine, di(2-ethyl hexyl)propanolamine, isopropyl dimethanolamine, isobutyldimethanolamine, tertiarybutyldimethanolamine, (2-ethylhexyl)dimethanolamine, isopropyldiethanolamine, isobutyldiethanolamine, tertiarybutyldiethanolamine, (2-ethylhexyl)diethanolamine, dimethylisopropanolamine, di ethylisopropanolamine, methyldiisopropanolamine, ethyldiisopropanolamine, propyldiisopropanolamine, butyldiisopropanolamine, and triisopropanolamine.

In this invention, it is preferred that the compound represented by the aforementioned general formula (IX) is triisopropanolamine or a salt thereof. Since triisopropanolamine has three hydroxyl groups, the interaction with the functional groups on the surface of carbon fibers can be enhanced for allowing the protons of the functional groups on the surface of carbon fibers to be efficiently extracted, and the reactivity with the epoxy can be enhanced. Further, since it has three branched structures, the steric hindrance properties can be enhanced to inhibit the reaction between epoxy rings, and the reactivity between the functional groups on the surface of carbon fibers and the epoxy can be enhanced.

In this invention, examples of the compound represented by the aforementioned general formula (V) include 1,8-bis(dimethylamino)naphthalene, 1,8-bis(diethylamino)naphthalene, 1,8-bis(dipropylamino)naphthalene, 1,8-bis(dibutylamino)naphthalene, 1,8-bis(dipentylamino)naphthalene, 1,8-bis(dihexylamino)naphthalene, 1-dimethylamino-8-methylamino-quinolidine, 1-dimethylamino-7-methyl-8-methylamino-quinolidine, 1-dimethylamino-7-methyl-8-methylamino-isoquinoline, 7-methyl-1,8-methylamino-2,7-naphthyridine, and 2,7-dimethyl-1,8-methylamino-2,7-naphthyridine, etc.

In this invention, from the viewpoint that the compound represented by the aforementioned general formula (V) extracts the hydrogen ions of oxygen-containing functional groups such as carboxyl groups and hydroxyl groups of carbon fibers, to promote the reaction with the matrix resin, 1,8-bis(dimethylamino)naphthalene or a salt thereof is preferred. Since the compound represented by the aforementioned general formula (V) has benzene rings, it is considered that affinity is enhanced owing to the π-π interaction with the carbon fibers having carbon mesh surfaces, and this is considered to allow the hydrogen ions of the functional groups on the surface of carbon fibers to be efficiently and effectively extracted.

In this invention, it is preferred that the acid dissociation constant (pKa) of the conjugate acid of the tertiary amine compound is 9 or more. More preferred is 11 or more. In the case where the acid dissociation constant (pKa) is 9 or more, the reaction between the oxygen-containing functional groups such as carboxyl groups and hydroxyl groups of carbon fibers and the epoxy is promoted to enhance the adhesion enhancing effect. Examples of the tertiary amine compound include DBU (pKa 12.5), DBN (pKa 12.7), 1,8-bis(dimethylamino)naphthalene (pKa 12.3), etc.

In this invention, further, as the component (A), it is preferred in view of further higher adhesion that a di- or higher functional epoxy compound (A1) and an epoxy compound (A2) having mono- or higher functional groups and at least one or more types of functional groups selected from hydroxyl groups, amide groups, imide groups, urethane groups, urea groups, sulfonyl groups and sulfo groups are deposited. In this invention, it is preferred that the tertiary amine compound and/or tertiary amine salt (B1) is mixed by 0.1 to 25 parts by mass per 100 parts by mass of the epoxy compound (A). A more preferred range is 0.5 to 20 parts by mass, and a further more preferred range is 2 to 15 parts by mass. The most preferred range is 2 to 8 parts by mass.

In this invention, it is preferred that the epoxy equivalent of the component (A) is less than 360 g/mol. More preferred is less than 270 g/mol, and further more preferred is less than 180 g/mol. If the epoxy equivalent is less than 360 g/mol, covalent bonding is formed at high density between the oxygen-containing functional groups such as carboxyl groups and hydroxyl groups of the carbon fibers used in this invention and the epoxy groups, to further enhance the adhesion. There is no particular limit to the lower limit of the epoxy equivalent, but if the epoxy equivalent is less than 90 g/mol, the adhesion may be saturated as the case may be.

In this invention, it is preferred that the component (A) is a tri- or higher functional epoxy compound. More preferred is a tetra- or higher functional epoxy compound. If the component (A) is a tri- or higher functional epoxy compound having three or more epoxy groups in the molecule, even in the case where one epoxy group forms covalent bonding with an oxygen-containing functional group such as a carboxyl group or hydroxyl group of carbon fibers, the remaining two or more epoxy groups can form covalent bonding with the matrix resin, to further enhance the adhesion. There is no particular limit to the upper limit of the number of epoxy groups, but if the number of epoxy groups is 10 or more, the adhesion may be saturated as the case may be.

In this invention, it is preferred that the component (A) has one or more aromatic ring in the molecule, and having two or more aromatic rings is more preferred. In the fiber reinforced composite material comprising the carbon fibers of this invention and a matrix resin, the so-called interface layer near the carbon fibers may have properties different from those of the matrix resin, being affected by the carbon fibers or sizing agent. If the epoxy compound as the component (A) has one or more aromatic rings, a rigid interface layer is formed to enhance the stress transmission capability between the carbon fibers and the matrix resin, and to enhance the mechanical properties such as 0° tensile strength of the fiber reinforced composite material. There is no particular limit to the upper limit of the number of aromatic rings, but if the number of aromatic rings is 10 or more, the mechanical properties may be saturated as the case may be.

In this invention, it is preferred that (A1) is any one of a phenol novolac type epoxy resin, a cresol novolac type epoxy resin and tetraglycidyl diaminodiphenylmethane. These epoxy resins are large in the number of epoxy groups and small in epoxy equivalent and have two or more aromatic rings, and therefore they can enhance the adhesion between the carbon fibers of this invention and the matrix resin, and in addition, enhance the mechanical properties such as 0° tensile strength of the fiber reinforced composite material. It is more preferred that the di- or higher functional epoxy resin is a phenol novolac type epoxy resin or a cresol novolac type epoxy resin.

In this invention, it is preferred that the carbon fibers are such that the surface oxygen concentration (O/C) as the ratio of oxygen atoms (O) to carbon atoms (C) on the surface of the fibers measured by X-ray photoelectron spectroscopy is kept in a range from 0.05 to 0.50. A more preferred range is 0.06 to 0.30, and a further more preferred range is 0.07 to 0.20. If the surface oxygen concentration (O/C) is 0.05 or higher, the oxygen-containing functional groups on the surface of carbon fibers can be secured, and strong adhesion to the matrix resin can be obtained. Further, if the surface oxygen concentration (O/C) is 0.5 or lower, the decline of the strength of the carbon fibers per se by oxidation can be inhibited.

As the matrix resin, a thermosetting resin and a thermoplastic resin can be used.

Examples of the thermosetting resin include an unsaturated polyester resin, vinyl ester resin, epoxy resin, phenol resin, melamine resin, urea resin, cyanate ester resin and bismaleimide resin, etc. Among them, it is preferred to use an epoxy resin in view of such advantages as excellent balance of mechanical properties and small cure shrinkage. For the purpose of enhancing toughness and the like, a thermosetting resin can be made to contain any thermoplastic resin described later or an oligomer thereof.

Examples of the thermoplastic resin include polyesters such as polyethylene terephthalate (PET), polybutylene terephthalate (PBT), polytrimethylene terephthalate (PTT), polyethylene naphthalate (PEN) and liquid crystal polyesters, polyolefins such as polyethylene (PE), polypropylene (PP) and polybutylene, styrene-based resins, further, polyoxymethylene (POM), polyamide (PA), polycarbonate (PC), polymethylene methacrylate (PMMA), polyvinyl chloride (PVC), polyphenylene sulfide (PPS), polyphenylene ether (PPE), modified PPE, polyimide (PI), polyamideimide (PAI), polyether imide (PEI), polysulfone (PSU), modified PSU, polyethersulfone, polyketone (PK), polyetherketone (PEK), polyetheretherketone (PEEK), polyetherketoneketone (PEKK), polyarylate (PAR), polyethemitrile (PEN), phenol-based resins, phenoxy resin and fluorine-based resins such as polytetrafluoroethylene, further, thermoplastic elastomers such as polystyrene-based elastomer, polyolefin-based elastomer, polyurethane-based elastomer, polyester-based elastomer, polyamide-based elastomer, polybutadiene-based elastomer, polyisoprene-based elastomer and fluorine-based elastomer, copolymers thereof, modification products thereof, and resins obtained by blending two or more of theforegoing, etc.

A composite material in which the matrix resin is a thermosetting resin is explained below.

The carbon fibers obtained by the carbon fiber production method of this invention can be used in any mode of, for example, a tow, woven fabric, knitted fabric, braids, web, mat and chopped fibers. In particular, for applications requiring high specific strength and high specific elastic modulus, a tow in which carbon fibers are paralleled in one direction is most suitable, and further, a prepreg impregnated with a matrix resin can also be preferably used.

The aforementioned prepreg can be produced by a wet process of dissolving a matrix resin into a solvent such as methyl ethyl ketone or methanol for lowering the viscosity, and impregnating, or a hot melt process (dry process) of heating to lower the viscosity and impregnating, or the like.

The wet process is a method in which carbon fibers are immersed in a matrix resin solution and are pulled up for evaporating the solvent by using an oven or the like. Further, the hot melt process is a method in which the reinforcing fibers are directly impregnated with the matrix resin lowered in viscosity by heating, or a method in which a film once prepared by coating releasing paper or the like with the matrix resin is overlaid on either or both sides of carbon fibers, the laminate then being heated and pressurized to impregnate the carbon fibers with the matrix resin. The hot melt process is a preferred method, since no solvent substantially remains in the prepreg.

A method of laminating layers of the obtained prepreg and subsequently applying a pressure to the laminate while heating for curing the matrix resin or the like is used to prepare a composite material. As the method of applying heat and pressure in this case, a press molding method, autoclave molding method, packing molding method, wrapping tape method, internal pressure molding method or the like can be employed. The composite material can also be produced by a method of impregnating the carbon fibers directly with the matrix resin and subsequently heating for curing, without using the inteimediately produced prepreg, for example, by a molding method such as a hand layup method, resin injection molding method, resin transfer molding method or the like. In these methods, it is preferred to mix two components comprising a main component of a matrix resin and a curing agent component, to prepare the intended resin immediately before use.

A composite material in which the matrix resin is a thermoplastic resin is explained below.

A composite material in which a thermoplastic resin is used as the matrix resin can be molded by such a molding method as injection molding (injection compression molding, gas-assist injection molding, insert molding, etc.), blow molding, rotational molding, extrusion molding, press molding, transfer molding, or filament winding molding, and in view of productivity, injection molding can be preferably used.

As the modes of the molding material used in such molding, pellets, stampable sheet, prepreg and the like can be used, and the most preferred molding material is pellets used for injection molding. The aforementioned pellets refer to pellets obtained by kneading a thermoplastic resin and chopped fibers or continuous fibers in an extruder, extruding and pelletizing. In the aforementioned pellets, the fiber length in each pellet becomes shorter than the length of the pellet in the longitudinal direction, but pellets also include long-fiber pellets. A long-fiber pellet refers to a pellet in which fibers are arranged in almost parallel to the longitudinal direction of the pellet while the fiber length is the same as or longer than the pellet length, as described in JP 63-37694 B. In this case, the thermoplastic resin may be impregnated in or covered with a fiber bundle. In particular, in the case of a long-fiber pellet covered with a thermoplastic resin, the fiber bundle may also be impregnated with a resin having a viscosity (or molecular weight) identical to or lower than the covering resin.

In order that the composite material may have both excellent conductivity and excellent mechanical properties (especially strength and impact resistance), it is effective to elongate the fibers in the molded article, and for this purpose, among the aforementioned pellets, it is preferred to use long-fiber pellets for molding.

The molded articles comprising the carbon fibers obtained by the carbon fiber production method of this invention and a thermosetting resin and/or a thermoplastic resin can be used, for example, as the housings, interior members such as trays and chassis and cases thereof of electric and electronic devices such as personal computers, displays, OA devices, cell phones, portable information terminals, facsimiles, compact discs, portable MDs, portable radio cassettes, PDAs (portable information terminals such as electronic organizers), video cameras, digital still cameras, optical devices, audio devices, air conditioners, illuminating devices, amusement articles, toy articles and other home use electric appliances, building materials such as mechanism parts and panels, the parts, members and outside plates of motor vehicles and two-wheelers such as motor parts, alternator terminals, alternator connectors, IC regulators, potentiometer bases for light dimmers, suspension parts, various valves such as exhaust gas valves, various pipes for fuels, exhaust systems and suction systems, air intake nozzle snorkels, intake manifolds, various arms, various frames, various hinges, various bearings, fuel pumps, gasoline tanks, CNG tanks, engine cooling water joints, carburetor main bodies, carburetor spacers, exhaust gas sensors, cooling water sensors, oil temperature sensors, brake pad wear sensors, throttle position sensors, crankshaft position sensors, air float meters, brake pad wear sensors, thermostat bases for air conditioners, space heating air flow control valves, brush holders for radiator motors, water pump impellers, turbine vanes, wiper motor parts, distributors, starter switches, starter relays, wire harnesses for transmissions, window washer nozzles, air conditioner panel switch boards, fuel solenoid valve coils, fuse connectors, battery trays, AT brackets, head lamp supports, pedal housings, handles, door beams, protectors, chassis, frames, arm rests, horn terminals, step motor rotors, lamp sockets, lamp reflectors, lamp housings, brake pistons, noise shields, radiator supports, spare tire covers, seat shells, solenoid bobbins, engine oil filters, igniter cases, under covers, scuff plates, pillar trims, propeller shafts, wheels, fenders, fascia, bumpers, bumper beams, bonnets, aero-parts, platforms, cowl louvers, roofs, instrument panels, spoilers and various modules, the parts, members and outside plates of aircraft such as landing gear pods, winglets, spoilers, edges, rudders, elevators, fairings and ribs, vanes of windmills, etc. In particular, the molded articles can be preferably used as aircraft members, windmill vanes, motor vehicle outside plates, and the housings, trays and chassis of electronic devices, etc.

EXAMPLES

This invention is explained below specifically in reference to examples, but is not limited thereto or thereby.

(Strand Tensile Strength and Elastic Modulus of Carbon Fiber Bundle)

The strand tensile strength and strand elastic modulus of a carbon fiber bundle were obtained according to the following procedure in conformity with the resin-impregnated strand testing method of JIS-R-7608 (2004). As the resin, "Celloxide" (registered trademark) 2021P (produced by Daicel Chemical Industries, Ltd.)/boron trifluoride monoethylamine (produced by Tokyo Chemical Industry Co., Ltd.)/acetone=100/3/4 (parts by mass) was used, and curing conditions were normal pressure, temperature 125° C. and time 30 minutes. Ten carbon fiber bundles were measured, and the mean values were obtained as the strand tensile strength and the strand elastic modulus.

(Surface Oxygen Concentration (O/C) of Carbon Fibers)

The surface oxygen concentration (O/C) of carbon fibers was obtained according to the following procedure by X-ray photoelectron spectroscopy. At first, the contaminant deposited on the surface was removed by a solvent, and the carbon fibers were cut at approx. 20 mm and spread on a sample support base made of copper. Then, the sample support base was set in a sample chamber, and the sample chamber was internally kept at $1\times10^{-8}$ Torr. In succession, $AlK_{\alpha1,2}$ was used as the X-ray source, and measurement was performed at a photoelectron escape angle of 90°. Meanwhile, the kinetic energy value (K.E.) of the main peak of $C_{1s}$ was adjusted to 1202 eV as the correction value of the peak involved in the electrification at the time of measurement. The $C_{1s}$ peak area was obtained by drawing a straight baseline in a range from 1191 to 1205 eV as K.E. Further, the $O_{1s}$ peak area was obtained by drawing a straight baseline in a range from 947 to 959 eV as K.E. In this case, the surface oxygen concentration was calculated as the ratio of the numbers of atoms by using the sensitivity correction value peculiar to the instrument from the abovementioned ratio of the $O_{1s}$ peak area to $C_{1s}$ peak area. As the X-ray photoelectron spectroscope, ESCA-1600 produced by ULVAC-PHI was used, and the sensitivity correction value peculiar to the instrument was 2.33.

(Method for Measuring the Deposited Amount of the Sizing Agent)

A carbon fiber bundle with approx. 2 g of a sizing agent deposited thereon was weighed (W1) (read to the fourth decimal place), and subsequently was allowed to stand in an electric furnace (capacity 120 $cm^3$) with the temperature set at 450° C. in a nitrogen stream of 50 ml/min for 15 minutes, to perfectly thermally decompose the sizing agent. Subsequently the carbon fibers were transferred into a vessel in a dry nitrogen steam of 20 l/min, to be cooled for 15 minutes, then being weighed (W2) (read to the fourth decimal place). From W1-W2, the deposited amount of the sizing agent was obtained. The deposited amount of the sizing agent was converted into the value corresponding to 100 parts by mass of the carbon fiber bundle (by counting a fraction of 0.005 and over as 0.01 and cutting away the rest), and the value was employed as the deposited amount (parts by mass) of the sizing agent. The measurement was performed twice, and the mean value was employed as the amount (parts by mass) of the sizing agent.

(Measurement of Interfacial Shear Strength (IFSS))

The interfacial shear strength (IFSS) was measured according to the following procedures (a) through (d).

(a) Preparation of Resin

One hundred parts by mass of bisphenol A type epoxy resin compound "jER" (registered trademark) 828 (produced by Mitsubishi Chemical Corporation) and 14.5 parts by mass of metaphenylenediamine (produced by Sigma-Aldrich Japan) were placed in respectively different vessels. Then, in order to lower the viscosity of the abovementioned jER828 and to dissolve metaphenylenediamine, they were heated at a temperature of 75° C. for 15 minutes. Subsequently, they were sufficiently mixed, and the mixture was defoamed in vacuum at a temperature of 80° C. for approximately 15 minutes.

(b) Fixing Single Carbon Filaments to a Special Mold

From the carbon fiber bundle, single filaments were pulled out, and both the ends were fixed by using an adhesive in the state where a certain tension in the longitudinal direction of a dumbbell-shaped mold was applied. Then, the mold and the carbon fibers were dried in vacuum at a temperature of 80° C. for 30 minutes or longer in order to remove the water deposited on the carbon fibers and the mold. The dumbbell-shaped mold was made of silicone rubber. As the form of the casting portion, the width of the central portion was 5 mm and the length was 25 mm. The width at both the end portions was 10 mm and the entire length was 150 mm.

(c) From Resin Casting to Curing

The resin prepared according to the abovementioned procedure(a) was cast into the mold dried in vacuum according to the abovementioned procedure (b), and by using an oven, the resin was heated up to a temperature of 75° C. at a heating rate of 1.5° C./min, held for 2 hours, then heated up to a temperature of 125° C. at a heating rate of 1.5 minutes, held for 2 hours, and subsequently cooled down to a temperature of 30° C. at a cooling rate of 2.5° C./min. Then, the resin was taken out of the mold, to obtain a specimen.

(d) Measurement of Interfacial Shear Strength (IFSS)

To the specimen obtained according to the abovementioned procedure (c), a tensile force was applied in the fiber axis direction (longitudinal direction), to cause a strain of 12%, and subsequently the number (N) of the fibers broken in a 22 mm central range of the specimen was counted by using a polarization microscope. Then, the average broken fiber length (la) was calculated from the formula of la (μm)=22×1000 (μm)/N. Subsequently, using the average broken fiber length (la), the critical fiber length (lc) was calculated from the formula of lc (μm)=(4/3)×la (μm). The strand tensile strength (σ) and the diameter (d) of a single carbon filament were measured, and the interfacial shear strength (IFSS) as an indicator of the bonding strength of the interface between the carbon fibers and the resin was calculated from the following formula. In each example, five specimens were measured, and the mean value was employed as the test result.

$$\text{Interfacial shear strength (IFSS) (MPa)} = \sigma(\text{MPa}) \times d\,(\mu\text{m}) / (2 \times lc)\,(\mu\text{m})$$

The materials and components used in the respective examples and respective comparative examples were as follows.

Component (A1): A-1 to A-7

A-1: "jER" (registered trademark) 152 (produced by Mitsubishi Chemical Corporation), glycidyl ether of phenol novolac; epoxy equivalent . . . 175 g/mol, number of epoxy groups . . .

A-2: "EPICLON" (registered trademark) N660 (produced by DIC Corporation), glycidyl ether of cresol novolac; epoxy equivalent . . . 206 g/mol, number of epoxy groups . . . 4.3

A-3: "Araldite" (registered trademark) MY721 (produced by Huntsman Advanced Materials), N,N,N',N'-tetraglycidyl-4,4'-diaminodiphenylmethane; epoxy equivalent . . . 113 g/mol, number of epoxy groups . . . 4

A-4: "jER" (registered trademark) 828 (produced by Mitsubishi Chemical Corporation), diglycidyl ether of bisphenol A; epoxy equivalent . . . 189 g/mol, number of epoxy groups 2

A-5: "jER" (registered trademark) 1001 (produced by Mitsubishi Chemical Corporation), diglycidyl ether of bisphenol A; epoxy equivalent 475 g/mol, number of epoxy groups . . . 2

A-6: "Denacol" (registered trademark) EX-810 (produced by Nagase ChemteX Corporation), diglycidyl ether of ethylene glycol; epoxy equivalent . . . 113 g/mol, number of epoxy groups . . . 2

A-7: TETRAD-X (produced by Mitsubishi Gas Chemical Co., Inc.), tetraglycidyl metaxylenediamine;epoxy equivalent . . . 100 g/mol, number of epoxy groups . . . 4

Applicable to Both Components (A1) and (A2): A-8

A-8: "Denacol" (registered trademark) EX-611 (produced by Nagase ChemteX Corporation), sorbitol polyglycidyl ether; epoxy equivalent . . . 167 g/mol, number of epoxy groups . . . 4, number of hydroxyl groups . . . 2

Component (A2): A-9 and A-10

A-9: "Denacol" (registered trademark) EX-731 (produced by Nagase ChemteX Corporation), N-glycidylphthalimide; epoxy equivalent . . . 216 g/mol, number of epoxy groups . . . 1, number of imide groups . . . 1

A-10: "Adeka Resin" (registered trademark), EPU-6 (produced by Adeka Corporation), urethane-modified epoxy; epoxy equivalent . . . 250 g/mol, number of epoxy groups . . . 1 or more, number of urethane groups . . . 1 or more Component (B1): B-1 to B-13, B-25 to B-27

B-1: "DBU" (registered trademark) (produced by San-Apro Ltd.), (corresponding to formula (III)), 1,8-diazabicyclo[5,4,0]-undecene,molecular weight . . . 152

B-2: Tributylamine (produced by Tokyo Chemical Industry Co., Ltd.), molecular weight . . . 185.4, (corresponding to formula (IV))

B-3: N,N-dimethylbenzylamine (produced by Tokyo Chemical Industry Co., Ltd.), molecular weight . . . 135.21, (corresponding to formula (IV))

B-4: 1,8-bis(dimethylamino)naphthalene (produced by Aldrich)

Alias: Proton Sponge, molecular weight . . . 214.31, (corresponding to formula (V)) B-5: 2,4,6-tris(dimethylaminomethyl)phenol (produced by Tokyo Chemical Industry Co., Ltd.)

Alias:DMP-30, molecular weight . . . 265.39, (corresponding to formula (VI))

B-6: DBN (produced by San-Apro Ltd.), molecular weight . . . 124, (corresponding to formula (III)), 1,5-diazabicyclo[4,3,0]-nonene B-7 Imidazole-based compound, 1-benzyl-imidazole (produced by Tokyo Chemical Industry Co., Ltd.), molecular weight . . . 158.2

B-8: U-CAT SA1 (produced by San-Apro Ltd.) (corresponding to formula (III)), DBU-phenol salt, molecular weight . . . 246.11

B-9: U-CAT SA102 (produced by San Apro Ltd.) (corresponding to formula (III)), DBU-octylate, molecular weight . . . 296.45

B-10: U-CAT SA506 (produced by San Apro Ltd.) (corresponding to formula (III)), DBU-p-toluenesulfonate, molecular weight . . . 324.44

B-11: N-ethylmorpholine (produced by Tokyo Chemical Industry Co, Ltd.), molecular weight . . . 115.17

B-12: 2,6-lutidine (produced by Tokyo Chemical Industry Co., Ltd.), molecular weight . . . 107.15

B-13: 4-pyridine methanol (produced by Tokyo Chemical Industry Co., Ltd.), molecular weight . . . 109.13

B-25: Triisopropanolamine (produced by Tokyo Chemical Industry Co., Ltd.), molecular weight . . . 191.27, (corresponding to formula (IX))

B-26: Triethanolamine (produced by Tokyo Chemical Industry Co., Ltd.), molecular weight . . . 149.19, (corresponding to formula (IV))

B-27: N,N-diisopropylethylamine (produced by Tokyo Chemical Industry Co., Ltd.), molecular weight . . . 129.24, (corresponding to formula (IV))

Component (B2): B-14 to B-20

B-14: Benzyltrimethylammonium bromide (the number of carbon atoms of $R_1$ is 7; the number of carbon atoms of each of $R_2$ to $R_4$ is 1; bromide anion as theanionic moiety; produced by Tokyo Chemical Industry Co., ltd.)

B-15: Tetrabutylammonium bromide (the number of carbon atoms of each of $R_1$ to $R_4$ is 4; bromide anion as theanionic moiety; produced by Tokyo Chemical Industry Co., Ltd.)

B-16: Trimethyloctadecylammonium bromide (the number of carbon atoms of $R_1$ is 18; the number of carbon atoms of each of $R_2$ to $R_4$ is 1; bromide anion as theanionic moiety; produced by Tokyo Chemical Industry Co., Ltd.)

B-17: (2-methoxyethoxymethyl)triethylammonium chloride (the number of carbon atoms of $R_1$ is 4; the number of carbon atoms of each of $R_2$ to $R_4$ is 2; chloride anion as theanionic moiety; produced by Tokyo Chemical Industry Co., Ltd.)

B-18: (2-acetoxyethyl)trimethylammonium chloride (the number of carbon atoms of $R_1$ is 4; the number of carbon atoms of each of $R_2$ to $R_4$ is 1; chloride anion as theanionic moiety; produced by Tokyo Chemical Industry Co., Ltd.)

B-19: (2-hydroxyethyl)trimethylammonium bromide (the number of carbon atoms of $R_1$ is 2; the number of carbon atoms of each of $R_2$ to $R_4$ is 1; bromide anion as theanionic moiety; produced by Tokyo Chemical Industry Co., Ltd.)

B-20: 1-hexadecylpyridinium chloride (the number of carbon atoms of $R_5$ is 16, each of $R_6$ and $R_7$ denotes a hydrogen atom; chloride anion as the anionic moiety; produced by Tokyo Chemical Industry Co., Ltd.)

Component (B3): B-21 to B-24

B-21: Tetrabutylphosphonium bromide (the number of carbon atoms of each of $R_{25}$ to $R_{28}$ is 4; bromide anion as the anionic moiety; produced by Tokyo Chemical Industry Co., Ltd.); molecular weight . . . 339

B-22: Tetraphenylphosphonium bromide (the number of carbon atoms of each of $R_{25}$ to $R_{28}$ is 6; bromide anion as the anionic moiety; produced by Tokyo Chemical Industry Co., Ltd.); molecular weight . . . 419

B-23: Tributylphosphine (the number of carbon atoms of each of $R_{29}$ to $R_{31}$ is 4; produced by Tokyo Chemical Industry Co., Ltd.); molecular weight . . . 202

B-24: Triphenylphosphine (the number of carbon atoms of each of $R_{29}$ to $R_{31}$ is 6; produced by Tokyo Chemical Industry Co., Ltd.); molecular weight . . . 262

Component (C) (other component): C-1 to C-4

C-1: "Deconal" (registered trademark) EX-141 (produced by Nagase ChemteX Corporation); phenyl glycidyl ether, epoxy equivalent . . . 151 g/mol, number of epoxy groups . . . 1

C-2: N,N-diethylmethylamine (produced by Tokyo Chemical Industry Co., Ltd.); molecular weight . . . 87

C-3: Hexamethylenediamine (produced by Tokyo Chemical Industry Co., Ltd.); molecular weight . . . 116

C-4: Glycidyl methacrylate (produced by Sumitomo Chemical Co., Ltd.); number of epoxy groups . . . 1, unsaturated group . . . 1

Example 1

This example comprises the following first process and second process.

First Process: Process for Producing Carbon Bibers to be Used as a Starting Material A copolymer consisting of 99 mol % of acrylonitrile and 1 mol % of itaconic acid was spun, and the obtained filaments were burned to obtain carbon fibers comprising 24,000 filaments in total, with a total fineness of 800 tex, a specific gravity of 1.8, a strand tensile strength of 6.2 GPa, and a strand tensile modulus of 300 GPa. Subsequently, the carbon fibers were electrolytically treated on the surface with 100 coulombs of electricity per 1 g of the carbon fibers by using, as an electrolyte, an ammonium hydrogencarbonate aqueous solution with a concentration of 0.1 mole/l. The electrolytically surface-treated carbon fibers were washed with water in succession and dried in heated air with a temperature of 150° C., to obtain the carbon fibers to be used as a starting material. The surface oxygen concentration (O/C) in this case was 0.20. The carbon fibers are called carbon fibers (A).

Second Process: Process for Depositing a Sizing Agent on Carbon Fibers

The aforementioned (A-1) and the aforementioned (B-1) were mixed at a ratio by mass of 100:1, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 210° C. for 90 seconds, to obtain a sizing agent-coated carbon fiber bundle. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The result is shown in Table 1 together with the results of other examples. As a result, the IFSS value was 38 MPa, and it was found that the adhesion was sufficiently high.

Examples 2 to 5

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 1, except that the ratio by mass of (A-1):(B-1) was changed in a range from 100:3 to 100:20 as shown in Table 1 in the second process of Example 1. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 35 to 47 MPa. It was found that the adhesion was sufficiently high in every example. Among the examples, in the cases where the ratios by mass of (A-1):(B-1) were 100:3 or 100:6, the adhesion was very excellent. The results are shown in Table 1.

Comparative Example 1

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 1, except that (A-1) only was used in the second process of Example 1. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS value was 25 MPa. It was found that the adhesion was insufficient. The result is shown in Table 1.

Comparative Example 2

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 1, except that the ratio by mass of (A-1):(B-1) was changed to 100:30 in the second process of Example 1. The deposited amount of the sizing agent was 1 part by mass per 100 parts by mass of the surface-treated carbon fibers. Since the mass of (B-1) was large, the measured interfacial shear strength (IFSS) of the sizing agent-coated carbon fibers obtained was 20 MPa, and it was found that the adhesion was insufficient. The result is shown in Table 1

Examples 6 to 10

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 2, except that the heat treatment temperature was changed in a range from 180 to 260° C. while the heat treatment time was changed in a range from 45 to 480 seconds as shown in Table 2 in the second process of Example 2. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 33 to 42 MPa. It was found that the adhesion was sufficiently high in every example. Among the examples, in the case where the heat treatment temperature was 220° C. while the heat treatment time was 90 seconds, the adhesion was very excellent. The results are shown in Table 2.

Comparative Examples 3 to 6

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 2, except that the heat treatment temperature was changed in a range from 150 to 280° C. while the heat treatment time was changed in a range from 15 to 700 seconds as shown in Table 2 in the second process of Example 2. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were

TABLE 1

| | | | Example 1 | Example 2 | Example 3 | Example 4 | Example 5 | Comparative Example 1 | Comparative Example 2 |
|---|---|---|---|---|---|---|---|---|---|
| Component (A) (parts by mass) | A-1 | jER152 | 100 | 100 | 100 | 100 | 100 | 100 | 100 |
| | A-2 | N660 | | | | | | | |
| | A-3 | MY721 | | | | | | | |
| | A-4 | jER828 | | | | | | | |
| | A-5 | jER1001 | | | | | | | |
| | A-6 | EX-810 | | | | | | | |
| | A-7 | TETRAD-X | | | | | | | |
| Component (B) (parts by mass) | B-1 | DBU | 1 | 3 | 6 | 15 | 20 | | 30 |
| | B-2 | Tributylamine | | | | | | | |
| | B-3 | N,N-dimethylbenzylamine | | | | | | | |
| | B-4 | Proton sponge | | | | | | | |
| | B-5 | DMP-30 | | | | | | | |
| | B-6 | DBN | | | | | | | |
| | B-7 | 1-benzyl-imidazole | | | | | | | |
| Component (C) (parts by mass ) | C-1 | EX-141 | | | | | | | |
| | C-2 | N,N-diethylmethylamine | | | | | | | |
| | C-3 | Hexamethylenediamine | | | | | | | |
| | C-4 | Glycidyl methacrylate | | | | | | | |
| Carbon fibers | | | A | A | A | A | A | A | A |
| Heat treatment conditions | | ° C./sec | 210/90 | 210/90 | 210/90 | 210/90 | 210/90 | 210/90 | 210/90 |
| Interfacial adhesion | | IFSS(MPa) | 38 | 40 | 47 | 38 | 35 | 25 | 20 |

From the results of Examples 1 to 5 and Comparative Examples 1 and 2 shown in Table 1, the following can be seen. The sizing agent-coated carbon fibers of Examples 1 to 5 are higher in interfacial shear strength (IFSS) and therefore more excellent in interfacial adhesion than the sizing agent-coated carbon fibers of Comparative Examples 1 and 2.

26 to 28 MPa. It was found that the adhesion was insufficient in every comparative example. The results are shown in Table 2.

TABLE 2

| | | | Example 2 | Example 6 | Example 7 | Example 8 | Example 9 | Example 10 | Comparative Example 3 | Comparative Example 4 | Comparative Example 5 | Comparative Example 6 |
|---|---|---|---|---|---|---|---|---|---|---|---|---|
| Component (A) (parts by mass) | A-1 | jER152 | 100 | 100 | 100 | 100 | 100 | 100 | 100 | 100 | 100 | 100 |
| | A-2 | N660 | | | | | | | | | | |
| | A-3 | MY721 | | | | | | | | | | |
| | A-4 | jER828 | | | | | | | | | | |
| | A-5 | jER1001 | | | | | | | | | | |
| | A-6 | EX-810 | | | | | | | | | | |
| | A-7 | TETRAD-X | | | | | | | | | | |
| Component (B) (parts by mass) | B-1 | DBU | 3 | 3 | 3 | 3 | 3 | 3 | 3 | 3 | 3 | 3 |
| | B-2 | Tributylamine | | | | | | | | | | |
| | B-3 | N,N-dimethylbenzylamine | | | | | | | | | | |
| | B-4 | Proton sponge | | | | | | | | | | |
| | B-5 | DMP-30 | | | | | | | | | | |
| | B-6 | DBN | | | | | | | | | | |
| | B-7 | 1-benzylimidazole | | | | | | | | | | |
| Component (C) (parts by mass) | C-1 | EX-141 | | | | | | | | | | |
| | C-2 | N,N-diethylmethylamine | | | | | | | | | | |
| | C-3 | Hexamethylenediamine | | | | | | | | | | |
| | C-4 | Glycidyl methacrylate | | | | | | | | | | |
| Carbon fibers | | | A | A | A | A | A | A | A | A | A | A |
| Heat treatment conditions | | ° C./sec | 210/90 | 180/90 | 220/90 | 220/45 | 210/480 | 260/90 | 280/90 | 150/90 | 210/15 | 210/700 |
| Interfacial adhesion | | IFSS(MPa) | 40 | 39 | 42 | 38 | 36 | 33 | 26 | 27 | 28 | 27 |

From the results of Examples 2 and 6 to 10 and Comparative Examples 3 to 6 shown in Table 2, the following can be seen. The sizing agent-coated carbon fibers of Examples 2 and 6 to 10 are higher in interfacial shear strength (IFSS) and therefore more excellent in interfacial adhesion than the sizing agent-coated carbon fibers of Comparative Examples 3 to 6 different in heat treatment conditions.

Example 11

First Process: Process for Producing Carbon Fibers to be Used as a Starting Material The process was the same as that of Example 1.

Second Process: Process for Depositing a Sizing Agent on Carbon Fibers (A-1) and (B-3) were mixed at a ratio by mass of 100:3, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 210° C. for 180 seconds, to obtain sizing agent-coated carbon fibers. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The result is shown in Table 3 together with the results of other examples. As a result, the IFSS value was 39 MPa, and it was found that the adhesion was sufficiently high.

Examples 12 to 16

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 11, except that the component (A) was changed to any one of the aforementioned (A-2) to (A-6) as shown in Table 3 in the second process of Example 11. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 31 to 39 MPa. It was found that the adhesion was sufficiently high in every example. Among the examples, in the case of (A-3), the adhesion was very excellent. The results are shown in Table 3.

Comparative Example 7

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 10, except that (A-1) was changed to the aforementioned (C-1) as shown in Table 3 in the second process of Example 11. The deposited amount of the sizing agent was 1 part by mass per 100 parts by mass of the surface-treated carbon fibers. The sizing agent-coated carbon fibers obtained were used to measure the interfacial shear strength (IFS S), and as a result, the IFSS value was 27 MPa. It was found that the adhesion was insufficient. The result is shown in Table 3.

Comparative Examples 8 to 11

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 11, except that the starting material of the sizing agent was changed to (C-1) only, or (A-2) only, or (A-4) only, or (A-7) only as shown in Table 3 in the second process of Example 11. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 25 to 29 MPa. It was found that the adhesion was insufficient in every comparative example. The results are shown in Table 3.

Comparative Example 12

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 11, except that (A-1) was changed to the aforementioned (C-4) as shown in Table 3 in the second process of Example 11. The deposited amount of the sizing agent was 1 part by mass per 100 parts by mass of the surface-treated carbon fibers. The sizing agent-coated carbon fibers obtained were used to measure the interfacial shear strength (FSS). As a result, the IFSS value was 27 MPa, and it was found that the adhesion was insufficient. The result is shown in Table 3.

TABLE 3

| | | | Example 11 | Example 12 | Example 13 | Example 14 | Example 15 | Example 16 | Comparative Example 7 | Comparative Example 8 | Comparative Example 9 | Comparative Example 10 | Comparative Example 11 | Comparative Example 12 |
|---|---|---|---|---|---|---|---|---|---|---|---|---|---|---|
| Component (A) (parts by mass) | A-1 | jER152 | 100 | | | | | | | | | | | |
| | A-2 | N660 | | 100 | | | | | | | 100 | | | |
| | A-3 | MY721 | | | 100 | | | | | | | | | |
| | A-4 | jER828 | | | | 100 | | | | | | 100 | | |
| | A-5 | jER1001 | | | | | 100 | | | | | | | |
| | A-6 | EX-810 | | | | | | 100 | | | | | | |
| | A-7 | TETRAD-X | | | | | | | | | | | 100 | |
| Component (B) (parts by mass) | B-1 | DBU | | | | | | | | | | | | |
| | B-2 | Tributylamine | | | | | | | | | | | | |
| | B-3 | N,N-dimethyl-benzylamine | 3 | 3 | 3 | 3 | 3 | 3 | 3 | | | | | 3 |
| | B-4 | Proton sponge | | | | | | | | | | | | |
| | B-5 | DMP-30 | | | | | | | | | | | | |
| | B-6 | DBN | | | | | | | | | | | | |
| | B-7 | 1-benzyl-imidazole | | | | | | | | | | | | |
| Component (C) (parts by mass) | C-1 | EX-141 | | | | | | | 100 | 100 | | | | |
| | C-2 | N,N-diethyl-methylamine | | | | | | | | | | | | |
| | C-3 | Hexamethyl-enediamine | | | | | | | | | | | | |
| | C-4 | Glycidyl methacrylate | | | | | | | | | | | | 100 |
| Carbon fibers | | | A | A | A | A | A | A | A | A | A | A | A | A |
| Heat treatment conditions | | ° C./sec | 210/180 | 210/180 | 210/180 | 210/180 | 210/180 | 210/180 | 210/180 | 210/180 | 210/180 | 210/180 | 210/180 | 210/180 |
| Interfacial adhesion | | IFSS(MPa) | 37 | 39 | 34 | 39 | 31 | 35 | 27 | 26 | 27 | 25 | 29 | 27 |

From the results of Examples 11 to 16 and Comparative Examples 7 to 12 shown in Table 3, the following can be seen. The sizing agent-coated carbon fibers of Examples 11 to 16 are higher in interfacial shear strength (IFSS) and therefore more excellent in interfacial adhesion than the sizing agent-coated carbon fibers of Comparative Examples 7 to 12.

Example 17

First Process: Process for Producing Carbon Fibers to be Used as a Starting Material The process was the same as that of Example 1.

Second Process: Process for Depositing a Sizing Agent on Carbon Fibers (A-2) and (B-2) were mixed at a ratio by mass of 100:3, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 210° C. for 180 seconds, to obtain sizing agent-coated carbon fibers. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The result is shown in Table 4-1 together with the results of other examples. As a result, the IFSS value was 35 MPa, and it was found that the adhesion was sufficiently high.

Examples 18 to 20

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 17, except that the component (B) was changed to (B-4), (B-5) or (B-7) as shown in Table 4-1 in the second process of Example 17. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 31 to 44 MPa. It was found that the adhesion was sufficiently high in every example. The results are shown in Table 4-1.

Examples 21 and 22

First Process: Process for Producing Carbon Fibers to be Used as a Starting Material The process was the same as that of Example 1.

Second Process: Process for Depositing a Sizing Agent on Carbon Fibers (A-2) and (B-6) were mixed at a ratio by mass of 100:3, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 160° C. for 180 seconds or at a temperature of 210° C. for 180 seconds, to obtain sizing agent-coated carbon fibers. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The results are shown in Table 4-1 together with the results of other examples. As a result, the IFSS values were 38 MPa and 42 MPa, and it was found that the adhesion was sufficiently high.

Example 23

First Process: Process for Producing Carbon Fibers to be Used as a Starting Material Carbon fibers were produced as described in Example 1, except that a sulfuric acid aqueous solution with a concentration of 0.05 mole/l was used as the electrolyte, and that electrolytic surface treatment was performed with 20 coulombs of electricity per 1 g of carbon atoms. In this case, the surface oxygen concentration (O/C) was 0.20. The carbon fibers are called carbon fibers (B).

Second Process: Process for Depositing a Sizing Agent on Carbon Fibers

Sizing agent-coated carbon fibers were obtained by the same method as that of Example 3. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS value was 38 MPa. It was found that the adhesion was sufficiently high. The result is shown in Table 4-1.

Example 24

First Process: Process for Producing Carbon Fibers to be Used as a Starting Material The process was the same as that of Example 23.

Second Process: Process for Depositing a Sizing Agent on Carbon Fibers

Sizing agent-coated carbon fibers were obtained by the same method as that of Example 14. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS value was 32 MPa. It was found that the adhesion was sufficiently high. The result is shown in Table 4-1.

Example 25

First Process: Process for Producing Carbon Fibers to be Used as a Starting Material The carbon fibers (B) obtained in Example 23 were immersed in a tetraethylammonium hydroxide aqueous solution (pH=4), and pulled up while being ultrasonically vibrated. In this case, the surface oxygen concentration (O/C) was 0.17. The carbon fibers are called carbon fibers (C).

Second Process: Process for Depositing a Sizing Agent on Carbon Fibers

Sizing agent-coated carbon fibers were obtained by the same method as that of Example 3. The deposited amount of the sizing agent was 1 part by mass per 100 parts by mass of the surface-treated carbon fibers. The sizing, agent-coated carbon fibers obtained were used to measure the interfacial shear strength (IFSS), and as a result, the IFSS value was 41

MPa. It was found that the adhesion was sufficiently high. The result is shown in Table 4-1.

Examples 26 to 31

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 17, except that the component (B) was changed to any one of the aforementioned (B-8) to (B-13) as shown in Table 4-2 in the second process of Example 17. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 38 to 45 MPa. It was found that the adhesion was sufficiently high in every example. The results are shown in Table 4-2.

Comparative Examples 13 and 14

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 12, except that (B-3) was changed to (C-2) or (C-3) as shown in Table 4-2 in the second process of Example 12. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 26 and 27 MPa. It was found that the adhesion was insufficient in each comparative example. The results are shown in Table 4-2.

TABLE 4-1

| | | | Example 17 | Example 18 | Example 19 | Example 20 | Example 21 | Example 22 | Example 23 | Example 24 | Example 25 |
|---|---|---|---|---|---|---|---|---|---|---|---|
| Component (A) (parts by mass) | A-1 | jER152 | | | | | | | 100 | | 100 |
| | A-2 | N660 | 100 | 100 | 100 | 100 | 100 | 100 | | | |
| | A-3 | MY721 | | | | | | | | | |
| | A-4 | jER828 | | | | | | | | 100 | |
| | A-5 | jER1001 | | | | | | | | | |
| | A-6 | EX-810 | | | | | | | | | |
| | A-7 | TETRAD-X | | | | | | | | | |
| Component (B) (parts by mass) | B-1 | DBU | | | | | | | 6 | | 6 |
| | B-2 | Tributylamine | 3 | | | | | | | | |
| | B-3 | N,N-dimethyl-benzylamine | | | | | | | | 3 | |
| | B-4 | Proton sponge | | 3 | | | | | | | |
| | B-5 | DMP-30 | | | 3 | | | | | | |
| | B-6 | DBN | | | | | 3 | 3 | | | |
| | B-7 | 1-benzyl-imidazole | | | | 3 | | | | | |
| | B-8 | DBU-phenol salt | | | | | | | | | |
| | B-9 | DBU-octylate | | | | | | | | | |
| | B-10 | DBU-p-toluene-sulfonate | | | | | | | | | |
| | B-11 | Ethylmorpholine | | | | | | | | | |
| | B-12 | 2,6-lutidine | | | | | | | | | |
| | B-13 | 4-pyridinemethanol | | | | | | | | | |
| Component (C) (parts by mass) | C-1 | EX-141 | | | | | | | | | |
| | C-2 | N,N-diethyl-methylamine | | | | | | | | | |
| | C-3 | Hexamethyl-enediamine | | | | | | | | | |
| | C-4 | Glycidyl methacrylate | | | | | | | | | |
| Carbon fibers | | | A | A | A | A | A | A | B | B | C |
| Heat treatment conditions | | ° C./sec | 210/180 | 210/180 | 210/180 | 210/180 | 160/180 | 210/180 | 210/90 | 210/180 | 210/90 |
| Interfacial adhesion | | IFSS(MPa) | 35 | 44 | 37 | 31 | 38 | 42 | 38 | 32 | 41 |

TABLE 4-2

| | | | Example 26 | Example 27 | Example 28 | Example 29 | Example 30 | Example 31 | Comparative Example 13 | Comparative Example 14 |
|---|---|---|---|---|---|---|---|---|---|---|
| Component (A) (parts by mass) | A-1 | jER152 | | | | | | | | |
| | A-2 | N660 | 100 | 100 | 100 | 100 | 100 | 100 | 100 | 100 |
| | A-3 | MY721 | | | | | | | | |
| | A-4 | jER828 | | | | | | | | |
| | A-5 | jER1001 | | | | | | | | |
| | A-6 | EX-810 | | | | | | | | |
| | A-7 | TETRAD-X | | | | | | | | |

TABLE 4-2-continued

| | | | Example 26 | Example 27 | Example 28 | Example 29 | Example 30 | Example 31 | Comparative Example 13 | Comparative Example 14 |
|---|---|---|---|---|---|---|---|---|---|---|
| Component (B) (parts by mass) | B-1 | DBU | | | | | | | | |
| | B-2 | Tributylamine | | | | | | | | |
| | B-3 | N,N-dimethyl-benzylamine | | | | | | | | |
| | B-4 | Proton sponge | | | | | | | | |
| | B-5 | DMP-30 | | | | | | | | |
| | B-6 | DBN | | | | | | | | |
| | B-7 | 1-benzyl-imidazole | | | | | | | | |
| | B-8 | DBU-phenol salt | 3 | | | | | | | |
| | B-9 | DBU-octylate | | 3 | | | | | | |
| | B-10 | DBU-p-toluene-sulfonate | | | 3 | | | | | |
| | B-11 | Ethylmorpholine | | | | 3 | | | | |
| | B-12 | 2,6-lutidine | | | | | 3 | | | |
| | B-13 | 4-pyridine-methanol | | | | | | 3 | | |
| Component (C) (parts by mass) | C-1 | EX-141 | | | | | | | | |
| | C-2 | N,N-diethyl-methylamine | | | | | | | 3 | |
| | C-3 | Hexamethyl-enediamine | | | | | | | | 3 |
| | C-4 | Glycidyl methacrylate | | | | | | | | |
| Carbon fibers | | | A | A | A | A | A | A | A | A |
| Heat treatment conditions | | ° C./sec | 210/180 | 210/180 | 210/180 | 210/180 | 210/180 | 210/180 | 210/180 | 210/180 |
| Interfacial adhesion | | IFSS(MPa) | 42 | 45 | 45 | 41 | 38 | 38 | 26 | 27 |

From the results of Examples 17 to 22 shown in Table 4 and Examples 26 to 31 and Comparative Examples 13 and 14 shown in Table 4-2, the following can be seen. The sizing agent-coated carbon fibers of Examples 17 to 22 and 26 to 31 are higher in interfacial shear strength (IFSS) and therefore more excellent in interfacial adhesion than the sizing agent-coated carbon fibers of Comparative Examples 13 and 14.

Example 32

This example comprises the following first process and second process.

First Process: Process for Producing Carbon Fibers to be Used as a Starting Material A copolymer consisting of 99 mol % of acrylonitrile and 1 mol % of itaconic acid was spun, and the obtained filaments were burned to obtain carbon fibers comprising 24,000 filaments in total, with a total fineness of 800 tex, a specific gravity of 1.8, a strand tensile strength of 6.2 GPa, and a strand tensile modulus of 300 GPa. Subsequently, the carbon fibers were electrolytically treated on the surface with 100 coulombs of electricity per 1 g of the carbon fibers by using, as an electrolyte, ammonium hydrogencarbonate aqueous solution with a concentration of 0.1 mole/l. The electrolytically surface-treated carbon fibers were washed with water in succession and dried in heated air with a temperature of 150° C., to obtain the carbon fibers to be used as a starting material. The surface oxygen concentration (O/C) in this case was 0.20. The carbon fibers are called carbon fibers (A).

Second Process: Process for Depositing a Sizing Agent on Carbon Fibers

The aforementioned (A-4) and the aforementioned (B-14) were mixed at a ratio by mass of 100:1, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 210° C. for 90 seconds, to obtain a sizing agent-coated carbon fiber bundle. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The result is shown in Table 5 together with the results of other examples. As a result, the IFS S value was 35 MPa, and it was found that the adhesion was sufficiently high.

Examples 33 to 37

First Process: Process for Producing Carbon Fibers to be Used as a Starting Material The process was the same as that of Example 32.

Second Process: Process for Depositing a Sizing Agent on Carbon Fibers

Sizing agent-coated carbon fibers were obtained by the same method as that of Example 32, except that (A-4) was changed to (A-1) and that the ratio by mass of (A-1):(B-14) was changed in a range from 100:1 to 100:20 as shown in Table 5 in the second process of Example 32. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 36 to 42 MPa. It was found that the adhesion was sufficiently high in every example. Among the examples, in the cases where the ratios by mass of (A-1):(B-14) were 100:3 and 100:5, the adhesion was very excellent. The results are shown in Table 5.

Example 38

First Process: Process for Producing Carbon Fibers to be Used as a Starting Material The process was the same as that of Example 32.

Second Process: Process for Depositing a Sizing Agent on Carbon Fibers

Sizing agent-coated carbon fibers were obtained by the same method as that of Example 32, except that (A-4) was changed to (A-3) in the second process of Example 32. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS value was 42 MPa. It was found that the adhesion was sufficiently high. The result is shown in Table 5.

TABLE 5

| | | | Example 32 | Example 33 | Example 34 | Example 35 | Example 36 | Example 37 | Example 38 |
|---|---|---|---|---|---|---|---|---|---|
| Component (A) (parts by mass) | A-1 | jER152 | | 100 | 100 | 100 | 100 | 100 | |
| | A-3 | MY721 | | | | | | | 100 |
| | A-4 | jER828 | 100 | | | | | | |
| Component (B) (parts by mass) | B-14 | Benzyltrimethyl-ammonium bromide | 3 | 1 | 3 | 5 | 10 | 20 | 3 |
| | B-15 | Tetrabutylammonium bromide | | | | | | | |
| | B-16 | Trimethyloctadecyl-ammonium bromide | | | | | | | |
| | B-17 | (2-methoxyethoxymethyl) triethylammonium chloride | | | | | | | |
| | B-18 | (2-acetoxyethyl) trimethylammonium chloride | | | | | | | |
| | B-19 | (2-hydroxyethyl) trimethylammonium bromide | | | | | | | |
| | B-20 | 1-hexadecylpyridinium chloride | | | | | | | |
| Carbon fibers | | | A | A | A | A | A | A | A |
| Heat treatment conditions | | ° C./sec | 210/90 | 210/90 | 210/90 | 210/90 | 210/90 | 210/90 | 210/90 |
| Interfacial adhesion | | IFSS(MPa) | 35 | 36 | 40 | 42 | 38 | 36 | 42 |

Examples 39 to 44

First Process: Process for Producing Carbon Fibers to be Used as a Starting Material The process was the same as that of Example 32.

Second Process: Process for Depositing a Sizing Agent on Carbon Fibers

Sizing agent-coated carbon fibers were obtained by the same method as that of Example 32, except that (A-4) was changed to (A-1) and that (B-14) was changed to any one of (B-15) to (B-20) in the second process of Example 32. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 36 to 41 MPa. It was found that the adhesion was sufficiently high in every example. The results are shown in Table 6.

TABLE 6

| | | | Example 39 | Example 40 | Example 41 | Example 42 | Example 43 | Example 44 |
|---|---|---|---|---|---|---|---|---|
| Component (A) (parts by mass) | A-1 | jER152 | 100 | 100 | 100 | 100 | 100 | 100 |
| | A-3 | MY721 | | | | | | |
| | A-4 | jER828 | | | | | | |
| Component (B) (parts by mass) | B-14 | Benzyltrimethylammonium bromide | | | | | | |
| | B-15 | Tetrabutylammonium bromide | 3 | | | | | |
| | B-16 | Trimethyloctadecylammonium bromide | | 3 | | | | |
| | B-17 | (2-methoxyethoxymethyl) triethylammonium chloride | | | 3 | | | |
| | B-18 | (2-acetoxyethyl) trimethylammonium chloride | | | | 3 | | |

TABLE 6-continued

| | | | Example 39 | Example 40 | Example 41 | Example 42 | Example 43 | Example 44 |
|---|---|---|---|---|---|---|---|---|
| | B-19 | (2-hydroxyethyl) trimethylammonium bromide | | | | | 3 | |
| | B-20 | 1-hexadecylpyridinium chloride | | | | | | 3 |
| | Carbon fibers | | A | A | A | A | A | A |
| Heat treatment conditions | | ° C./sec | 210/90 | 210/90 | 210/90 | 210/90 | 210/90 | 210/90 |
| Interfacial adhesion | | IFSS(MPa) | 41 | 36 | 40 | 39 | 39 | 37 |

Examples 45 to 49

First Process: Process for Producing Carbon Fibers to be Used as a Starting Material The process was the same as that of Example 32.

Second Process: Process for Depositing a Sizing Agent on Carbon Fibers

Sizing agent-coated carbon fibers were obtained by the same method as that of Example 32, except that (A-4) was changed to (A-1), and that the heat treatment temperature was changed in a range from 180 to 240° C. while the heat treatment time was changed in a range from 30 to 480 seconds as shown in Table 7 in the second process of Example 32. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 36 to 42 MPa. It was found that the adhesion was sufficiently high in every example. Among the examples, in the case where the heat treatment temperature was 210° C. while the heat treatment time was 300 seconds, the adhesion was very excellent. The results are shown in Table 7.

Example 50

First Process: Process for Producing Carbon Fibers to be Used as a Starting Material The carbon fibers were produced as described in Example 32, except that a sulfuric acid aqueous solution with a concentration of 0.05 mole/l was used as the electrolyte, and that electrolytic surface treatment was performed with 20 coulombs of electricity per 1 g of carbon atoms. In this case, the surface oxygen concentration (O/C) was 0.20. The carbon fibers are called carbon fibers (B).

Second Process: Process for Depositing a Sizing Agent on Carbon Fibers

Sizing agent-coated carbon fibers were obtained by the same method as that of Example 32. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS value was 33 MPa. It was found that the adhesion was sufficiently high. The result is shown in Table 7.

Example 51

First Process: Process for Producing Carbon Fibers to be Used as a Starting Material The process was the same as that of Example 50.

Second Process: Process for Depositing a Sizing Agent on Carbon Fibers

Sizing agent-coated carbon fibers were obtained by the same method as that of Example 34. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS value was 36 MPa. It was found that the adhesion was sufficiently high. The result is shown in Table 7.

TABLE 7

| | | | Example 45 | Example 46 | Example 47 | Example 48 | Example 49 | Example 50 | Example 51 |
|---|---|---|---|---|---|---|---|---|---|
| Component (A) (parts by mass) | A-1 | jER152 | 100 | 100 | 100 | 100 | 100 | | 100 |
| | A-3 | MY721 | | | | | | | |
| | A-4 | jER828 | | | | | | 100 | |
| Component (B) (parts by mass) | B-14 | Benzyltrimethylammonium bromide | 3 | 3 | 3 | 3 | 3 | 3 | 3 |
| | B-15 | Tetrabutylammonium bromide | | | | | | | |
| | B-16 | Trimethyloctadecylammonium bromide | | | | | | | |
| | B-17 | (2-methoxyethoxymethyl) triethylammonium chloride | | | | | | | |
| | B-18 | (2-acetoxyethyl) trimethylammonium chloride | | | | | | | |
| | B-19 | (2-hydroxyethyl) trimethylammonium bromide | | | | | | | |
| | B-20 | 1-hexadecylpyridinium chloride | | | | | | | |
| | Carbon fibers | | A | A | A | A | A | B | B |
| Heat treatment conditions | | ° C./sec | 210/30 | 210/300 | 210/480 | 180/90 | 240/90 | 210/90 | 210/90 |
| Interfacial adhesion | | IFSS(MPa) | 38 | 42 | 40 | 39 | 36 | 33 | 36 |

Comparative Examples 15 to 17

First Process: Process for Producing Carbon Fibers to be Used as a Starting Material The process was the same as that of Example 32.

Second Process: Process for Depositing a Sizing Agent on Carbon Fibers

Sizing agent-coated carbon fibers were obtained by the same method as that of Example 32, except that any one of (A-4), (A-1) and (A-3) only was used in the second process of Example 32. The deposited amount of-the sizing agent was 1 part by mass per 100 parts by mass of the surface-treated carbon fibers. The sizing agent-coated carbon fibers obtained were used to measure the interfacial shear strength (IFSS), and as a result, the IFSS values were 23 to 29 MPa. It was found that the adhesion was insufficient. The results are shown in Table 8.

Comparative Example 18

First Process: Process for Producing Carbon Fibers to be Used as a Starting Material The process was the same as that of Example 32.

Second Process: Process for Depositing a Sizing Agent on Carbon Fibers

The aforementioned (A-1) and the aforementioned (B-14) were mixed at a ratio by mass of 100:30, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 210° C. for 90 seconds, to obtain a sizing agent-coated carbon fiber bundle. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The result is shown in Table 8 together with the results of other comparative examples. As a result, the IFSS value was 23 MPa, and it was found that the adhesion was insufficient. The result is shown in Table 8.

Comparative Examples 19 to 22

First Process: Process for Producing Carbon Fibers to be used as a Starting Material The process was the same as that of Example 32.

Second Process: Process for Depositing a Sizing Agent on Carbon Fibers

Sizing agent-coated carbon fibers were obtained by the same method as that of Example 32, except that (A-4) was changed to (A-1) and that the heat treatment temperature and the heat treatment time were changed to 210° C.×10 seconds, 210° C.×720 seconds, 140° C.×90 seconds or 280° C.×90 seconds as shown in Table 8 in the second process of Example 32. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 25 to 29 MPa. It was found that the adhesion was insufficient in every comparative example. Among the examples, in the case where the heat treatment temperature was 140° C. while the heat treatment time was 90 seconds, the adhesion was found to be insufficient. The results are shown in Table 8.

TABLE 8

| | | | Comparative Example 15 | Comparative Example 16 | Comparative Example 17 | Comparative Example 18 | Comparative Example 19 | Comparative Example 20 | Comparative Example 21 | Comparative Example 22 |
|---|---|---|---|---|---|---|---|---|---|---|
| Component (A) (parts by mass) | A-1 | jER152 | | 100 | | 100 | 100 | 100 | 100 | 100 |
| | A-3 | MY721 | | | 100 | | | | | |
| | A-4 | jER828 | 100 | | | | | | | |
| Component (B) (parts by mass) | B-14 | Benzyltrimethylammonium bromide | | | | 30 | 3 | 3 | 3 | 3 |
| | B-15 | Tetrabutylammonium bromide | | | | | | | | |
| | B-16 | Trimethyloctadecylammonium bromide | | | | | | | | |
| | B-17 | (2-methoxyethoxymethyl) triethylammonium chloride | | | | | | | | |
| | B-18 | (2-acetoxyethyl) trimethylammonium chloride | | | | | | | | |
| | B-19 | (2-hydroxyethyl) trimethylammonium bromide | | | | | | | | |
| | B-20 | 1-hexadecylpyridinium chloride | | | | | | | | |
| Carbon fibers | | | A | A | A | A | A | A | A | A |
| Heat treatment conditions | | ° C./sec | 210/90 | 210/90 | 210/90 | 210/90 | 210/10 | 210/720 | 140/90 | 280/90 |
| Interfacial adhesion | | IFSS(MPa) | 23 | 25 | 29 | 23 | 27 | 29 | 25 | 27 |

Example 52

First Process: Process for Producing Carbon Fibers to be Used as a Starting Material A copolymer consisting of 99 mol % of acrylonitrile and 1 mol % of itaconic acid was spun, and the obtained filaments were burned to obtain carbon fibers comprising 24,000 filaments in total, with a total fineness of 800 tex, a specific gravity of 1.8, a strand tensile strength of 6.2 GPa, and a strand tensile modulus of 300 GPa. Subsequently, the carbon fibers were electrolytically treated on the surface with 100 coulombs of electricity per 1 g of the carbon fibers by using, as an electrolyte, an ammonium hydrogencarbonate aqueous solution with a concentration of 0.1 mole/l. The electrolytically surface-treated carbon fibers were washed with water in succession and dried in heated air with a temperature of 150° C., to obtain the carbon fibers to be as a starting material. The surface oxygen concentration (O/C) in this case was 0.20. The carbon fibers are called carbon fibers (A).

Second Process: Process for Depositing a Sizing Agent on Carbon Fibers

The aforementioned (A-1) and the aforementioned (B-21) were mixed at a ratio by mass of 100:1, and further acetone was mixed, to obtain an approx. 1 mass% acetone solution with the sizing agent homogeneously dissolved therein. The surface-treated carbon fibers were immersed in the sizing agent acetone solution, to be coated with the sizing agent, and subsequently the coated carbon fibers were heat-treated at a temperature of 210° C. for 90 seconds, to obtain a sizing agent-coated carbon fiber bundle. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The result is shown in Table 9. As a result, the IFSS value was 39 MPa, and it was confirmed that the adhesion was sufficiently high.

Examples 53 to 56

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that the ratio by mass of (A-1):(B-21) was changed in a range from 100:3 to 100:20 as shown in Table 1 in the second process of Example 1. The deposited amount of the sizing agent was 1 part by mass per 100 parts by mass of the surface-treated carbon fibers in every sample. The sizing agent-coated carbon fibers obtained were used to measure the interfacial shear strength (IFSS), and the results are shown in Table 9. As a result, the IFSS values were 35 to 43 MPa, and it was found that the adhesion was sufficiently high in every example. Among the examples, in the cases where the ratios by mass of (A-1):(B-21) were 100:3 and 100:6, the adhesion was very excellent.

Examples 57 to 59

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that (B-21) was changed to any one of (B-22) to (B-24) and that the ratio by mass of (A-1):(B-22) or (B-23) or (B-24) was changed to 100:3 in the second process of Example 52. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 34 to 36 MPa. It was found that the adhesion was sufficiently high in every example. The results are shown in Table 9.

TABLE 9

| | | | Example 52 | Example 53 | Example 54 | Example 55 | Example 56 | Example 57 | Example 58 | Example 59 |
|---|---|---|---|---|---|---|---|---|---|---|
| Component (A) (parts by mass) | A-1 | jER152 | 100 | 100 | 100 | 100 | 100 | 100 | 100 | 100 |
| | A-2 | N660 | | | | | | | | |
| | A-3 | MY721 | | | | | | | | |
| | A-4 | jER828 | | | | | | | | |
| | A-5 | jER1001 | | | | | | | | |
| | A-6 | EX-810 | | | | | | | | |
| | A-7 | TETRA D-X | | | | | | | | |
| Component (B) (parts by mass) | B-21 | Tetrabutylphosphonium bromide | 1 | 3 | 6 | 9 | 20 | | | |
| | B-22 | Tetraphenylphosphonium bromide | | | | | | 3 | | |
| | B-23 | Tributylphosphine | | | | | | | 3 | |
| | B-24 | Triphenylphosphine | | | | | | | | 3 |
| Carbon fibers | | | A | A | A | A | A | A | A | A |
| Heat treatment conditions | | ° C./sec | 210/90 | 210/90 | 210/90 | 210/90 | 210/90 | 210/90 | 210/90 | 210/90 |
| Interfacial adhesion | | IFSS(MPa) | 39 | 42 | 43 | 38 | 35 | 36 | 35 | 34 |

Examples 60 to 65

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that (A-1) was changed to any one of (A-2) to (A-7) and that the ratio by mass of (A-2) or (A-3) or (A-4) or (A-5) or (A-6) or (A-7):(B-21) was changed to 100:3 in the second process of Example 52. The deposited amount of the sizing agent was 1 part by mass per 100 parts by mass of the surface-treated carbon fibers. The sizing agent-covered carbon fibers obtained were used to measure the interface shear stress (IFSS), and as a result, the IFSS values were 33 to 42 MPa. It was found that the adhesion was sufficiently high in every example. The results are shown in Table 10.

TABLE 10

| | | | Example 60 | Example 61 | Example 62 | Example 63 | Example 64 | Example 65 |
|---|---|---|---|---|---|---|---|---|
| Component (A) (parts by mass) | A-1 | jER152 | | | | | | |
| | A-2 | N660 | 100 | | | | | |
| | A-3 | MY721 | | 100 | | | | |
| | A-4 | jER828 | | | 100 | | | |
| | A-5 | jER1001 | | | | 100 | | |
| | A-6 | EX-810 | | | | | 100 | |
| | A-7 | TETRAD-X | | | | | | 100 |
| Component (B) (parts by mass) | B-21 | Tetrabutylphosphonium bromide | 3 | 3 | 3 | 3 | 3 | 3 |
| | B-22 | Tetraphenylphosphonium bromide | | | | | | |
| | B-23 | Tributylphosphine | | | | | | |
| | B-24 | Triphenylphosphine | | | | | | |
| | Carbon fibers | | A | A | A | A | A | A |
| Heat treatment conditions | | ° C./sec | 210/90 | 210/90 | 210/90 | 210/90 | 210/90 | 210/90 |
| Interfacial adhesion | | IFSS(MPa) | 40 | 42 | 36 | 33 | 35 | 41 |

Examples 66 to 69

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that the ratio by mass of (A-1):(B-21) was changed to 100:3 and that the heat treatment temperature was changed in a range from 160 to 240° C. while the heat treatment time was changed in a range from 30 to 480 seconds as shown in Table 11 in the second process of Example 52. The deposited amount of the sizing agent was 1 part by mass per 100 parts by mass of the surface-treated carbon fibers. The sizing agent-coated carbon fibers obtained were used to measure the interfacial shear strength (IFSS), and as a result, the IFSS values were 38 to 43 MPa. It was found that the adhesion was sufficiently high in every example. Among the examples, in the case where the heat treatment temperature was 240° C. while the heat treatment time was 90 seconds, the adhesion was very excellent. The results are shown in Table 11.

TABLE 11

| | | | Example 66 | Example 67 | Example 68 | Example 69 | Example 70 |
|---|---|---|---|---|---|---|---|
| Component (A) (parts by mass) | A-1 | jER152 | 100 | 100 | 100 | 100 | 100 |
| | A-2 | N660 | | | | | |
| | A-3 | MY721 | | | | | |
| | A-4 | jER828 | | | | | |
| | A-5 | jER1001 | | | | | |
| | A-6 | EX-810 | | | | | |
| | A-7 | TETRA D-X | | | | | |
| Component (B) (parts by mass) | B-21 | Tetrabutylphosphonium bromide | 3 | 3 | 3 | 3 | 3 |
| | B-22 | Tetraphenylphosphonium bromide | | | | | |
| | B-23 | Tributylphosphine | | | | | |
| | B-24 | Triphenylphosphine | | | | | |
| | Carbon fibers | | A | A | A | A | D |
| Heat treatment conditions | | ° C./sec | 210/30 | 210/480 | 160/90 | 240/90 | 210/90 |
| Interfacial adhesion | | IFSS (MPa) | 38 | 40 | 38 | 43 | 37 |

Example 70

First Process: Process for Producing Carbon Fibers to be Used as a Starting Material The carbon fibers were produced as described in Example 1, except that an ammonium hydrogencarbonate aqueous solution with a concentration of 0.1 mole/l was used as the electrolyte and that electrolytic surface treatment was performed with 10 coulombs of electricity per 1 g of the carbon fibers. In this case, the surface oxygen concentration (O/C) was 0.08. The carbon fibers are called carbon fibers (D).

Second Process: Process for Depositing a Sizing Agent on Carbon Fibers

Sizing agent-coated carbon fibers were obtained by the sane method as that of Example 52, except that the ratio by mass of (A-1):(B-21) was changed to 100:3 in the second process of Example 52. The deposited amount of the sizing agent was 1 part by mass per 100 parts by mass of the surface-treated carbon fibers. The sizing agent-coated carbon fibers obtained were used to measure the interfacial shear strength (IFSS), and the result is shown in Table 11. As a result, the IFSS value was 37 MPa, and it was confirmed that the adhesion was sufficiently high.

Comparative Example 23

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that (A-1) only was used in the second process of Example 52. The deposited amount of the sizing agent was 1 part by mass per 100 parts by mass of the surface-treated carbon fibers. The sizing agent-coated carbon fibers obtained were used to measure the interfacial shear strength (IFSS), and the result is shown in Table 12. As a result, the IFSS value was 25 MPa, and it was confirmed that the adhesion was insufficient.

Comparative Example 24

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that the ratio by mass of (A-1):(B-21) was changed to 100:30 in the second process of Example 52. The deposited amount of the sizing agent was 1 part by mass per 100 parts by mass of the surface-treated carbon fibers. The sizing agent-coated carbon fibers obtained were used to measure the interfacial shear strength (IFSS), and the result is shown in Table 12. As a result, the IFSS value was 20 MPa, and it was confirmed that the adhesion was insufficient.

Comparative Examples 25 to 27

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 52, except that (A-3), (A-4) or (A-6) only was used in the second process. The deposited amount of the sizing agent was 1 part by mass per 100 parts by mass of the surface-treated carbon fibers in every comparative example. The obtained sizing agent-coated carbon fibers were used to measure the interfacial shear strength (IFSS), and the results are shown in Table 12. As a result, the IFSS values were 22 to 29 MPa, and it was confirmed that the adhesion was insufficient in every comparative example.

Comparative Examples 28 and 19

First Process: Process for Producing Carbon Fibers to be Used as a Starting Material The process was the same as that of Example 52.

Second Process: Process for Depositing a Sizing Agent on Carbon Fibers

Sizing agent-coated carbon fibers were obtained by the same method as that of Example 66, except that the heat treatment time was changed to 10 or 720 seconds as shown in Table 12 in the second process of Example 66. The deposited amount of the sizing agent was 1 part by mass per 100 parts by mass of the surface-treated carbon fibers in each comparative example. The sizing agent-coated carbon fibers obtained were used to measure the interfacial shear strength (IFSS), and the results are shown in Table 12. As a result, the IFSS values were 26 and 28 MPa, and it was confirmed that the adhesion was insufficient in each comparative example.

Comparative Examples 30 and 31

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Example 53, except that the heat treatment temperature was changed to 140 or 280° C. as shown in Table 12 in the second process of Example 53. The deposited amount of the sizing agent was 1 part by mass per 100 parts by mass of the surface-treated carbon fibers in each comparative example. The sizing agent-coated carbon fibers obtained were used to measure the interfacial shear strength (IFSS), and the results are shown in Table 12. As a result, the IFSS values were 28 and 27 MPa, and it was confirmed that the adhesion was insufficient in each comparative example.

TABLE 12

| | | | Comparative Example 23 | Comparative Example 24 | Comparative Example 25 | Comparative Example 26 | Comparative Example 27 | Comparative Example 28 | Comparative Example 29 | Comparative Example 30 | Comparative Example 31 |
|---|---|---|---|---|---|---|---|---|---|---|---|
| Component (A) (parts by mass) | A-1 | jER152 | 100 | 100 | | | | 100 | 100 | 100 | 100 |
| | A-2 | N660 | | | | | | | | | |
| | A-3 | MY721 | | | 100 | | | | | | |
| | A-4 | jER828 | | | | 100 | | | | | |
| | A-5 | jER1001 | | | | | | | | | |
| | A-6 | EX-810 | | | | | 100 | | | | |
| | A-7 | TETRA D-X | | | | | | | | | |
| Component (B) (parts by mass) | B-21 | Tetrabutylphosphonium bromide | | 30 | | | | 3 | 3 | 3 | 3 |
| | B-22 | Tetraphenylphosphonium bromide | | | | | | | | | |
| | B-23 | Tributylphosphine | | | | | | | | | |
| | B-24 | Triphenylphosphine | | | | | | | | | |
| Carbon fibers | | | A | A | A | A | A | A | A | A | A |

TABLE 12-continued

| | | Comparative Example 23 | Comparative Example 24 | Comparative Example 25 | Comparative Example 26 | Comparative Example 27 | Comparative Example 28 | Comparative Example 29 | Comparative Example 30 | Comparative Example 31 |
|---|---|---|---|---|---|---|---|---|---|---|
| Heat treatment conditions | ° C./sec | 210/90 | 210/90 | 210/90 | 210/90 | 210/90 | 210/10 | 210/720 | 140/90 | 280/90 |
| Interfacial adhesion | IFSS(MPa) | 25 | 20 | 29 | 23 | 22 | 26 | 28 | 28 | 27 |

Examples 71 to 73

First Process: Process for Producing Carbon Fibers to be Used as a Starting Material The process was the same as that of Example 1.

Second Process: Process for Depositing a Sizing Agent on Carbon Fibers (A-8) and (B-1), or (A-9) and (B-1), or (A-10) and (B-1) were mixed at a ratio by mass of 100:3, and further acetone was mixed, to obtain an approx. 1 mass % acetone solution with the corresponding sizing agent homogeneously dissolved therein. The surface-treated carbon fibers were immersed in the sizing agent acetone solution, to be coated with the corresponding sizing agent, and subsequently the coated carbon fibers were heat-treated at a temperature of 210° C. for 90 seconds, to obtain sizing agent-coated carbon fibers. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The respective results are shown together in Table 13. As a result, the IFSS values were 32 to 35 MPa, and it was found that the adhesion was sufficiently high.

Comparative Examples 32 to 34

First Process: Process for Producing Carbon Fibers to be Used as a Starting Material The process was the same as that of Example 1.

Second Process: Process for Depositing a Sizing Agent on Carbon Fibers

Sizing agent-coated carbon fibers were obtained by the same method as that of Examples 71 to 73, except that (B-1) was not contained in Examples 71 to 73. Adjustment was made to ensure that 1 part by mass of the sizing agent might be depositedon 100 parts by mass of the surface-treated carbon fibers. In succession, the sizing agent-coated carbon fibers obtained were used to measure the interfacial shear strength (IFSS). The respective results are shown together in Table 13. As a result, the IFSS values were 24 to 29 MPa, and it was found that the adhesion was insufficient in every comparative example.

TABLE 13

| | | | Example 71 | Example 72 | Example 73 | Comparative Example 32 | Comparative Example 33 | Comparative Example 34 |
|---|---|---|---|---|---|---|---|---|
| Component (A) (parts by mass) | A-8 | EX-611 | 100 | | | 100 | | |
| | A-9 | EX-731 | | 100 | | | 100 | |
| | A-10 | EPU-6 | | | 100 | | | 100 |
| Component (B) (parts by mass) | B-1 | DBU | 3 | 3 | 3 | | | |
| Carbon fibers | | | A | A | A | A | A | A |
| Heat treatment conditions | | ° C./sec | 210/90 | 210/90 | 210/90 | 210/90 | 210/90 | 210/10 |
| Interfacial adhesion | | IFSS (MPa) | 35 | 33 | 32 | 29 | 25 | 24 |

Examples 74 to 76

First Process: Process for Producing Carbon Fibers to be Used as a Starting Material The process was the same as that of Example 1.

Second Process: Process for Depositing a Sizing Agent on Carbon Fibers (A-2) and (B-25), or (A-2) and (B-26), or (A-2) and (B-27) were mixed at a ratio by mass of 100:3, and further acetone was mixed, to obtain an approx. 1 mass % acetone solution with the corresponding sizing agent homogeneously dissolved therein. The surface-treated carbon fibers were immersed in the sizing agent acetone solution, to be coated with the corresponding sizing agent, and subsequently the coated carbon fibers were heat-treated at a temperature of 210° C. for 90 seconds, to obtain sizing agent-coated carbon fibers. Adjustment was made to ensure that 1 part by mass of the sizing agent might be deposited on 100 parts by mass of the surface-treated carbon fibers. In succession, the sizing agent-coated carbon fibers obtained were used to measure the interfacial shear strength (IFSS). The respective results are shown together in Table 14. As a result, the IFSS values were 35 to 44 MPa, and it was found that the adhesion was sufficiently high.

Further, among the samples, it was found that the sizing agent-coated carbon fibers containing (B-25) were highest in adhesion.

TABLE 14

| | | | Example 74 | Example 75 | Example 76 |
|---|---|---|---|---|---|
| Component (A) (parts by mass) | A-2 | N660 | 100 | 100 | 100 |
| Component (B) (parts by mass) | B-25 | Triisopropanolamine | 3 | | |
| | B-26 | Triethanolamine | | 3 | |
| | B-27 | N,N-diisopropylethylamine | | | 3 |
| Carbon fibers | | | A | A | A |
| Heat treatment conditions | | ° C./sec | 210/90 | 210/90 | 210/90 |
| Interfacial adhesion | | IFSS (MPa) | 44 | 35 | 36 |

The invention claimed is:

1. A method for producing sizing agent-coated carbon fibers coated with at least one sizing agent [a], wherein a di- or higher functional epoxy compound (A1) selected from the group consisting of a phenol novolac type epoxy resin, a cresol novolac type epoxy resin, bisphenol A diglycidyl ether, and tetraglycidyldiaminodiphenylmethane and/or a mono or higher functional epoxy compound (A2) selected from the group consisting of sorbitol type polyglycidyl ether, glycidyl phthalimide and urea modified epoxy resin are/is used as component (A), wherein the epoxy equivalent of the component (A) Is less than 360 g/mol, said method comprising the steps of:

coating carbon fibers 100 parts by mass with said sizing agent of 0.1 to 10 parts by mass; and heat-treating in a temperature range from 160 to 260°C for 30 to 500 seconds; wherein [a] is a sizing agent obtained by mixing at least 0.1 to 25 parts by mass of a tertiary amine compound and/or tertiary amine salt (B1) with a molecular weight of 100 g/mol or higher used as component (B), with 100 parts by mass of the component (A), wherein the tertiary amine compound and/or tertiary amine salt (B1) with a molecular weight of 100 g/mol or higher or the abovementioned [a ]is a tertiary amine compound and/or tertiary amine salt represented by the following general formula (III):

Formula (III)

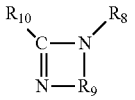

where $R_8$ denotes any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; and where $R_9$ denotes an alkylene group with 3 to 22 carbon atoms and may also contain an unsaturated group; and $R_{10}$ any one of a hydrogen, a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group; or $R_8$ and $R_{10}$ may be combined with each other to form an alkylene group with 2 to 11 carbon atoms, or the following general formula (V):

Formula (V)

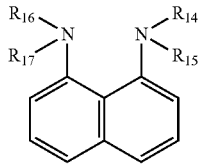

where $R_{14}$ to $R_{17}$ denote, respectively independently, any one of a hydrocarbon group with 1 to 22 carbon atoms, a group containing a hydrocarbon with 1 to 22 carbon atoms and an ether structure, a group containing a hydrocarbon with 1 to 22 carbon atoms and an ester structure, and a group containing a hydrocarbon with 1 to 22 carbon atoms and a hydroxyl group, or the following general formula (VI):

Formula (VI)

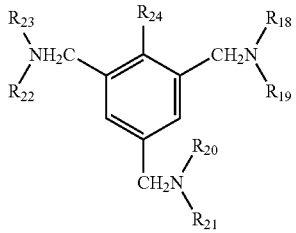

where $R_{18}$ to $R_{24}$ denote, respectively independently, any one of a hydrocarbon group with 1 to 22 carbon atoms, a group containing a hydrocarbon with 1 to 22 carbon atoms and an ester structure, a group containing a hydrocarbon with 1 to 22 carbon atoms and an ester structure, and a group containing a hydrocarbon with 1 to 22 carbon atoms and a hydroxyl group.

2. The method for producing sizing agent-coated carbon fibers, according to claim 1, wherein the compound represented by the general formula (III) is 1,5-diazabicyclo[4,3,0]nonene or a salt thereof, or 1,8-diazabicyclo[5,4,0]-7-undecene or a salt thereof.

3. The method for producing sizing agent-coated carbon fibers, according to claim 1, wherein the carbon fibers are electrolytically oxidized in a liquid phase in an alkaline or electrolyte or electrolytically oxidized in a liquid phase in an acidic electrolyte and in succession washed in an alkaline aqueous solution, being subsequently coated with the sizing agent.

4. The method for producing sizing agent-coated carbon fibers, according to claim 1, wherein the component (A) is a tri- or higher functional epoxy compound.

5. The method for producing sizing agent-coated carbon fibers, according to claim 1, wherein the component (A) comprises an aromatic ring.

6. The method for producing sizing agent-coated carbon fibers, according to claim 1, wherein the component (A1) is any one of a phenol, novolac type epoxy resin, a cresol novolac type epoxy resin and tetraglycidyldiaminodiphenylmethane.

7. The method for producing sizing agent-coated carbon fibers, according to claim 1. wherein the surface oxygen concentration (O/C) of the carbon fibers measured by X-ray photoelectron spectroscopy is 0.05 to 0.5.

* * * * *